US011638486B2

(12) United States Patent
Gwee et al.

(10) Patent No.: US 11,638,486 B2
(45) Date of Patent: May 2, 2023

(54) FURNITURE OBJECTS

(71) Applicant: Night and Day Furniture LLC, Vancouver, WA (US)

(72) Inventors: An Ling Gwee, Muar (MY); Howard Porter, Kuala Lumpur (MY); Mohammad Arib Bin Zaine, Muar (MY)

(73) Assignee: Night and Day Furniture LLC, Vancouver, WA (US)

( * ) Notice: Subject to any disclaimer, the term of this patent is extended or adjusted under 35 U.S.C. 154(b) by 381 days.

(21) Appl. No.: 16/809,718

(22) Filed: Mar. 5, 2020

(65) Prior Publication Data

US 2021/0076832 A1 Mar. 18, 2021

Related U.S. Application Data

(60) Provisional application No. 62/900,928, filed on Sep. 16, 2019.

(51) Int. Cl.

| | |
|---|---|
| ***A47C 17/52*** | (2006.01) |
| ***A47C 17/54*** | (2006.01) |
| ***A47C 19/22*** | (2006.01) |
| ***A47C 19/02*** | (2006.01) |
| ***A47C 19/12*** | (2006.01) |

(52) U.S. Cl.

CPC ..... *A47C 19/22* (2013.01); *A47C 19/024* (2013.01); *A47C 19/122* (2013.01)

(58) Field of Classification Search

CPC ..... A47C 17/52; A47C 17/54; A47C 17/56; A47C 17/58; A47C 17/60; A47C 17/62

See application file for complete search history.

(56) References Cited

U.S. PATENT DOCUMENTS

| | | | | | |
|---|---|---|---|---|---|
| 820,951 | A * | 5/1906 | Brown | A47C 17/48 | 5/149 |
| 1,170,149 | A * | 2/1916 | Gustafson | A47C 17/48 | 5/503.1 |
| 1,528,031 | A * | 3/1925 | Smith | A47C 17/48 | 5/503.1 |
| 2,073,293 | A * | 3/1937 | Ybanez | A47C 17/60 | 5/2.1 |

(Continued)

*Primary Examiner* — Peter M. Cuomo
*Assistant Examiner* — Ifeolu A Adeboyejo
(74) *Attorney, Agent, or Firm* — Harness, Dickey & Pierce, P.L.C.

(57) ABSTRACT

A furniture object, configured to store a foldable bed, may include a fixed panel and a foldable support platform including distal and proximate support panels. The fixed panel may include a bottom panel, an upper surface of the bottom panel at least partially defining a bottom inner surface of a compartment within an interior of the furniture object. The proximate support panel may be hingeably connected at opposite edges to the distal support panel and the one or more fixed panels via separate hingeable connections. The foldable support platform may between a folded position and a deployed position via a scissors-type motion. In the folded position, the foldable support platform may partially enclose the compartment. In the deployed position, the foldable support platform and bottom panel may collectively define a sleeping platform that structurally supports a bed resting on the proximate and distal support panels and the bottom panel.

19 Claims, 29 Drawing Sheets

(56) References Cited

U.S. PATENT DOCUMENTS 2,257,753 A * 10/1941 Martin ..... A47C 17/17 5/140
2,257,754 A * 10/1941 Martin ..... A47C 17/161 5/313.1
2,544,762 A * 3/1951 Lochridge ..... A47C 17/48 5/154
2,562,197 A * 7/1951 Martin ..... A47C 17/161 5/154
3,316,564 A * 5/1967 Rogers, Jr. ..... A47C 19/20 5/8
3,596,984 A * 8/1971 Jones ..... A47C 17/22 297/75
3,755,832 A * 9/1973 Bennett ..... A47C 17/38 5/2.1
4,365,369 A * 12/1982 Plume ..... A47C 17/161 5/55.1
4,660,235 A * 4/1987 Plume ..... A47C 17/175 5/55.1
4,793,011 A 12/1988 Eve
5,033,134 A * 7/1991 Burchett ..... A47C 17/52 5/167
6,167,579 B1 * 1/2001 Kopish ..... A47C 17/62 5/2.1
6,568,001 B2 * 5/2003 Walsh ..... A47C 19/22 5/2.1
6,739,651 B1 * 5/2004 Barefoot ..... A47C 17/161 297/118
7,774,872 B2 * 8/2010 Sanders, Jr. ..... A47C 17/62 5/8
8,566,980 B2 * 10/2013 Grone ..... A47C 17/58 5/164.1
9,591,928 B2 * 3/2017 Martinez ..... A47C 17/17
10,575,631 B2 * 3/2020 Baugh ..... A47C 17/62
D884,395 S * 5/2020 Flora ..... D6/663
2006/0225210 A1 * 10/2006 Arason ..... A47C 17/58 5/159.1
2019/0191889 A1 * 6/2019 Flora ..... A47C 17/58
2020/0113341 A1 * 4/2020 Rodriguez ..... A47C 7/624

* cited by examiner

100 [110, 120]

110 [112, 114, 116, 118-1, 118-2]

132 [132-1, 132-2]

FURNITURE OBJECTS

CROSS-REFERENCE TO RELATED APPLICATION

The present application is a non-provisional application that claims priority to U.S. provisional application No. 62/900,928, filed on Sep. 16, 2019, the contents of which are incorporated by reference in their entirety.

FIELD

The present disclosure relates to furniture objects configured to store foldable beds.

BACKGROUND

The statements in this section merely provide background information related to the present disclosure and may not constitute prior art.

Often, furniture apparatuses capable of more than one function are used in environments (e.g., residential, commercial, etc.) where space is limited. For example, foldable beds, such as Murphy beds, may be used in such environments to increase available empty space when not being used as beds. In such environments, these foldable beds may make more efficient use of the limited space and may relieve the need for additional furniture.

SUMMARY

Example embodiments relate to furniture objects configured to store foldable beds.

According to some example embodiments, a furniture object configured to store a foldable bed may include one or more fixed panels and a foldable support platform. The one or more fixed panels may partially enclose a compartment within an interior of the furniture object. The one or more fixed panels may include a bottom panel. An upper surface of the bottom panel may at least partially define a bottom inner surface of the compartment. The foldable support platform may include distal and proximate support panels. The proximate support panel may be hingeably connected at opposite edges to the distal support panel and the one or more fixed panels via separate hingeable connections. The foldable support platform may be configured to move between a folded position and a deployed position via a scissors-type motion, wherein, in the folded position, the foldable support platform at least partially encloses the compartment, such that a first surface of the distal support panel defines an outer surface of the furniture object and a first surface of the proximate support panel defines a front inner surface of the compartment, and, in the deployed position, the foldable support platform, in combination with the bottom panel, defines a sleeping platform configured to structurally support the foldable bed resting, in an unfolded configuration, on the first surfaces of the proximate and distal support panels and the upper surface of the bottom panel, such that the first surfaces of the distal and proximate support panels are coplanar with each other and with the upper surface of the bottom panel.

The one or more fixed panels may include a rear panel. A surface of the rear panel may define a rear inner surface of the compartment, the rear inner surface opposing the front inner surface defined by the first surface of the proximate support panel when the foldable support platform is in the folded position.

The one or more fixed panels may include a top panel and opposing side panels. A bottom surface of the top panel may define a top inner surface of the compartment. The opposing side panels may extend at least between opposite edges of the top panel and opposite edges of the bottom panel and may further extend orthogonally from opposite edges of the rear panel. Opposing side surfaces of the opposing side panels may define opposing side inner surfaces of the compartment.

Each side panel of the opposing side panels may include a stop structure configured to restrict motion of the proximate support panel into the interior of the furniture object when the foldable support platform is in the folded position.

The one or more fixed panels may include one or more connection interfaces configured to connect the one or more fixed panels with a separate article of furniture to incorporate the furniture object into the separate article of furniture.

The separate article of furniture may be configured to structurally support at least a portion of the separate article of furniture over a first space, independently of the furniture object. The furniture object may be configured to be coupled to at least one load-bearing structure of the separate article of furniture so that the foldable support platform is configured to move into the deployed position to position the proximate and distal support panels in the first space to be at least partially vertically overlapped by the portion of the separate article of furniture.

The portion of the separate article of furniture may be a loft bed structurally supported by one or more load-bearing structures over the first space.

The at least one load-bearing structure may at least partially enclose the compartment.

The furniture object may include a lift mechanism, connected at opposite ends to the one or more fixed panels and the foldable support platform, respectively, the lift mechanism configured to control a rate at which the foldable support platform moves between the folded position and the deployed position.

The furniture object may include a plurality of lift mechanisms, the plurality of lift mechanisms including the lift mechanism, where the plurality of lift mechanisms are each connected between a separate fixed panel of the one or more fixed panels and a separate, opposite edge of the foldable support platform.

The lift mechanism may include a piston lift mechanism.

The lift mechanism may be connected, at one end, to the proximate support panel.

The distal support panel may include a set of handles at opposite ends of the first surface of the distal support panel. The set of handles may have respective longitudinal axes that extend in parallel with each other. The set of handles may be configured to align a longitudinal axis of the foldable bed resting on the foldable support platform with a longitudinal axis extending through the bottom panel and the proximate and distal support panels, based on the foldable support platform being in the deployed position.

The furniture object may be configured to hold the foldable bed in a folded configuration entirely within the compartment when the foldable support platform is in a folded position, such that the foldable bed is isolated from direct contact with the first surface of the distal support panel, and the foldable bed is entirely absent from being between the proximate and distal support panels.

The distal support panel may include one or more rollers at a first edge of the distal support panel. The one or more rollers may be configured to at least partially structurally support the foldable support platform. The one or more rollers may be configured to roll on a surface as the foldable support platform moves between the folded position and the deployed position.

According to some example embodiments, a method of operating a furniture object to deploy foldable support platform, where the furniture object rests on a support surface, the furniture object includes one or more panels partially enclosing a compartment within an interior of the furniture object, the one or more panels includes a bottom panel, an upper surface of the bottom panel at least partially defines a bottom inner surface of the compartment, the furniture object further includes the foldable support platform including distal and proximate support panels, the proximate support panel hingeably connected at opposite edges to the distal support panel and the one or more panels, may include applying a driver force on the distal support platform to cause a distal edge of the distal support platform to move, in a first direction parallel to the support surface, away from a distal edge of the distal support platform that is hingeably connected to the one or more panels, to cause the foldable support platform to move from the folded position to a threshold partially-deployed position via a scissors-type motion. In response to the foldable support platform moving to the threshold partially-deployed position, the hingeably connected proximate edges of the proximate and distal support platforms are caused to move, in a second direction perpendicular to the first direction, downwards towards the support surface based on a weight of the hingeably connected proximate and distal support platforms, such that the foldable support platform moves from the threshold partially-deployed position to a fully deployed position via the scissors-type motion to cause first surfaces of the distal and proximate support panels to be coplanar with each other to at least partially define a sleeping platform configured to structurally support the foldable bed resting, in an unfolded configuration, on at least the first surfaces of the proximate and distal support panels.

In response to the foldable support platform moving to the threshold partially-deployed position, the foldable support platform may move from the threshold partially-deployed position to the fully deployed position without any further application of driver force to the foldable support platform.

BRIEF DESCRIPTION OF THE DRAWINGS

The drawings described herein are for illustration purposes only and are not intended to limit the scope of the present disclosure in any way.

DETAILED DESCRIPTION

Figure 1:
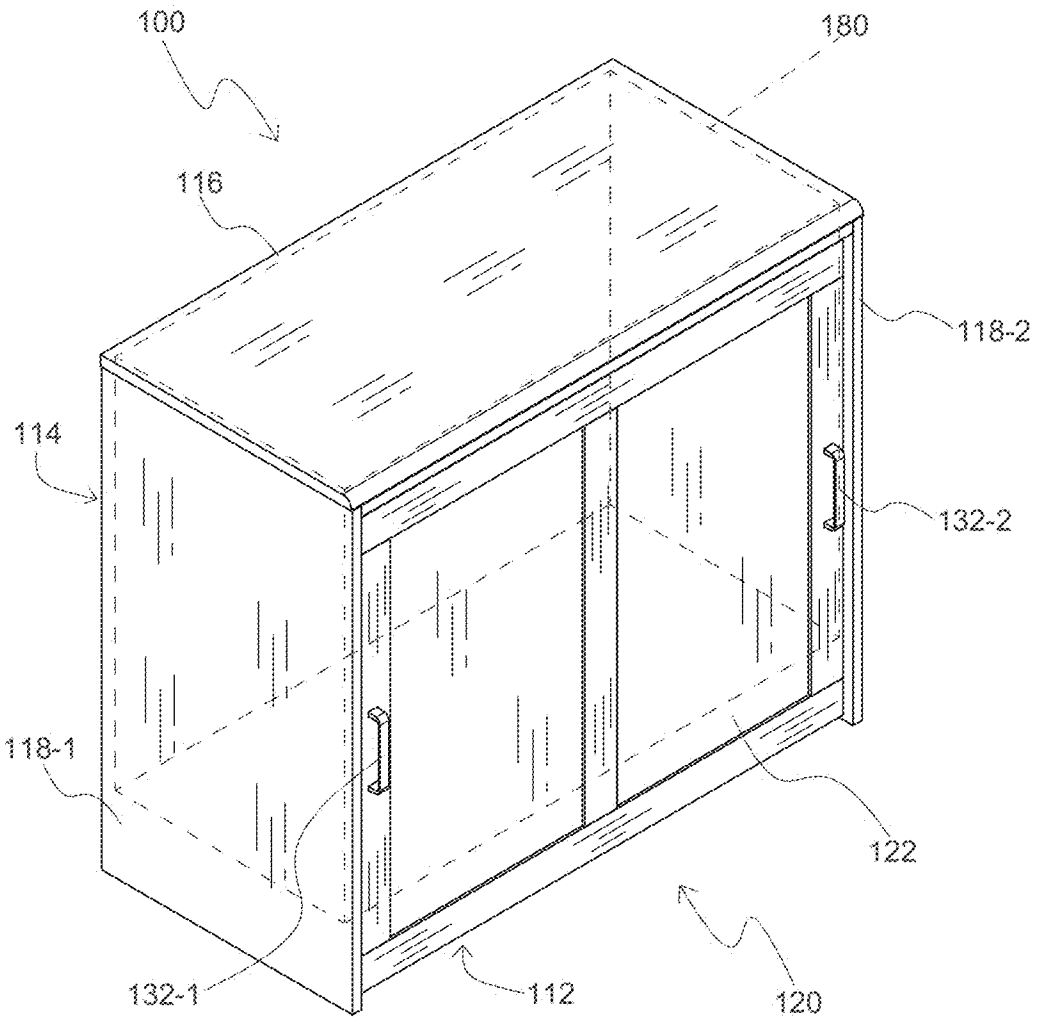
FIG. 1 is an upper front, left perspective view of a furniture object that includes a foldable support platform in a folded position according to some example embodiments.

The following description is merely example in nature and is not intended to limit the present disclosure, application, or uses. It should be understood that throughout the drawings, corresponding reference numerals indicate like or corresponding parts and features.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Certain terminology is used herein for purposes of reference only, and thus is not intended to be limiting. For example, terms such as "upper," "lower," "above," "below," "top," "bottom," "upward," "downward," "upwardly," "downwardly," "forward," "rearward," and the like refer to directions in the drawings to which reference is made. Terms such as "front," "back," "rear," "bottom," "side," and the like describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the inventive concepts to those skilled in the art.

Example embodiments relate to furniture objects configured to store foldable beds and/or reversibly deploy sleeping platforms to structurally support foldable beds and/or or more occupants on said foldable beds. Such furniture objects may include Murphy beds, as the term is well-known. The furniture objects as described herein may be constructed, manufactured, or otherwise built in a variety of shapes include any rectangular shape, square shape, and/or any other like shape. The furniture objects described herein may be constructed, manufactured, or otherwise built using a variety of materials, such as wood, plastic, metal, minerals and/or any combination thereof.

Figure 2:
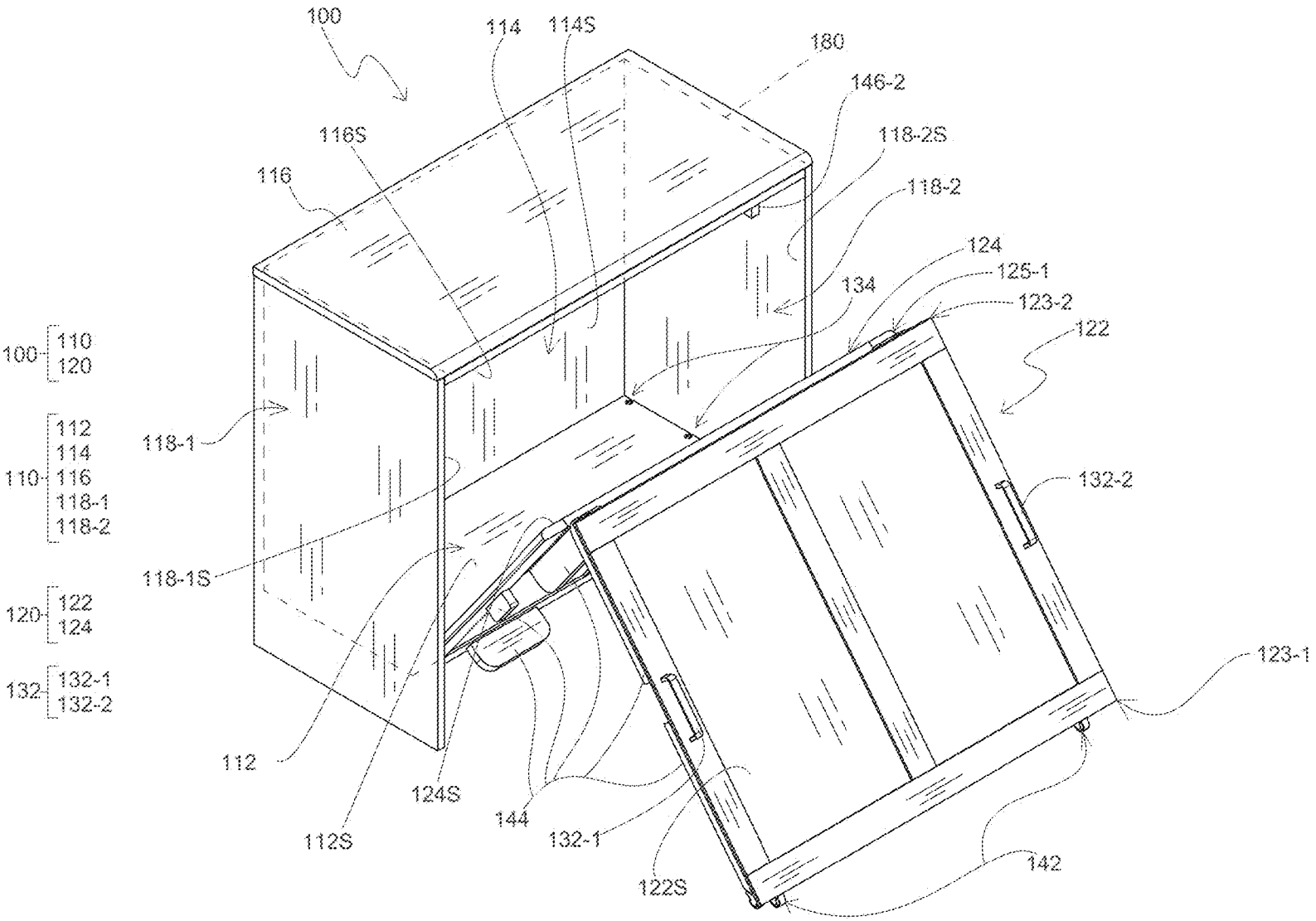
FIG. 2 is an upper front, left perspective view of a furniture object that includes a foldable support platform in a partially deployed position according to some example embodiments.
Figure 3:
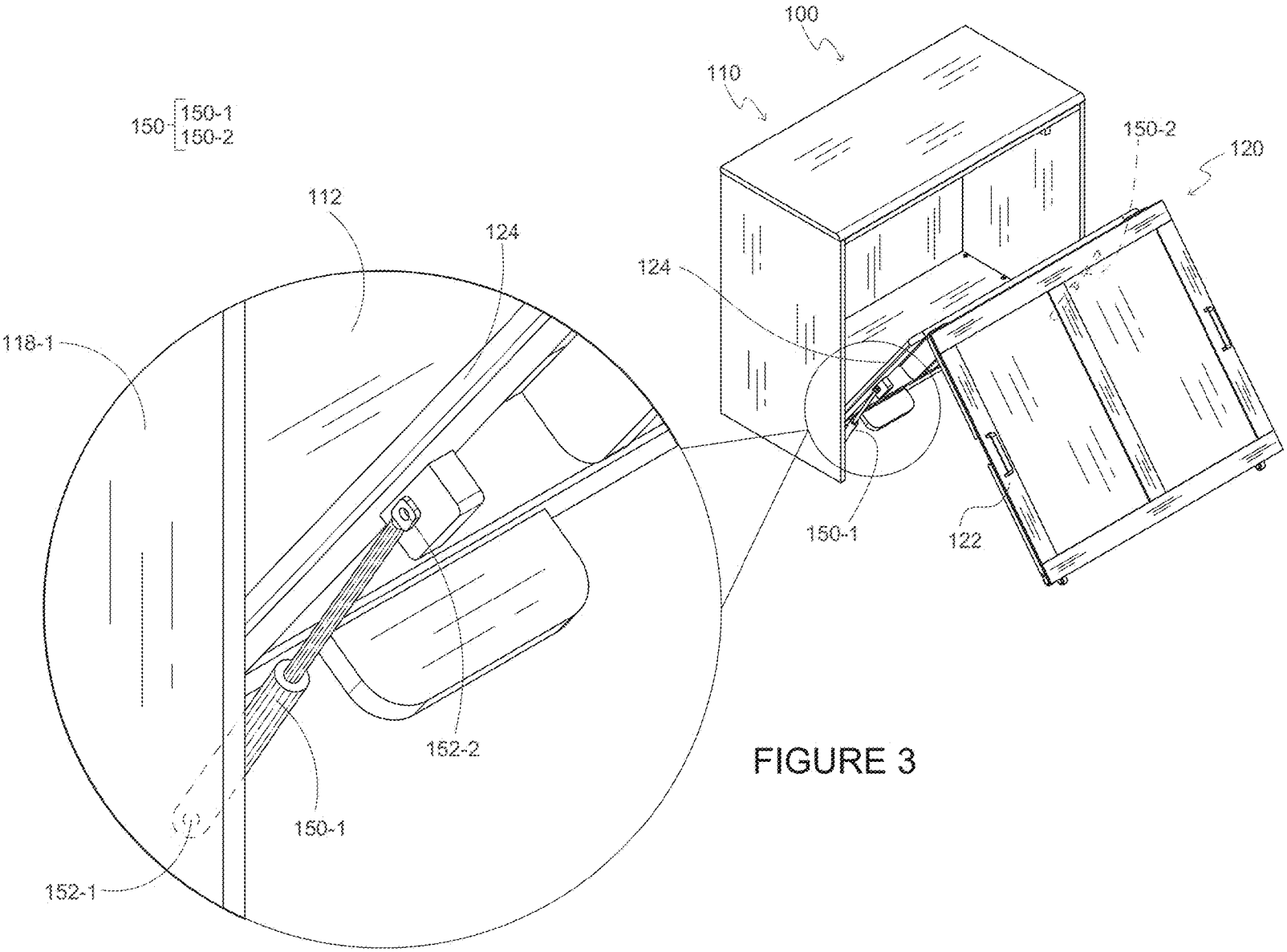
FIG. 3 is an upper front, left perspective view of a furniture object that includes a foldable support platform in a partially deployed position and including a lift mechanism according to some example embodiments.
Figure 4:
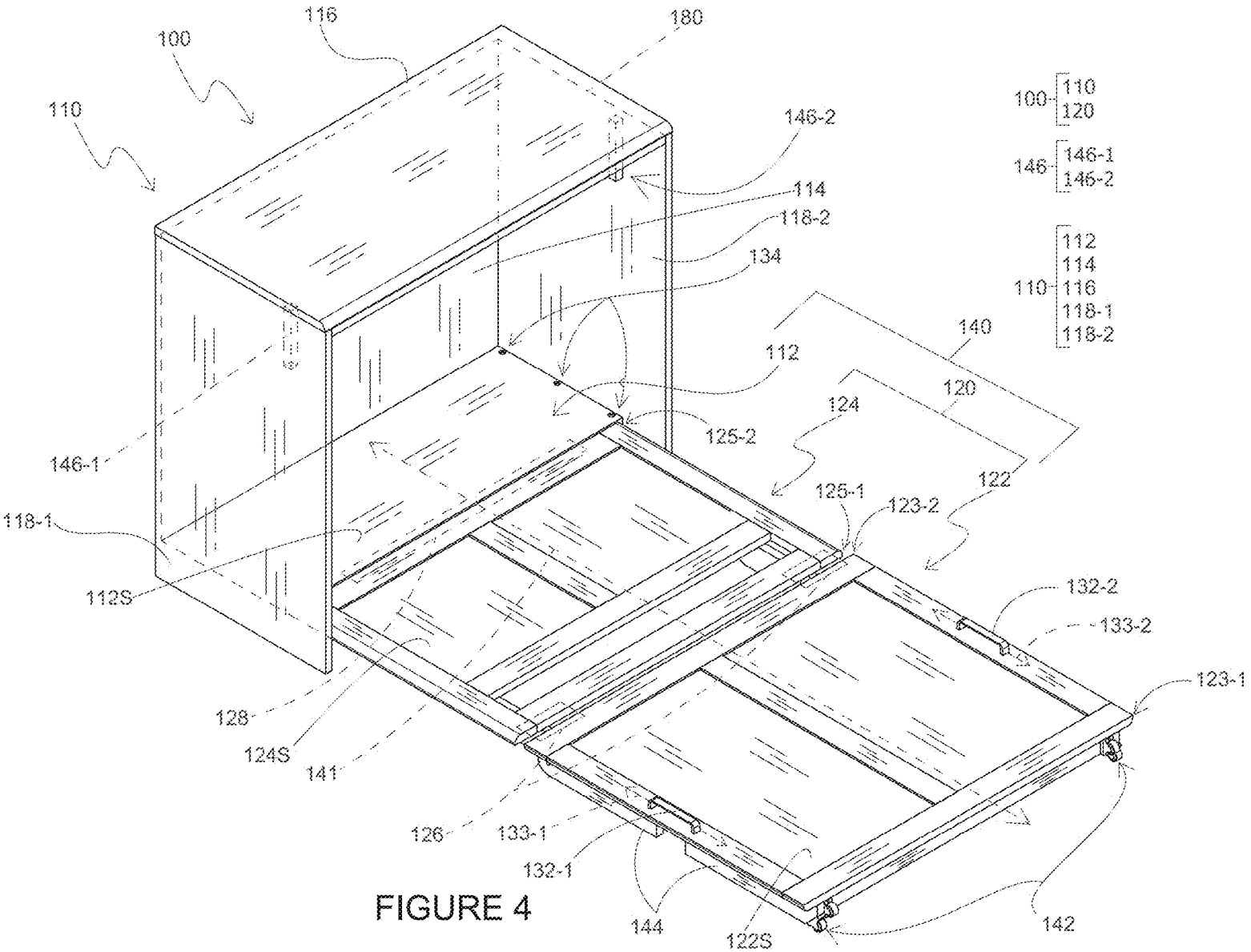
FIG. 4 is an upper front, left perspective view of a furniture object that includes a foldable support platform in a fully deployed position according to some example embodiments.
Figure 5:
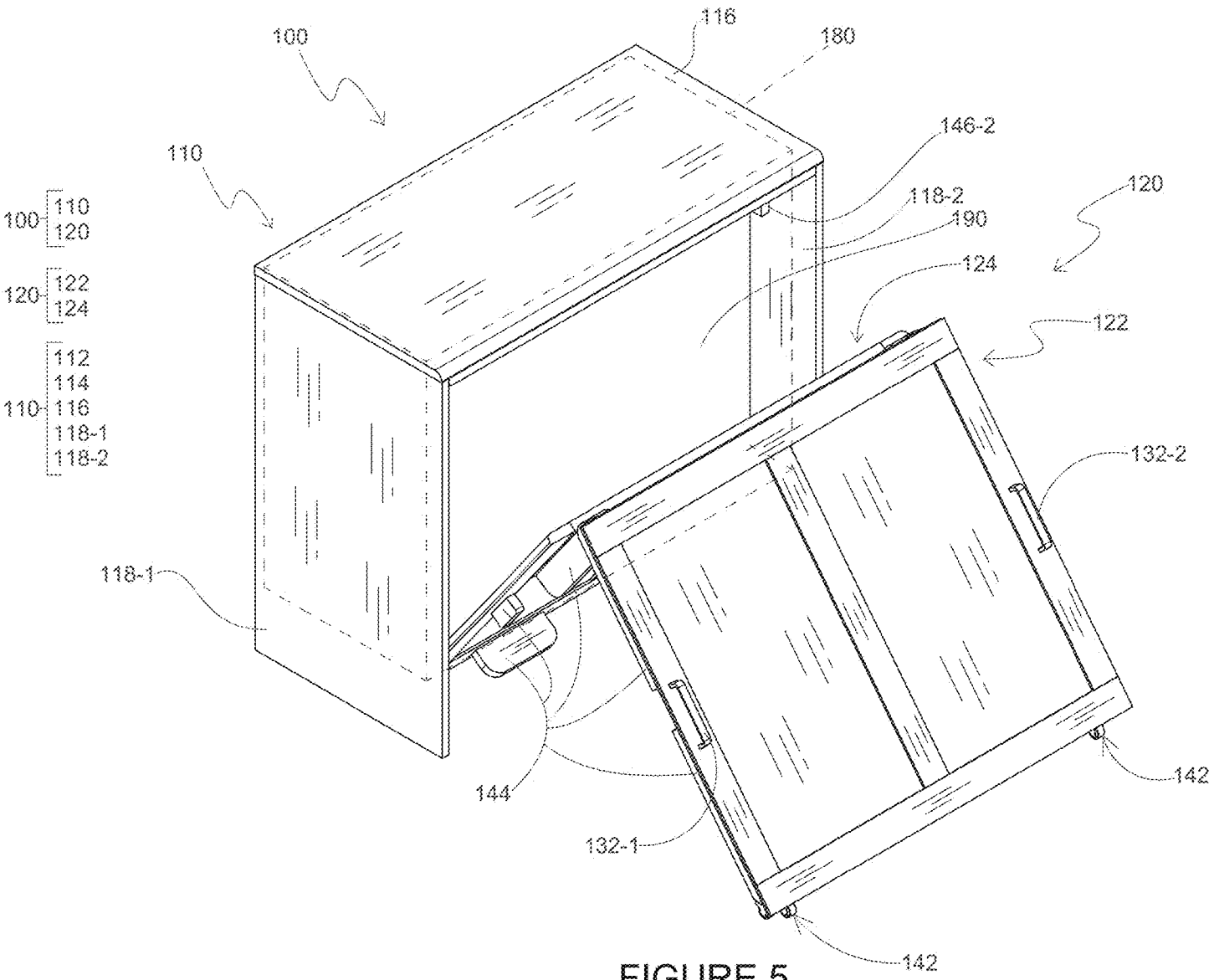
FIG. 5 is an upper front, left perspective view of a furniture object that includes a foldable support platform in a partially deployed position with a foldable bed stowed in a compartment in an interior of the furniture object according to some example embodiments.
Figure 6:
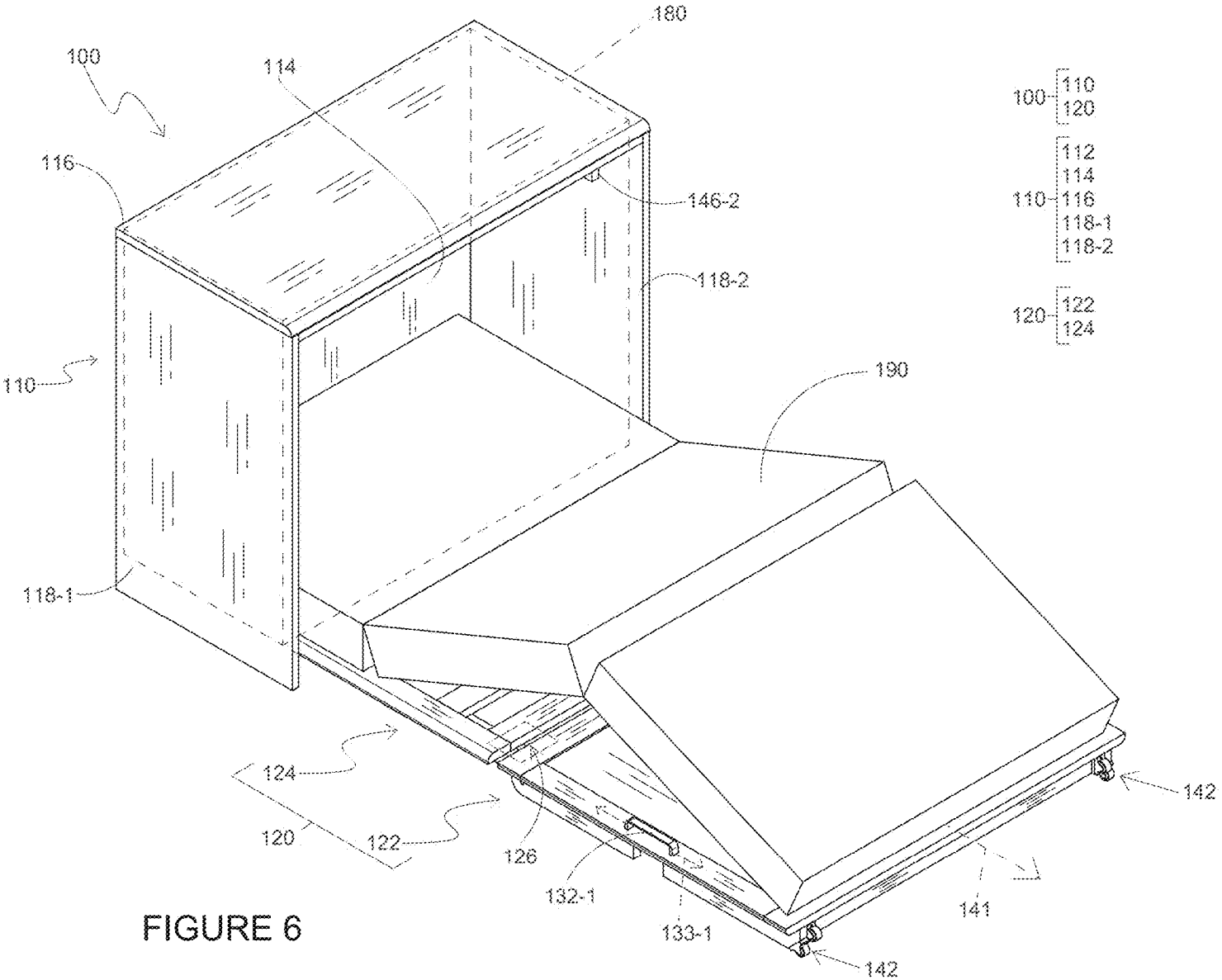
FIG. 6 is an upper front, left perspective view of a furniture object that includes a foldable support platform in a fully deployed position with a foldable bed in a partially unfolded configuration on a sleeping platform according to some example embodiments.
Figure 7:
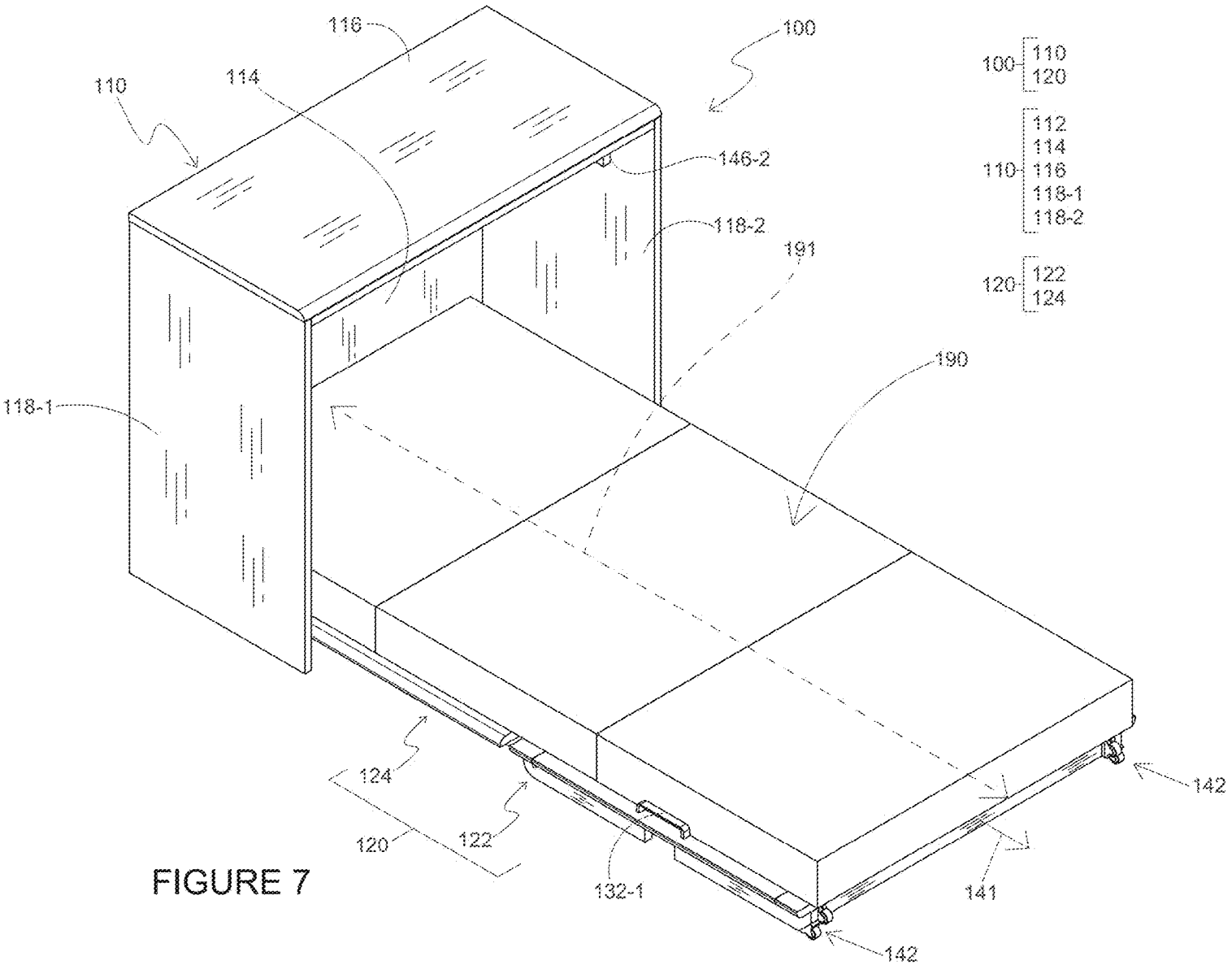
FIG. 7 is an upper front, left perspective view of a furniture object that includes a foldable support platform in a fully deployed position with a foldable bed in a fully unfolded configuration on a sleeping platform according to some example embodiments.
Figure 14A:
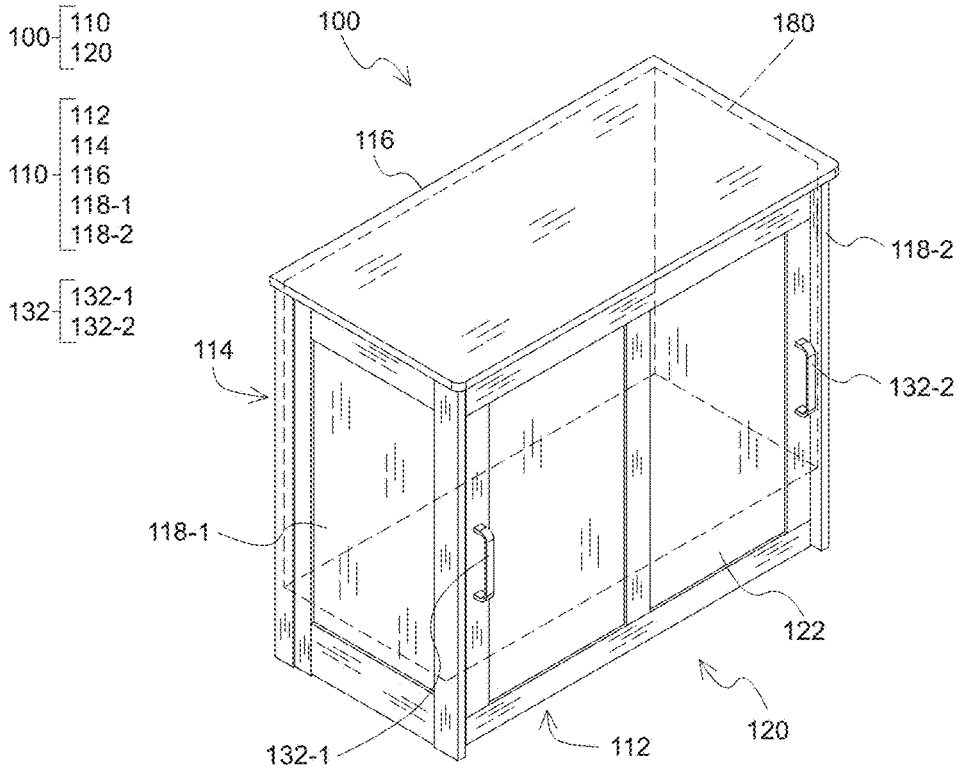
FIG. 14A is an upper front, left perspective view of a furniture object that includes a foldable support platform in a folded position according to some example embodiments.
Figure 14B:
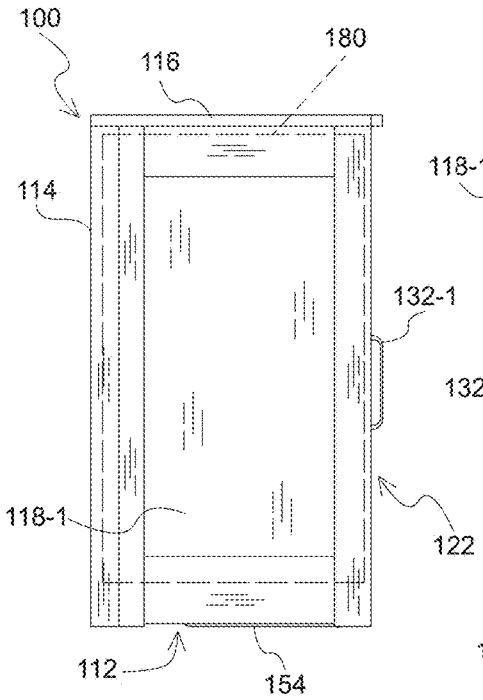
FIG. 14B is a left view of the furniture object of FIG. 14A according to some example embodiments.
Figure 14C:
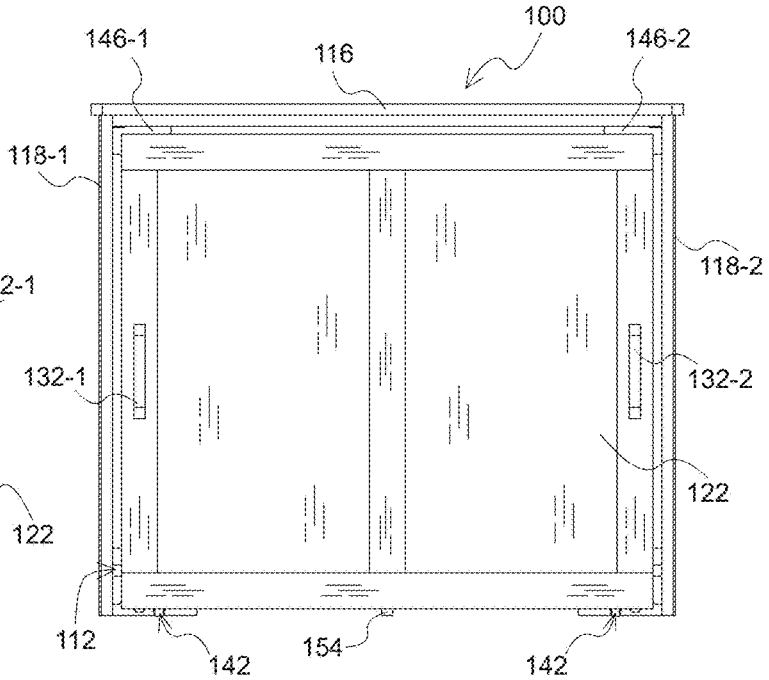
FIG. 14C is a front view of the furniture object of FIG. 14A according to some example embodiments.
Figure 15A:
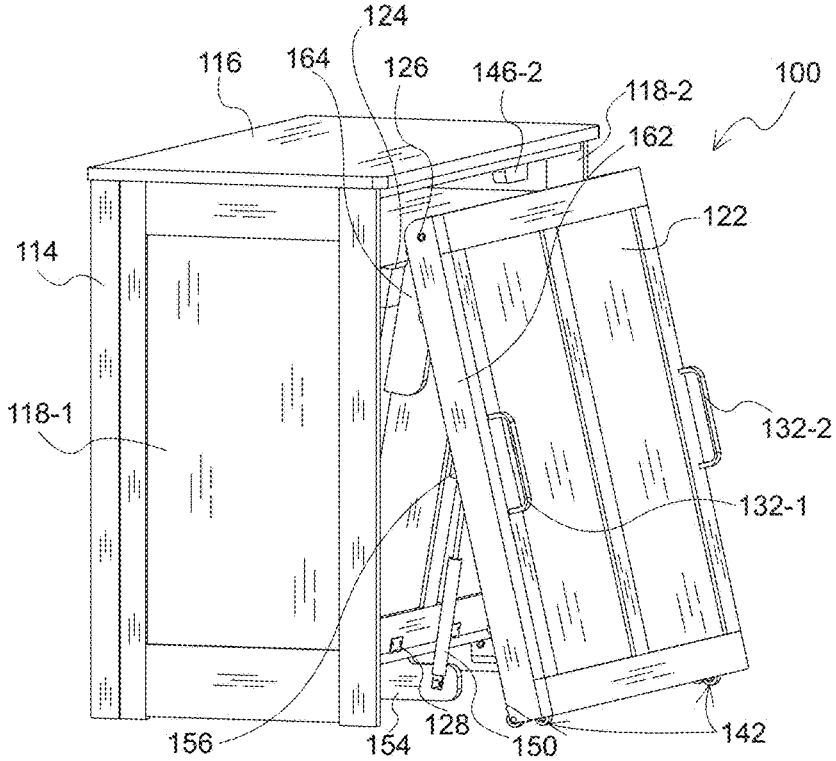
FIG. 15A is an upper front, left perspective view of a furniture object that includes a foldable support platform in a partially deployed position according to some example embodiments.
Figure 15B:
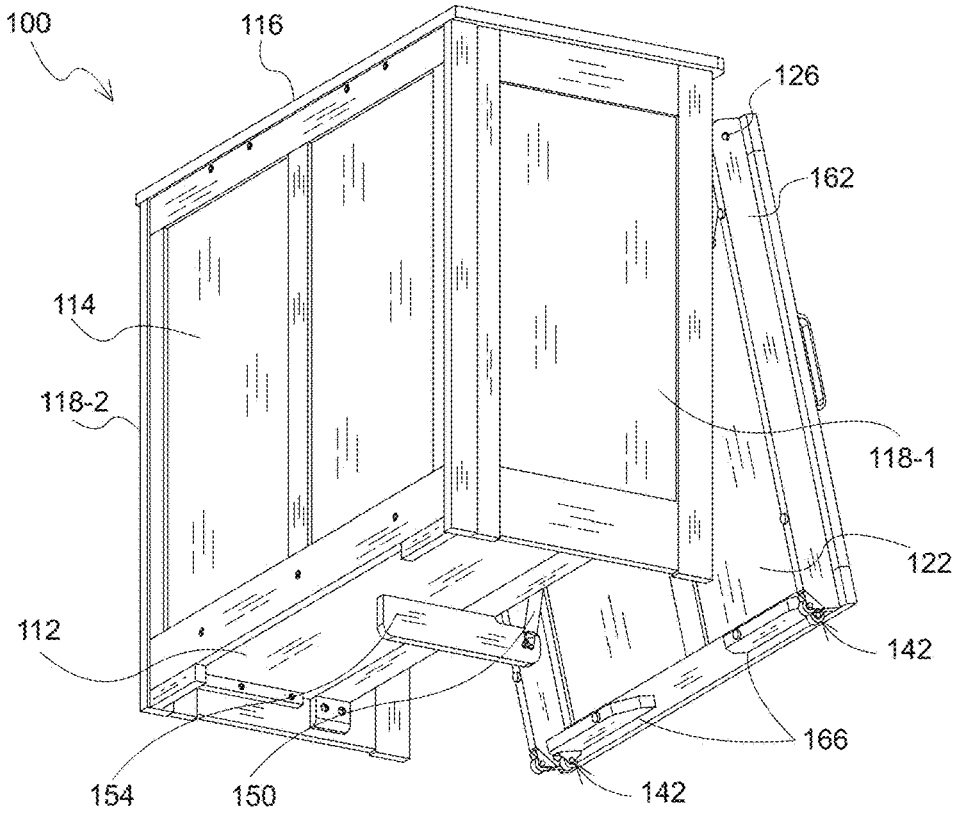
FIG. 15B is a lower rear, left perspective view of the furniture object of FIG. 15A according to some example embodiments.
Figure 16A:
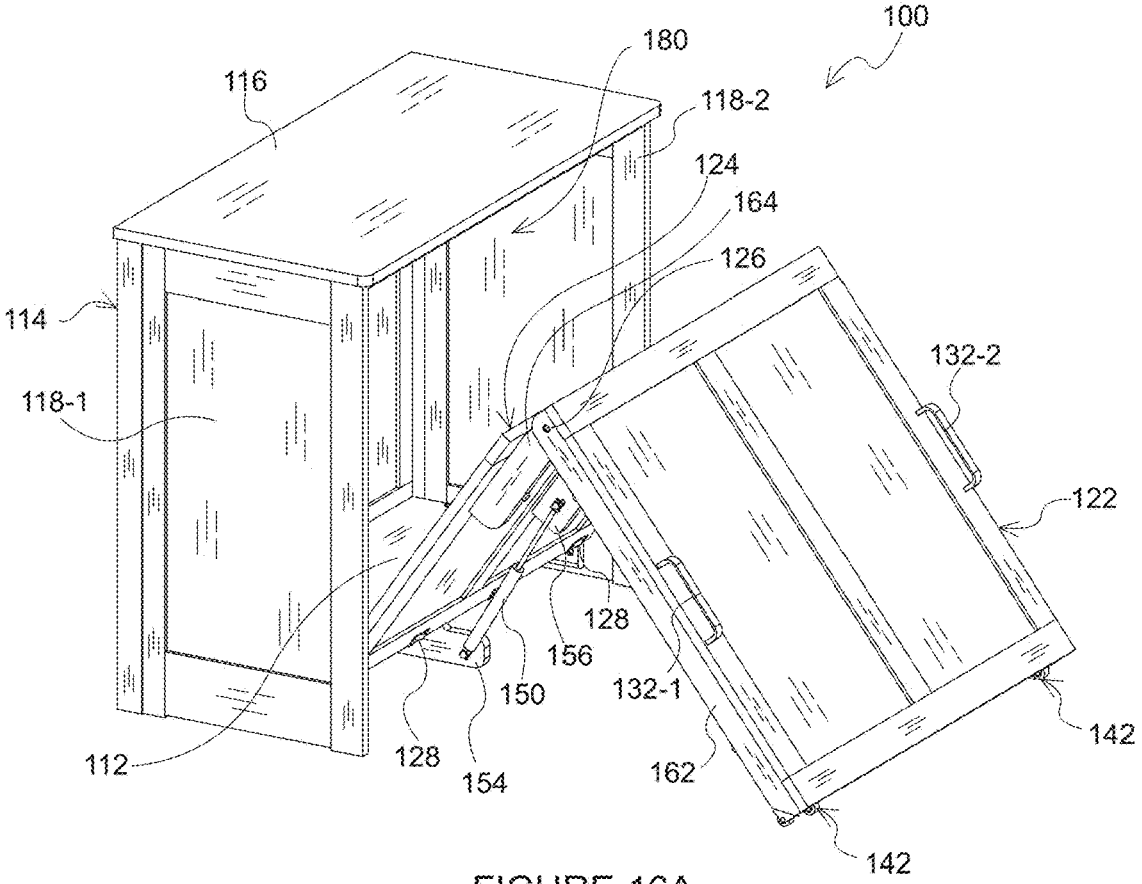
FIG. 16A is an upper front, left perspective view of a furniture object that includes a foldable support platform in a partially deployed position according to some example embodiments.
Figure 16B:
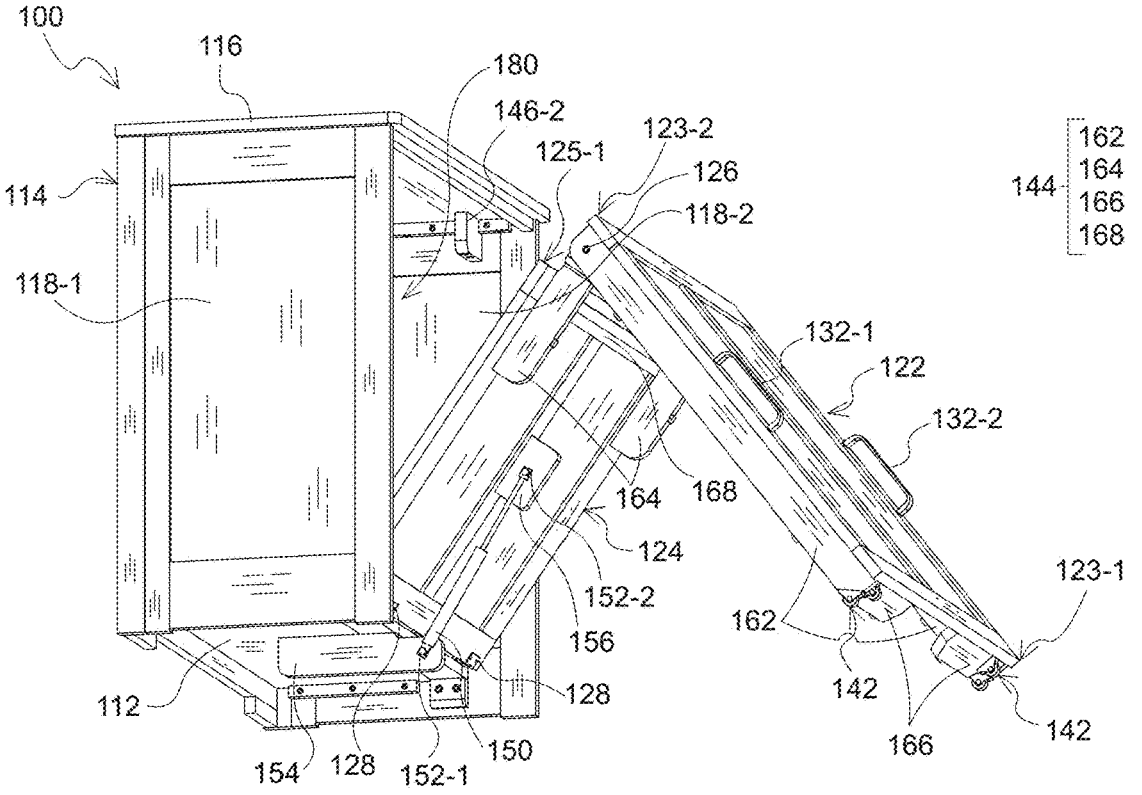
FIG. 16B is a lower front, left perspective view of the furniture object of FIG. 16A according to some example embodiments.
Figure 16C:
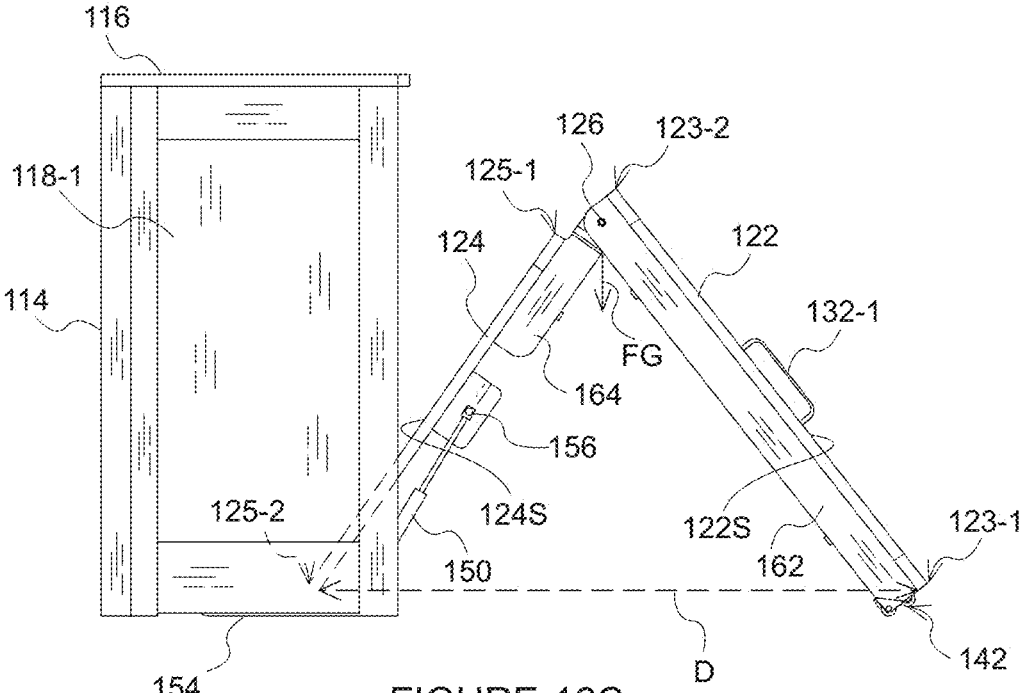
FIG. 16C is a left view of the furniture object of FIG. 16A according to some example embodiments.
Figure 17A:
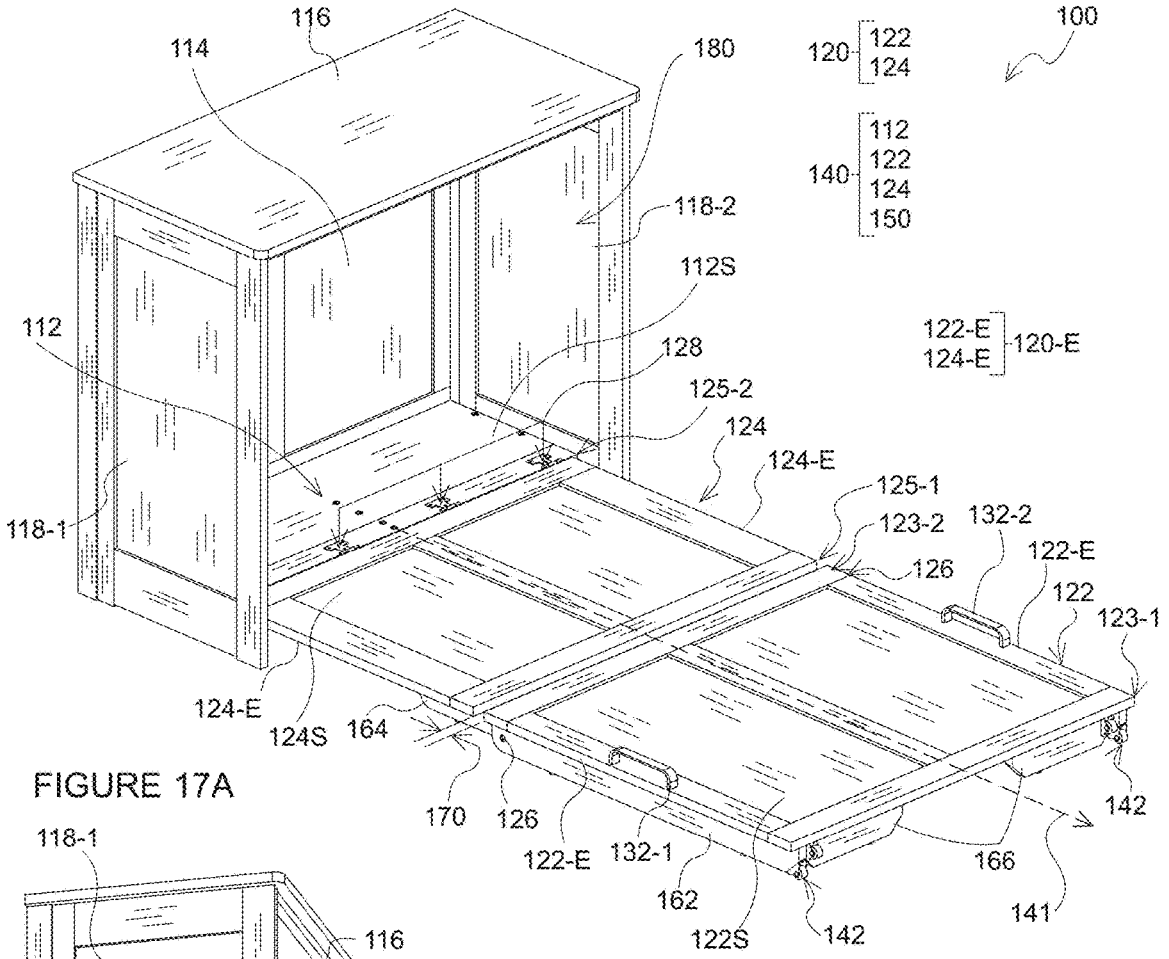
FIG. 17A is an upper front, left perspective view of a furniture object that includes a foldable support platform in a fully deployed position according to some example embodiments.
Figure 17B:
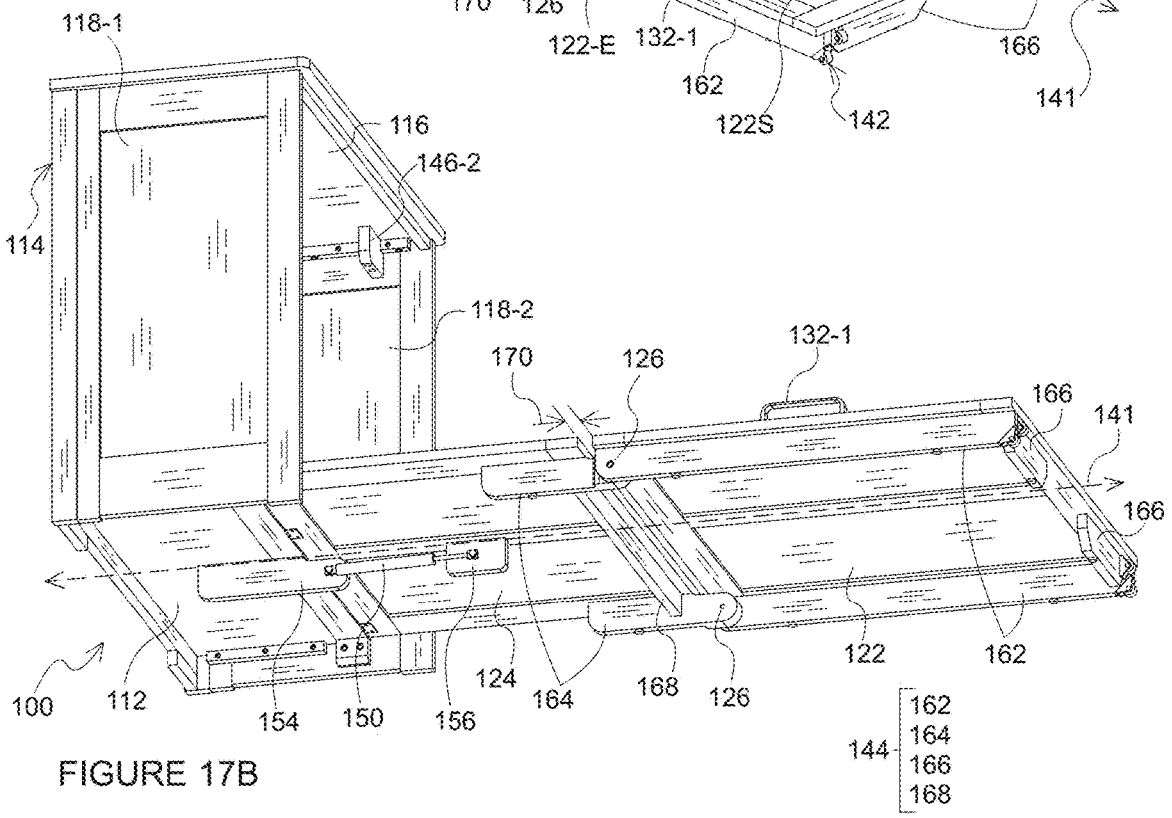
FIG. 17B is a lower front, left perspective view of the furniture object of FIG. 17A according to some example embodiments.
Figure 17C:
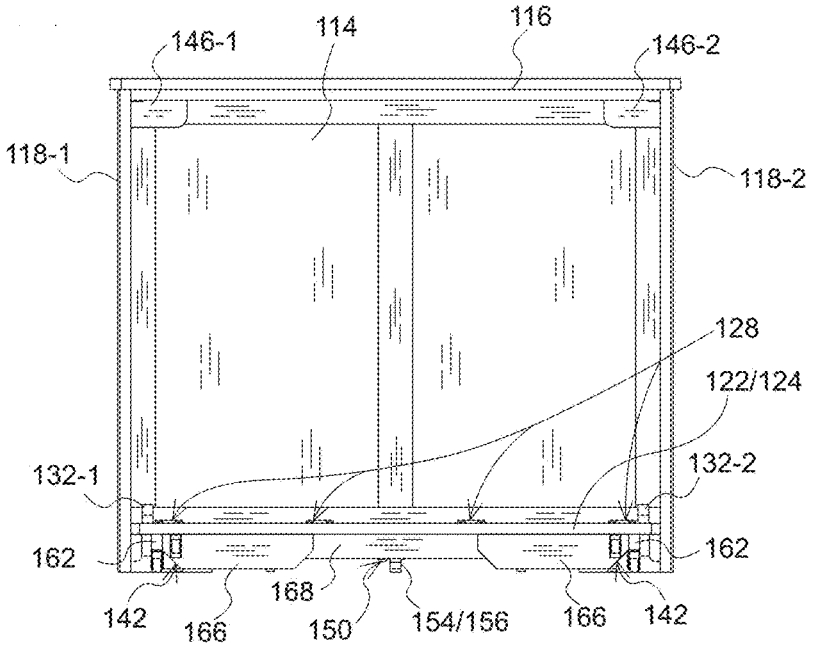
FIG. 17C is a front view of the furniture object of FIG. 17A according to some example embodiments.
Figure 17D:
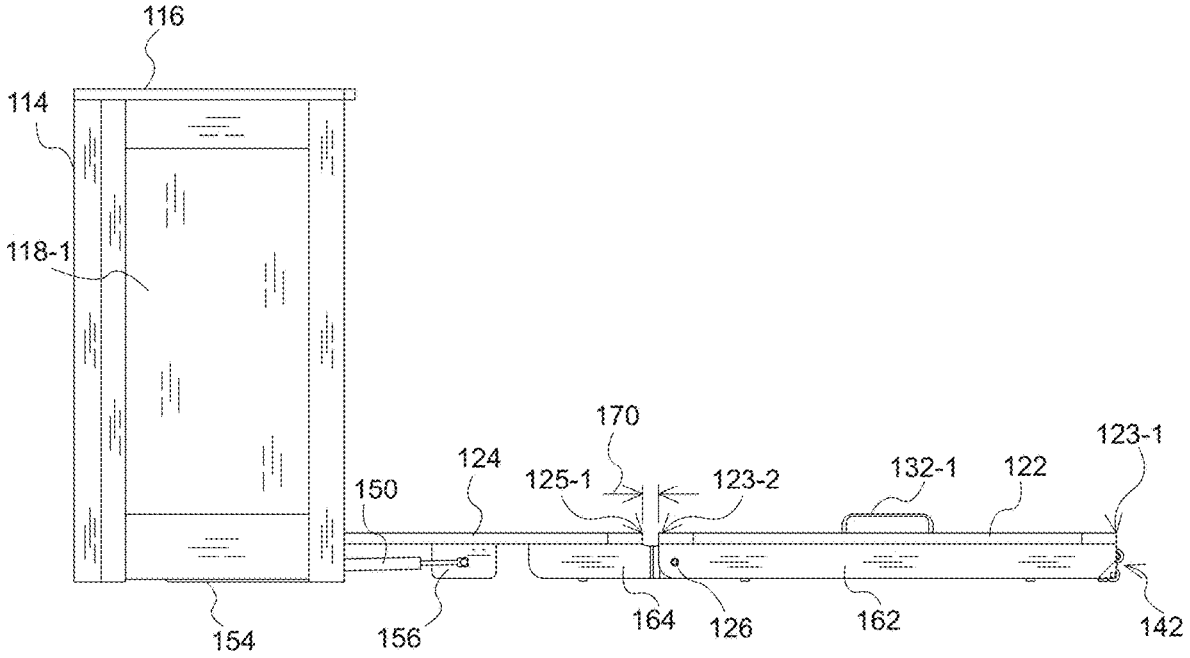
FIG. 17D is a left view of the furniture object of FIG. 17A according to some example embodiments.
Figure 18A:
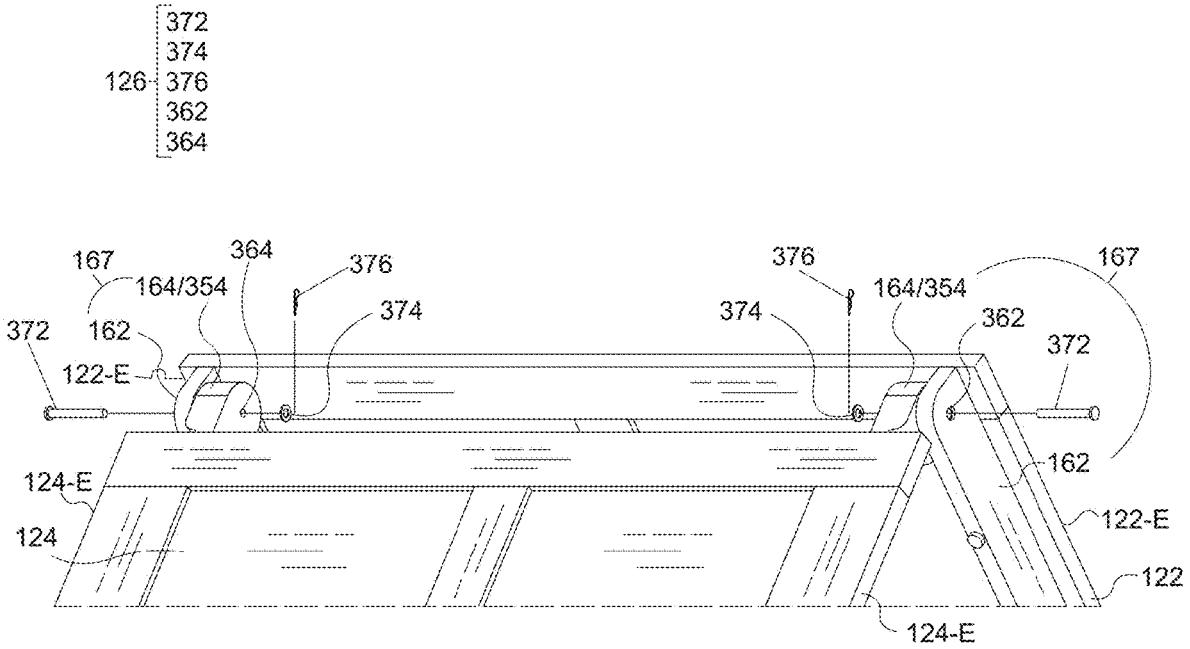
FIG. 18A is a view of a portion of a foldable support platform of a furniture object in a partially deployed position according to some example embodiments.
Figure 18B:
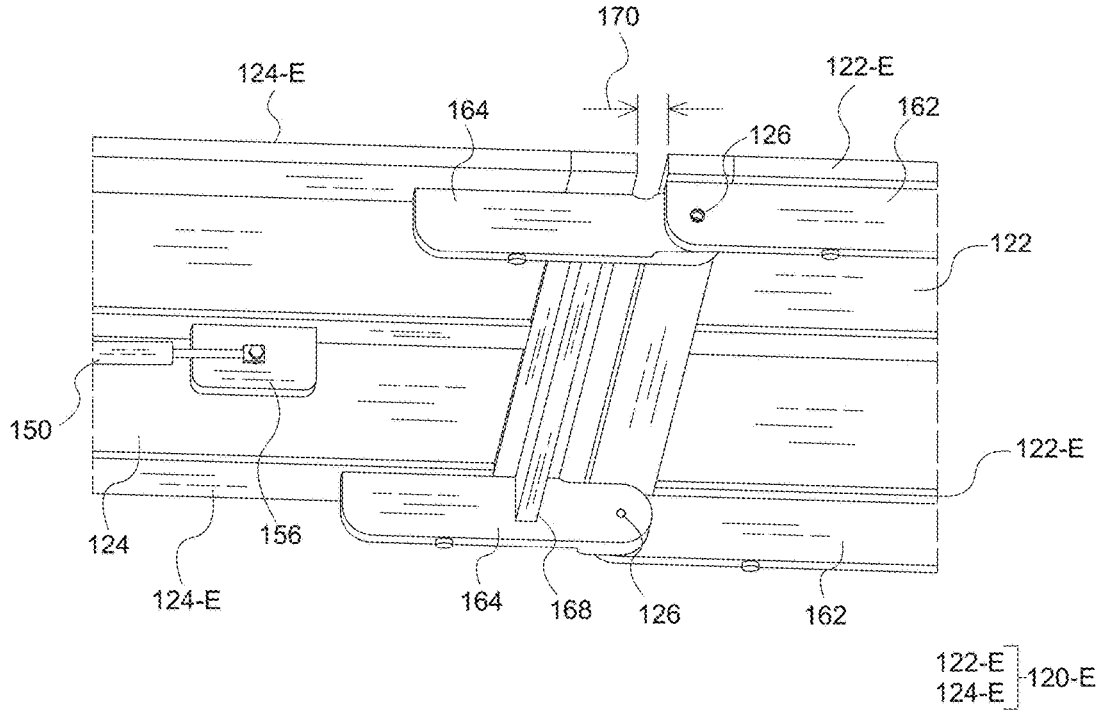
FIG. 18B is a view of a portion of a foldable support platform of a furniture object in a fully deployed position according to some example embodiments.
Figure 22A:
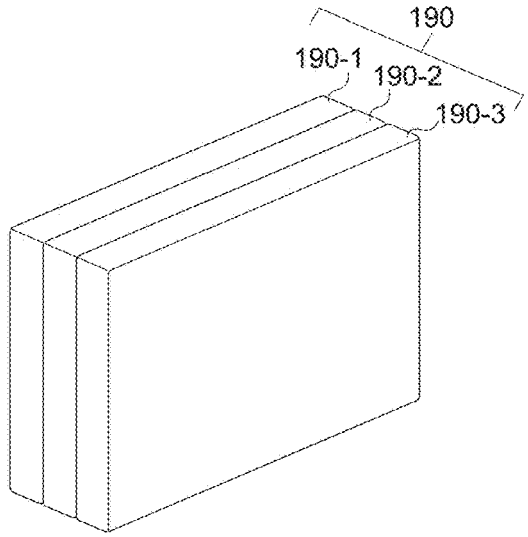
FIGS. 22A, 22B, and 22C are front, left perspective views of a foldable bed in various deployed positions according to some example embodiments.
Figure 22B:
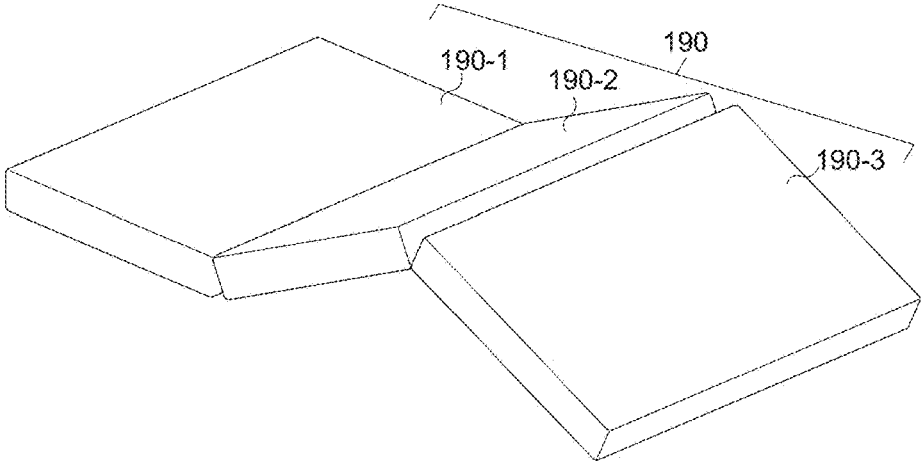
Figure 22C:
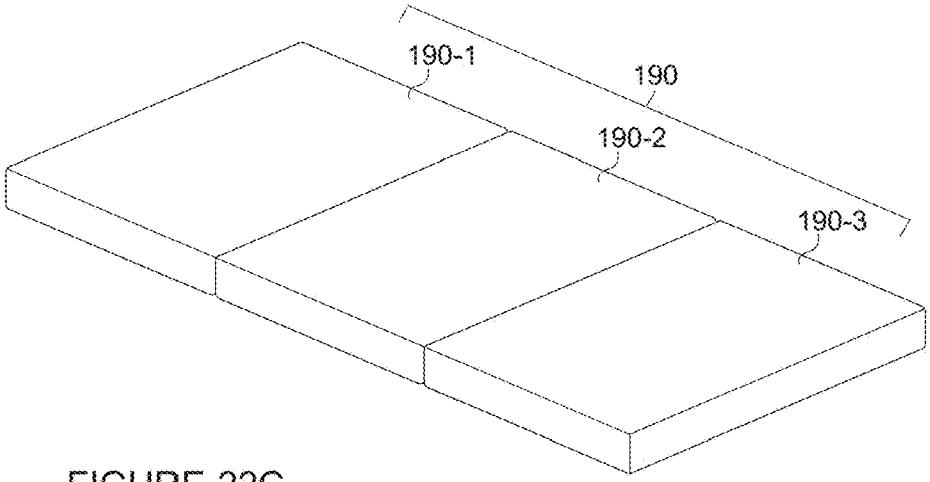
Figure 23A:
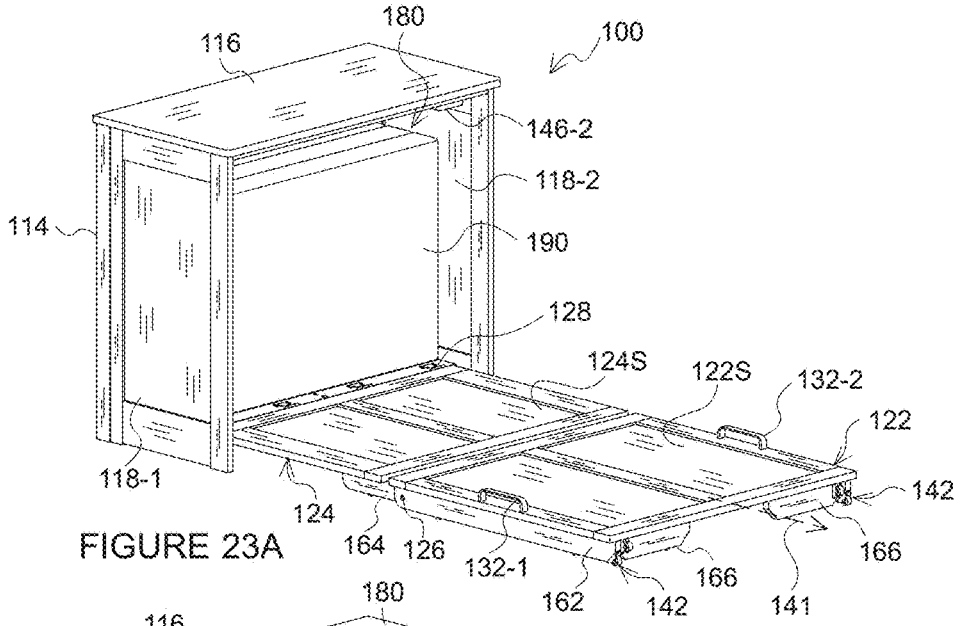
FIGS. 23A, 23B, and 23C are upper front, left perspective views of a furniture object having a foldable support platform in a fully deployed position and holding a foldable bed in various deployed positions according to some example embodiments.
Figure 23B:
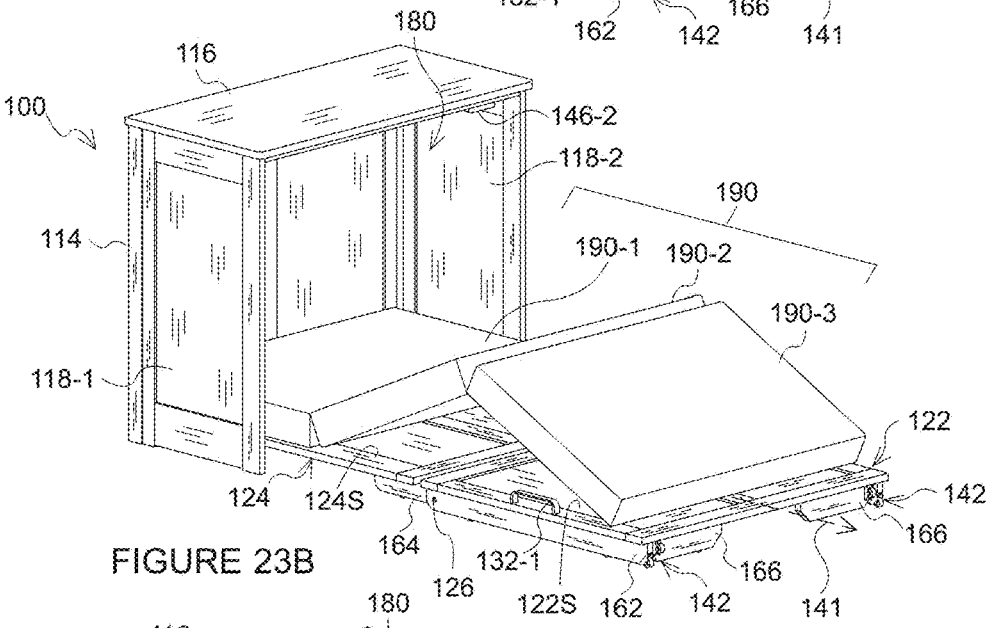
Figure 23C:
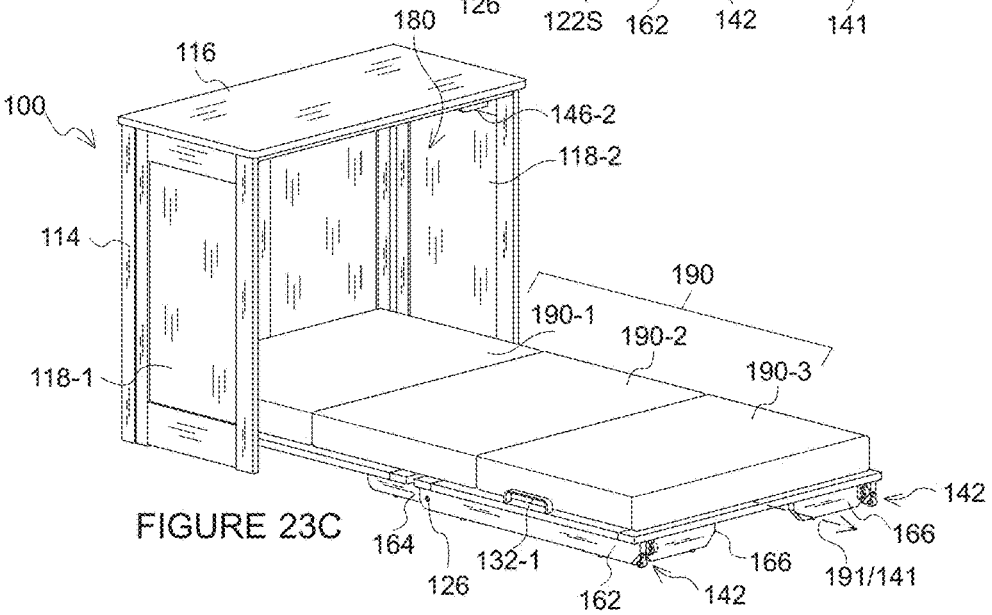

FIG. 1 is an upper front, left perspective view of a furniture object that includes a foldable support platform in a folded position according to some example embodiments. FIG. 2 is an upper front, left perspective view of a furniture object that includes a foldable support platform in a partially deployed position according to some example embodiments. FIG. 3 is an upper front, left perspective view of a furniture object that includes a foldable support platform in a partially deployed position and including a lift mechanism according to some example embodiments. FIG. 4 is an upper front, left perspective view of a furniture object that includes a foldable support platform in a fully deployed position according to some example embodiments. FIG. 5 is an upper front, left perspective view of a furniture object that includes a foldable support platform in a partially deployed position with a foldable bed stowed in a compartment in an interior of the furniture object according to some example embodiments. FIG. 6 is an upper front, left perspective view of a furniture object that includes a foldable support platform in a fully deployed position with a foldable bed in a partially unfolded configuration on a sleeping platform according to some example embodiments. FIG. 7 is an upper front, left perspective view of a furniture object that includes a foldable support platform in a fully deployed position with a foldable bed in a fully unfolded configuration on a sleeping platform according to some example embodiments. FIG. 14A is an upper front, left perspective view of a furniture object that includes a foldable support platform in a folded position according to some example embodiments. FIG. 14B is a left view of the furniture object of FIG. 14A according to some example embodiments. FIG. 14C is a front view of the furniture object of FIG. 14A according to some example embodiments. FIG. 15A is an upper front, left perspective view of a furniture object that includes a foldable support platform in a partially deployed position according to some example embodiments. FIG. 15B is a lower rear, left perspective view of the furniture object of FIG. 15A according to some example embodiments. FIG. 16A is an upper front, left perspective view of a furniture object that includes a foldable support platform in a partially deployed position according to some example embodiments. FIG. 16B is a lower front, left perspective view of the furniture object of FIG. 16A according to some example embodiments. FIG. 16C is a left view of the furniture object of FIG. 16A according to some example embodiments. FIG. 17A is an upper front, left perspective view of a furniture object that includes a foldable support platform in a fully deployed position according to some example embodiments. FIG. 17B is a lower front, left perspective view of the furniture object of FIG. 17A according to some example embodiments. FIG. 17C is a front view of the furniture object of FIG. 17A according to some example embodiments. FIG. 17D is a left view of the furniture object of FIG. 17A according to some example embodiments. FIG. 18A is a view of a portion of a foldable support platform of a furniture object in a partially deployed position according to some example embodiments. FIG. 18B is a view of a portion of a foldable support platform of a furniture object in a fully deployed position according to some example embodiments. FIGS. 19A, 19B, 19C, 19D, and 20E are left views of a foldable support platform of a furniture object in various deployed positions according to some example embodiments. FIGS. 20A, 20B, 20C, 20D, and 20E are left views of a portion of a foldable support platform of a furniture object in various deployed positions according to some example embodiments. FIGS. 21A, 21B, 21C, 21D, and 21E are left views of a portion of a foldable support platform of a furniture object in various deployed positions according to some example embodiments. FIGS. 22A, 22B, and 22C are front, left perspective views of a foldable bed in various deployed positions according to some example embodiments. FIGS. 23A, 23B, and 23C are upper front, left perspective views of a furniture object having a foldable support platform in a fully deployed position and holding a foldable bed in various deployed positions according to some example embodiments. It will be understood that same reference labels used in different Figures refer to same elements included in the different Figures.

Referring to FIGS. 1-7, 14A-21E, and 23A-23C, a furniture object 100 may be configured to store a foldable bed 190. In FIGS. 1-7, 14A-21E, and 23A-23C, the furniture object 100 is shown as a cabinet, but it will be understood that example embodiments of furniture objects 100 are not limited to cabinets. For example, the furniture object 100 may be any article of furniture that may include a compartment 180 at least partially located within an interior of the furniture object 100, including a desk, a dresser, a chair, a bed, a sofa, a chest, a coffer, a trunk, any other like furniture object, or any combination thereof.

In some example embodiments, the furniture object 100 may include a set of one or more fixed panels 110 and a foldable support platform 120 that may be moved between a folded position and a deployed position. In some example embodiments, the one or more fixed panels 110 may be at least partially movable in relation to a fixed support surface 1900 and thus may not be "fixed" panels. In the example embodiments shown in FIGS. 1-7, 14A-21E, and 23A-23C, for example, the set of one or more fixed panels 110 includes a bottom panel 112, a rear panel 114, a top panel 116, and two opposing side panels 118-1 and 118-2 that collectively partially define one or more surfaces of a compartment 180, also referred to herein as an "enclosure", within an interior of the furniture object 100. It will be understood that, as described herein, a structure and/or surface thereof that defines a surface of the compartment 180 may enclose said surface of the compartment 180. As described further herein, the foldable support platform 120 may, in the folded position, define a surface of the compartment 180 and may, as a result, enclose at least a portion of the compartment 180. Collectively, the set of one or more fixed panels 110 and the foldable support platform 120 may partially or entirely enclose the compartment 180 as an open or closed enclosure within the interior of the furniture object 100 when the foldable support platform 120 is in the folded position. It will be understood that one or more structures that define and partially enclose compartment 180 may be referred to as defining the compartment 180 as an open enclosure, and one or more structures that define and completely enclose the compartment 180, within manufacturing tolerances and/or material tolerances, may be referred to as defining the compartment 180 as a closed enclosure.

It will be understood that a compartment 180 may be referred to as a closed enclosure if the boundaries of the compartment 180 are enclosed within manufacturing tolerances and/or material tolerances (e.g., at least 90% enclosed by one or more structures). Otherwise, the compartment 180 may be referred to as an open enclosure.

It will be understood herein that a surface of the compartment 180 that is defined by one or more structures refers to an enclosed boundary of the compartment 180. It will be further understood that, as described herein, one or more structures that define one or more dimensions of the compartment 180, including one or more edges, vertices, and/or boundaries of the compartment 180, may not enclose the defined dimensions. For example, two opposing panels that define opposing side surfaces of the compartment 180, and thus enclose opposing side boundaries of the compartment may further define an additional side boundary of the compartment 180 that extends between the opposing side panels, for example orthogonally between opposing side edges of the opposing side panels, but the defined additional boundary of the compartment 180 may not be enclosed by the opposing side panels. Accordingly, it will be understood that one or more structures may define some or all of the compartment 180, for example defining an entirety of the dimensions of the volume space of the compartment 180, without completely enclosing the compartment 180, such that the one or more structures may be understood to define the compartment 180 as an open compartment or to partially enclose the compartment 180. Additional structures that are separate from the one or more structures may be coupled to the one or more structures to complete the enclosure of the compartment 180, within manufacturing tolerances and/or material tolerances, as a closed enclosure within an interior of the furniture object 100.

It will be understood that, as used herein, "orthogonally" may include orthogonally or substantially orthogonally, where substantially orthogonally includes orthogonally within manufacturing tolerances and/or material tolerances.

It will be understood that the "interior" of the furniture object 100 may amount to any volume space, also referred to herein as simply a "space" or "volume", having boundaries that are at least defined by any part of the furniture object 100 when the foldable support platform 120 is in the folded position. For example, referring to FIGS. 8-10, the rear panel 114, bottom panel 112, and foldable support platform 120 in the folded position may define and enclose bottom, rear, and front boundaries of the furniture object 100, and the edges 114E, 112E, and 120E of the rear panel 114, bottom panel 112, and foldable support platform 120 may be understood to define opposing, unenclosed side boundaries 194-1 and 194-2 of the furniture object 100, and edges 114E and 123-2 of the rear panel 114 and the foldable support platform 120 in the folded position may be understood to define an unenclosed top boundary 196 of the furniture object 100, and the interior of the furniture object 100, within which the compartment 180 is defined as an open enclosure, may be understood to be the space within such defined, enclosed and unenclosed boundaries.

It will be understood that example embodiments are not limited to the set of one or more fixed panels 110 as shown in FIGS. 1-7, 14A-21E, and 23A-23C, and the set of one or more fixed panels 110 of the furniture object may include additional or fewer fixed panels than as shown in FIGS. 1-7, 14A-21E, and 23A-23C. For example, in some example embodiments, including the example embodiments shown in FIGS. 8-10, the set of one or more fixed panels 110 may include the bottom panel 112 and the rear panel 114 and may not include side panels 118-1 and 118-2 and top panel 116. In another example, in some example embodiments, including the example embodiments shown in FIGS. 11-13, 24A-24B, and 25A-26B, the set of one or more fixed panels 110 may include only the bottom panel 112 and no other additional panels.

As shown in at least FIGS. 1-7, 14A-21E, 23A-23C, and 24A-24B, the set of one or more fixed panels 110 may include a bottom panel 112 having an upper surface 112S, where the upper surface 112S of the bottom panel 112 at least partially defines a bottom inner surface of the compartment 180 and thus at least partially defines and encloses a bottom boundary of the compartment 180. In some example embodiments, including the example embodiments shown in FIGS. 1-7, 8-10, 14A-21E, and 23A-23C, the set of one or more fixed panels 110 may include a rear panel 114 having a surface 114S, where the surface 114S of the rear panel 114 at least partially defines a rear inner surface of the compartment 180 and thus at least partially defines and encloses a bottom boundary of the compartment 180. In some example embodiments, including the example embodiments shown in FIGS. 1-7, 14A-21E, and 23A-23C, the set of one or more fixed panels 110 may include a top panel 116 having a bottom surface 116S and overlapping the bottom panel 112 in a vertical direction, where the bottom surface 116S of the top panel 116 at least partially defines a top inner surface of the compartment 180 and thus at least partially defines and encloses a top boundary of the compartment 180. In some example embodiments, including the example embodiments shown in FIGS. 1-7, 14A-21E, and 23A-23C, the set of one or more fixed panels 110 may include opposing side panels 118-1 and 118-2 extending at least between opposite edges of the top panel 116 and opposite edges of the bottom panel 112. The opposing side panels 118-1 and 118-2 may further extend orthogonally from opposite edges of the rear panel 114, and opposing side surfaces 118-1S and 118-2S of the opposing side panels 118-1 and 118-2 may at least partially define opposing side inner surfaces of the compartment 180 and thus may at least partially define and enclose opposing side boundaries of the compartment 180. The top panel 116, bottom panel 112, and opposing side panels 118-1 and 118-2 may further define a front boundary of the compartment 180 but may not enclose the front boundary of the compartment 180.

As shown in FIGS. 1-7, 14A-21E, and 23A-23C, the set of one or more fixed panels 110 may define the entirety of the boundaries of the compartment 180, and thus may entirely "define" the compartment 180, and may enclose all of the boundaries of the compartment 180, but at least the front boundary of the compartment 180 may not be enclosed by the set of one or more fixed panels 110. As shown in FIGS. 8-10, 24A-24B, the set of one or more fixed panels 110 may define some (e.g., a limited portion) of the boundaries of the compartment 180, and thus may partially "define" the compartment 180, and may enclose some of the boundaries of the compartment 180, but at least the front boundary of the compartment 180 may not be enclosed by the set of one or more fixed panels 110. Accordingly, the compartment 180 as defined by the set of one or more fixed panels 110, alone or in combination with the foldable support platform 120, may be an open enclosure.

Figure 19A:
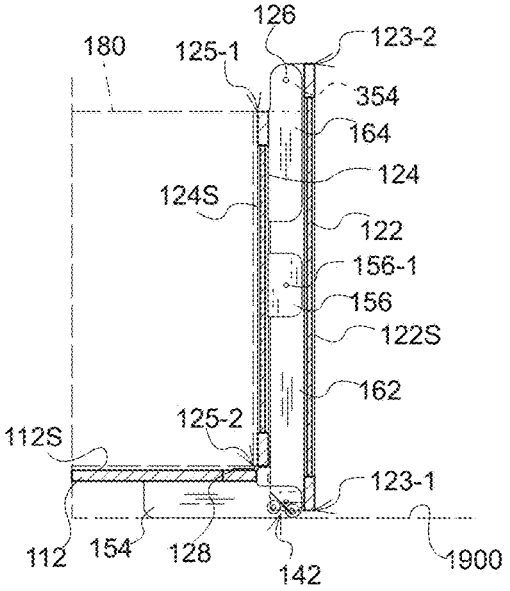
FIGS. 19A, 19B, 19C, 19D, and 19E are left views of a foldable support platform of a furniture object in various deployed positions according to some example embodiments.
Figure 19B:
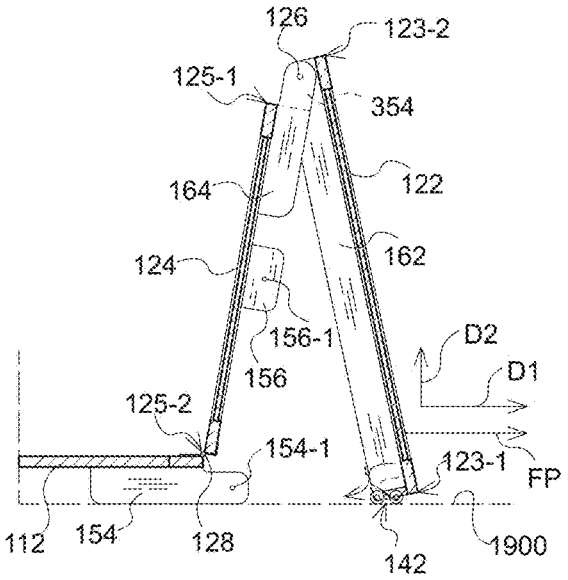
Figure 19C:
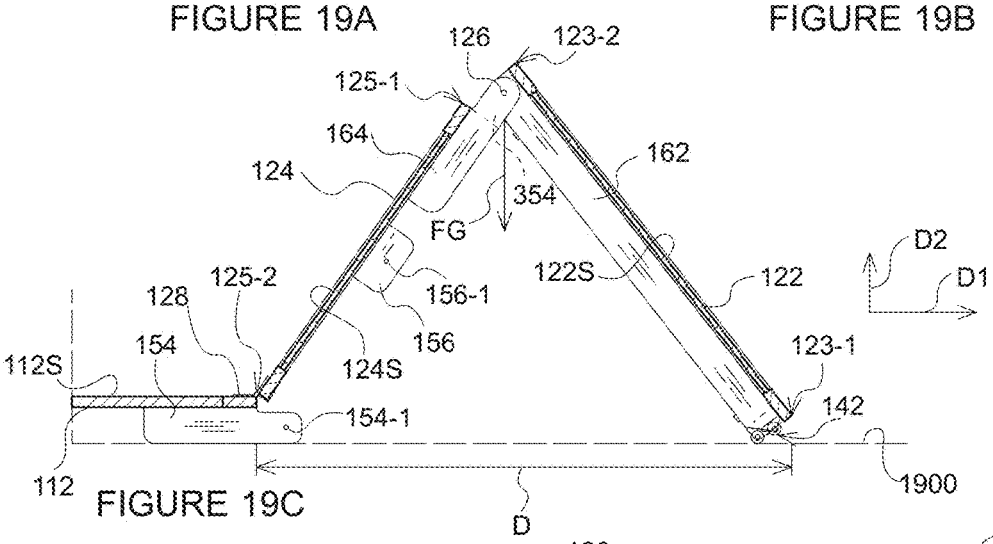
Figure 19D:
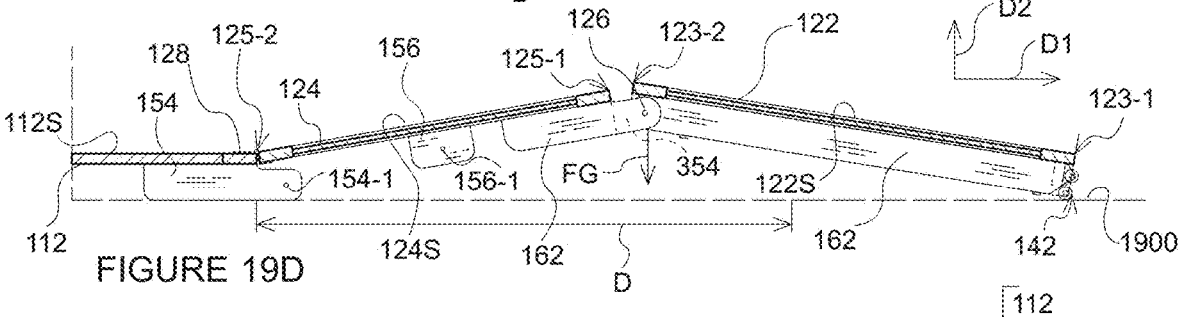
Figure 19E:
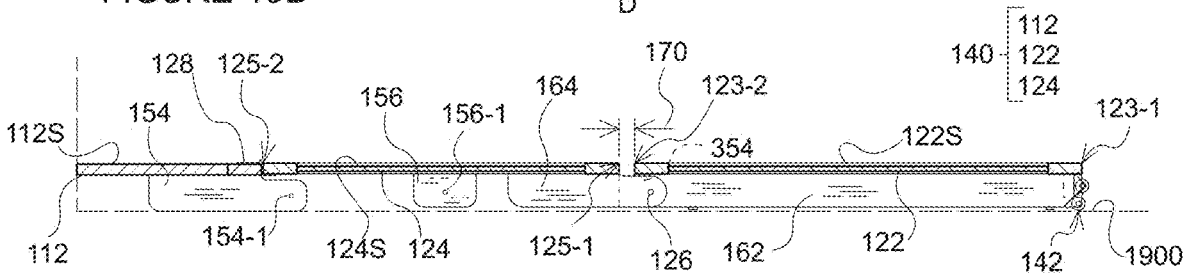
Figure 20A:
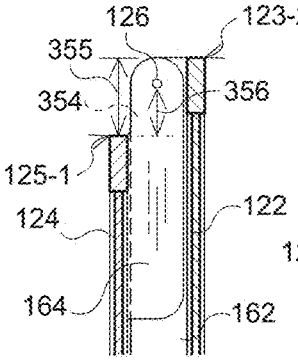
FIGS. 20A, 20B, 20C, 20D, and 20E are left views of a portion of a foldable support platform of a furniture object in various deployed positions according to some example embodiments.
Figure 20B:
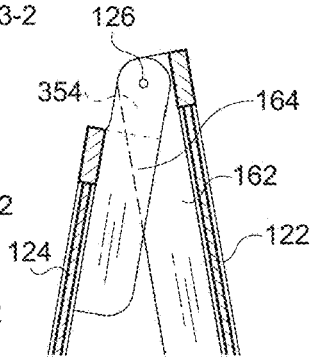
Figure 20C:
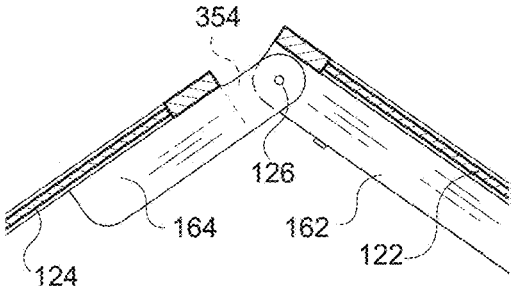
Figure 20D:
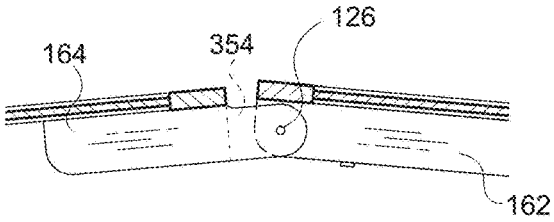
Figure 20E:
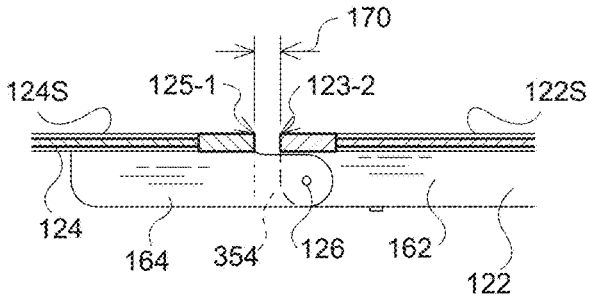

Still referring to FIGS. 1-7, 14A-21E, and 23A-23C, the foldable support platform 120 may be configured to move between a folded position, for example as shown in FIGS. 1, 14A-14C, and 19A, and a deployed position, for example as shown in FIGS. 4, 17C-17D, and 19E, via a scissors-type motion, for example as shown in FIGS. 2-3, 15A-16C, and 19B-19D, where the foldable support platform 120 is shown in a partially-deployed position, to provide a reversibly-deployable sleeping platform 140 that may at least partially structurally support the foldable bed 190 resting, in an unfolded configuration, thereupon, for example as shown in FIG. 23C. In some example embodiments, the foldable support platform 120, when in the deployed position, for example as shown in FIG. 19E, may, in combination with the bottom panel 112, define the sleeping platform 140 such that the sleeping platform 140 may structurally support the foldable bed 190 resting, in the unfolded configuration, on first surfaces 124S and 122S of the proximate and distal support panels 124 and 122 and the upper surface 112S (also referred to as "first surface") of the bottom panel 112, such that the first surfaces 122S and 124S of the distal and proximate support panels 122 and 124 are coplanar with each other and with the upper surface 112S of the bottom panel 112, such that the first surfaces 122S and 124S both face upwards (e.g., away from a support surface 1900 upon which the furniture object 100 is resting), in addition to the upper surface 122S which faces upwards, such that the upwards-facing, coplanar surfaces 122S, 124S, 112S are configured to directly contact the underside of the foldable bed 190 resting on the sleeping platform 140 in the unfolded configuration and thus structurally support the foldable bed 190 resting on the sleeping platform 140 in the unfolded configuration. But, it will be understood that, in some example embodiments, the furniture object 100 may omit at least the bottom panel 112 and may omit any fixed panels 110, such that the furniture object 100 is entirely comprised by the foldable support platform 120. It will be understood that an element that is described herein to be configured to "structurally support" another element is configured to support at least a portion of the structural load (e.g., weight) of the other element.

In some example embodiments, including the example embodiments shown in at least FIGS. 1-7, 14A-21E, and 23A-23C, and as particularly shown in FIGS. 19A-19E, the foldable support platform 120 may be configured to move between the folded position, for example as shown in FIG. 19A, and the deployed position, for example as shown in FIG. 19E, via a scissors-type motion such that the opposite, distal edges 123-1 and 125-2 of the foldable support platform 120 move in relation to each other, in a first direction D1 that is parallel or substantially parallel to a support surface 1900 (also referred to herein as a floor) upon which the furniture object 100 rests, during the movement between the folded position and the deployed position while edges 123-2 and 125-1 are hingeably connected to each other via hingeable connection 126 between the proximate and distal support panels 124 and 122, and thus remain approximately close in position to each other in relation to the relatively large change in proximity between the distal edges 123-1 and 125-2 of the foldable support platform 120 during the movement between the folded position and the deployed position, for example as shown in FIGS. 19A-19E.

The foldable support platform 120 may be configured to move between the folded position and the deployed position via a scissors-type motion such that the opposite, distal edges 123-1 and 125-2 of the foldable support platform 120 are configured to collectively transmit the structural load, or weight, of the foldable support platform 120 to a support surface 1900 upon which the furniture object 100 is resting, either directly or via transmission through an intervening structure such as the set of one or more fixed panels 110, throughout an entirety of the process of moving the foldable support platform 120 between the folded and deployed positions.

As a result, the foldable support platform 120 may be configured to be moved between the folded and deployed positions, as shown in at least FIGS. 19A-19E, by a driver, which may be a human operator and/or a mechanical driver such as an electrical motor, without the driver having to partially or entirely support the structural load, or weight, of the foldable support platform 120. Instead, the structural load of the foldable support platform 120 may be transferred to the underlying support surface 1900 via 1) a hingeable connection 128 between edge 125-2 of the foldable support platform 120 and the set of one or more fixed panels 110 and 2) a direct (e.g., sliding) or indirect (e.g., rolling via attached rollers 142) connection between edges 123-1 of the foldable support platform 120 and the underlying support surface 1900. As a result, the foldable support platform 120 to be moved between the folded and deployed positions based on reduced magnitudes of effort by the driver (e.g., human operator and/or mechanical driver) thereby improving the ease of movement and practicality of the foldable support platform 120 and increasing the range of drivers that may be configured to move the foldable support platform 120 completely between the folded and deployed positions. For example, the effort exerted by the driver to move the foldable support platform 120 between the folded and deployed positions may be limited to effort to induce lateral movement and/or acceleration of the foldable support platform 120 between the folded and deployed positions.

In some example embodiments, including the example embodiments shown in FIGS. 1-7, 14A-21E, and 23A-23C, the foldable support platform 120 may include a distal support panel 122 and a proximate support panel 124, where the proximate support panel 124 is hingeably connected to the distal support panel 122 and the set of one or more fixed panels 110 via one or more hingeable connections 126 and one or more hingeable connections 128 at opposite edges 125-1, 125-2 of the proximate support panel 124. Structures that are connected to each other via a hingeable connection will be understood to be hingeably connected to each other For example, as shown in FIGS. 1-7, 14A-21E, 23A-23C, and 24A-24B, the proximate support panel 124 may be hingeably connected (e.g., directly connected) to the bottom panel 112 and/or the opposing side panels 118-1 and 118-2 via a set of one or more hingeable connections 128 at edge 125-2 of the proximate support panel 124, and the proximate support panel 124 may also be hingeably connected (e.g., directly connected) to the distal support panel 122 via a set of one or more hingeable connections 126 at edge 125-1 of the proximate support panel 124, where edges 125-1 and 125-2 are opposite edges of the proximate support panel 124.

It will be understood that the one or more hingeable connections 126 and the one or more hingeable connections 128 may be same or different types of hingeable connections and may each include any type of hinge connection known in the art, including, without limitation, a pivot hinge connection, a spring hinge connection, a barrel hinge connection, a case hinge connection, or any combination thereof.

For example, in some example embodiments, the hingeable connection 126 may include one or more pivot hinge connections, also referred to herein as one or more pivot pin connections, which may include one or more pivot pins (e.g., clevis pins) that extend through a portion of the proximate support panel 124 and a portion of the distal support panel 122 to hingeably connect the proximate support panel 124 and the distal support panel 122 together. Such one or more pivot pins may be referred to herein as one or more pivot pin connections. Accordingly, it will be understood that, in some example embodiments, the distal and proximate support panels 122 and 124 may be hingeably connected together via a hingeable connection 126 that includes at least one pivot pin connection that may include a pivot pin that extends through a portion of the proximate support panel 124 and a portion of the distal support panel 122.

In some example embodiments, the hingeable connection 128 may include at least one pivot pin connection that may include a pivot pin that extends through a portion of the proximate support panel 124 and a portion of one or more fixed panels 110. In some example embodiments, the hingeable connection 128 may include a different type of hinge connection than the hingeable connection 126. For example, in some example embodiments, the hingeable connection 126 may include one or more pivot pin connections between the proximate and distal support panels 124 and 122, and the hingeable connection 128 may include one or more barrel hinge connections between the proximate support panels 124 and one or more fixed panels 110.

As shown in at least FIGS. 14A-20E, and particularly as shown in FIGS. 18A-18B, separate distal support structures 162 may be connected (e.g., affixed via any well-known means) to an underside of the distal support panel 122 at (e.g., adjacent and/or proximate to) opposite edges 122-E thereof, and separate proximate support structures 164 may be connected (e.g., affixed) to an underside of the proximate support panel 124 at opposite edges 124-E thereof. The proximate and distal support structures 164 and 162 may, in collection with support structures 166 and 168, collectively at least partially comprise one or more structural supports 144 that that are configured to contact an underlying support surface 1900 upon which the furniture object 100 is resting when the foldable support platform 120 is in the deployed position, for example as shown in FIG. 19E, such that the one or more structural supports 144 may assist in transferring a structural load of the foldable bed 190 and one or more loads resting thereupon to the underlying support surface 1900, and thus enabling the sleeping platform 140 to support the structural load of the foldable bed 190 and one or more loads resting thereupon As shown in at least FIGS. 14A-20E, and particularly as shown in FIGS. 18A-18B 19A-19E, and 20A-20E, separate sets 167 of proximate and distal support structures 164 and 162 that are adjacent to each other at a same edge 120-E of the foldable support platform 120, where the same edge 120-E includes adjacent edges 124-E and 122-E that are on a same side of the longitudinal axis 141 when the foldable support platform 120 is the deployed position as shown in at least FIGS. 17A-17D, may be connected to each other via separate, respective hingeable connections 126, where each separate hingeable connection 126 may include a pivot pin connection. As shown, each distal support structure 162 includes a through hole 362 that may be aligned with a through hole 364 of a corresponding proximate support structure 164 that is part of the same set 167 at the same edge 120-E of the foldable support platform 120. As shown in at least FIG. 18A, separate hingeable connections 126 connecting separate, respective sets 167 of proximate and distal support structures 164 and 162 at separate, respective edge 120-E of the foldable support platform 120 may each include a clevis pin 372 that extends through aligned through holes 362 and 364 of the distal and proximate support structures 162 and 164 of the given set 167, and the clevis pin 372 may further extend through a washer 374 and a hairpin cotter pin 376 may be inserted through a hole in the clevis pin 372 to secure the clevis pin in the aligned through holes 362 and 364 to establish the hingeable connection 126.

Referring now to FIG. 18B, FIGS. 19A-19E, and 20A-20E, the proximate support structure 164 may include a protruding structure 354 (which may be a continuous part of the proximate support structure 164) that protrudes outward from under (e.g., away from) the proximate support panel 124 and away from the proximate edge 125-1 by at least a particular spacing distance 355, where the through hole 364, and thus the hingeable connection 126 that connects the proximate support structure 164 to a distal support structure 162, is spaced apart from the proximate edge 125-1 by at least another spacing distance 356. As a result of such spacing of the hingeable connection 126 from the proximate edge 125-1 as a result of the protrusion of the protruding structure 354, and as shown in FIG. 18B, FIGS. 19A-19E, and 20A-20E, the foldable support platform 120 may be configured to establish a gap space 170 between the proximate edge 123-2 of the distal support panel 122 and the proximate edge 125-1 of the proximate support panel 124, such that the proximate edges 123-2 and 125-1 do not touch (e.g., do not contact each other) and thus the first surfaces 122S and 124S do not touch (e.g., do not contact each other) when the foldable support platform 120 is in the fully deployed position such that the first surfaces 122S and 124S are coplanar and facing upwards, away from support surface 1900, as shown in at least FIG. 19E. As a result, the safety provided to a driver that is a human operator and who applies force to the foldable support platform 120 to cause the foldable support platform 120 to move between the folded and deployed positions may be improved. For example, the presence of at least the gap space 170 between the support panels 122 and 124 when the foldable support platform 120 is in the deployed position, based on the hingeable connections 126 being pivot pin connections, reduces or prevents the risk of injury to a human operator driver due to limbs (e.g., fingers) being trapped or jammed between edges 123-2 and 125-2 when the foldable support platform 120 is moved to or from the fully deployed position. The magnitude of the gap space 170 may be a minimum spacing distance that is sufficiently large to prevent most or all human limbs (e.g., fingers) from being trapped and/or jammed between edges 123-2 and 125-1. For example, the gap space 170 may be set, based on the spacing 355 and 356 of the protruding structure 354 of the support structures 164 and the through holes 364 thereof that at least partially comprise the hingeable connections 126, to be equal to or greater than about 2 inches (e.g., 2±0.2 inches).

Figure 21A:
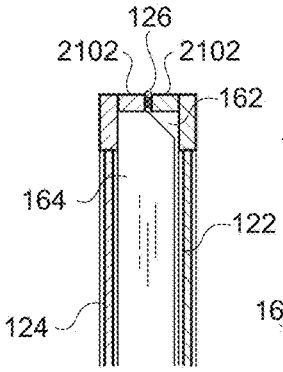
FIGS. 21A, 21B, 21C, 21D, and 21E are left views of a portion of a foldable support platform of a furniture object in various deployed positions according to some example embodiments.
Figure 21B:
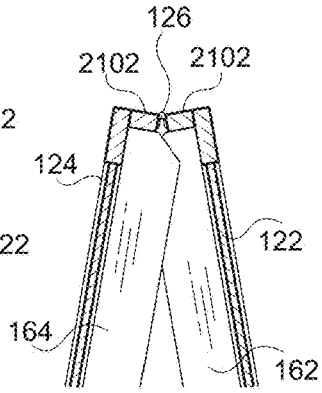
Figure 21C:
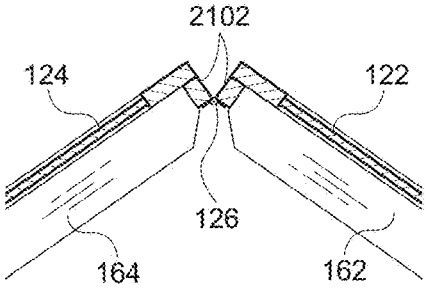
Figure 21D:
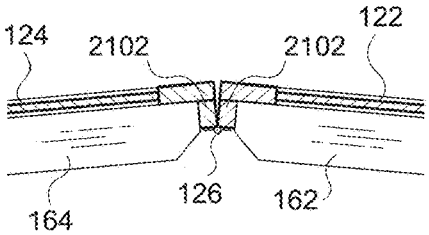
Figure 21E:
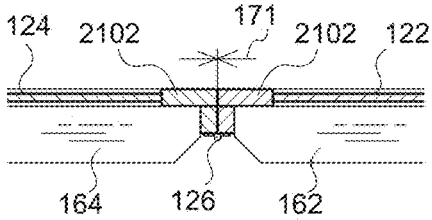

As shown in FIGS. 21A-21E, in some example embodiments, the hingeable connection 126 may include one or more hinges that connect opposing proximate and distal support panels 124 and 122. As shown in FIGS. 21A-21E, a hingeable connection 126 that is a hinge (e.g., a case hinge) may be configured to enable the distal and proximate support panels 122 and 124 to be in flush contact when the foldable support platform 120 is in the fully deployed position, for example as shown in FIG. 21E, such that opposing faces 2102 of the distal and proximate support panels 122 and 124 are in flush contact with each other. As shown, a gap space 171 between the distal and proximate support panels 122 and 124 when the foldable support platform 120 is in the fully deployed position as shown in FIG. 21E may be absent or very small (e.g., less than 0.5 inches), based on the hingeable connection 126 being a hinge connection. In addition, a hingeable connection 126 that includes a hinge connection as shown, for example, in FIGS. 21A-21E may close the gap spacing between the support panels 124 relatively quickly when the foldable support platform 120 moves between the folded and fully deployed positions.

In contrast, as shown in at least FIGS. 20A-20E, a gap space 170 between the distal and proximate support panels 122 and 124 when the foldable support platform 120 is in the fully deployed position may be present, and may be set based on spacings 355 and/or 356 of the protruding structure 354 to be at least a certain distance (e.g., 2 inches) that is associated with reduced or minimized human operator injury due to limbs being trapped between edges 123-2 and 125-2 when the foldable support platform 120 is in the fully deployed position. Additionally, based on the hingeable connection 126 being a pivot pin connection and/or the hingeable connection 126 being spaced apart by spacing distance 356 from edge 125-1 based on the support structure 164 including a protruding structure 354, the hingeable connection 126 may close the gap spacing between the support panels 124 and 122 relatively slowly during movement of the foldable support platform from the folded position shown in FIG. 20A to the fully deployed position shown in FIG. 20E, in comparison to the closing of the gap spacing during movement of the foldable support platform from the folded position shown in FIG. 21A to the fully deployed position shown in FIG. 21E when the hingeable connection 126 is a hinge connection as shown in FIGS. 21A-21E.

In some example embodiments, the support structure 162, instead of support structure 164, may include a protruding structure 354 that protrudes away from the distal support panel 122, and away from the proximate edge 123-2, but spacing distance 355 such that the through hole 362 of the support structure 162, and thus the hingeable connection 126, is spaced away from the edge 123-2 by distance 356. In some example embodiments, both support structures 162 and 164 may have respective protruding structures 354 that may protrude from the respective edges 125-1 and 123-2 by respective spacing distances 355 (which may be the same distance or different distances in the support structures 162, 164) such that the hingeable connection 126 between the support structures 162, 164 is spaced apart from both the edge 123-2 and the edge 125-1 by respective spacing distances 356 (where the spacing distance 356 of the hingeable connection 126 from edge 125-1 may be the same as or different from the spacing distance 356 of the hingeable connection 126 from edge 122-2).

Accordingly, and as shown, a foldable support platform 120 that includes a hingeable connection 126 (e.g., a pivot pin connection) that connects the proximate and distal support panels 124 and 122 based on connecting respective support structures 164, 162 that have one or more protruding structures 354 that cause the hingeable connection 126 to be spaced apart (e.g., by one or more respective spacing distances 356) from one or both of the proximate edges 123-2 and 125-1 of the distal and proximate support panels 122 and 124. Accordingly, the spacing of the hingeable connection 126 due to the one or more protruding structures 354 may thereby cause the foldable support platform 120 to be configured to cause gap space 170 to be present, such that the proximate edges 123-2 and 125-1 of the distal and proximate support panels 122 and 124 do not touch (e.g., do not contact each other), when the foldable support platform 120 is in the deployed position (e.g., when the first surfaces 122S, 124S are coplanar with each other and face upwards, e.g., away from support surface 1900). Such a foldable support platform 120 may provide improved human operator safety in relation to a foldable support platform 120 that includes a hingeable connection that is a hinge connection.

As shown in at least FIGS. 15A-18B and 24A-24B, the hingeable connection 128 may include one or more hinges (e.g., one or more barrel hinges) connecting the bottom panel 112 to the proximate support panel 124. Such a hingeable connection 128 may enable the proximate support panel 124 and bottom panel 112 to be in flush contact, such that a gap space between the proximate support panel 124 and bottom panel 112 are reduced or minimized, when the foldable support platform 120 is in the fully deployed position as shown in at least FIGS. 17A-17D. However, example embodiments are not limited thereto.

It will be further understood that a hingeable connection is not limited to a hinge connection, and elements that are hingeably connected to each other are not limited to elements that are connected to each other by a hinge connection. For example, it will be understood that elements that are hingeably connected to each other via a hingeable connection may be configured to move in relation to each other, between two or more relative positions, while remaining physically connected to each other via one or more movable and/or fixed structures. In addition, it will be understood that a hingeable connection may include a set of one or more structures that, when connected to two separate structures, is configured to enable the two separate structures to move in relation to each other while remaining physically connected to both of the two separate structure.

In some example embodiments, including the example embodiments shown in FIGS. 1-7, 14A-21E, and 23A-23C, the foldable support platform 120 includes one or more rollers 142 connected (e.g., directly connected) to an edge 123-1 of the distal support panel 122 that is opposite to the edge 123-2 that is connected (e.g., directly connected) to the edge 125-2 of the proximate support panel 124. As shown in at least FIGS. 2-3 and FIGS. 19A-19E, the one or more rollers 142 are configured to establish rolling contact between the distal support panel 122 and a surface, to transfer at least a portion of the structural load, or weight, of the foldable support platform 120 to the underlying support surface 1900. Accordingly, the rollers 142, in combination with the one or more hingeable connections 128, may support the structural load of the foldable support platform 120. It will be understood that, in some example embodiments the one or more rollers 142 may be absent from the furniture object 100, and the edge 123-1 of the distal support panel 122 may be configured to directly contact the underlying support surface 1900 via sliding contact when the foldable support platform is moved between the folded and deployed positions.

As shown in FIGS. 19A-19E, a furniture object 100 that is supported on a support surface 1900 (e.g., a floor) may have a foldable support platform 120 that may be moved from the folded position shown in FIG. 19A to the fully deployed position shown in FIG. 19E. As shown at FIGS. 19A-19B, the movement may be initially implemented based on a force FP (e.g., a pulling or pushing force) being applied to at least a portion of the distal support panel 122 (e.g., based on exerting a pulling force on one or more of the handles 132-1, 132-2) by a driver (e.g., human operator) to cause at least the distal edge 123-1 of the distal support panel 122 to move in a horizontal, first direction D1 that is at least partially parallel to the support surface 1900, while the distal edge 125-2 does not move in relation to the support surface 1900, such that the distal edge 123-1 of the distal support panel 124 is caused to move away from the distal edge 125-2 of the proximate support panel 122, and thus away from the bottom panel 112, in the first direction D1. The distal edge 123-1 may be supported on the support surface 1900 by rollers 142 that roll over the surface 1900 as the distal edge 123-1 is moved away from distal edge 125-2 in the first direction D1 based on application of the force FP. The driver-applied force FP may be referred to herein as a "driver force" and may be applied on the one or more handles 132-1, 132-2 coupled to the distal support platform 122.

FIG. 19B shows the foldable support platform 120 in a first partially-deployed position, where the foldable support platform 120 remains stable and does not move without further application of the driver force FP to cause the foldable support platform 120 to move from the first partially deployed position.

As shown in FIG. 19C, where the foldable support platform 120 is in a second partially-deployed position (also referred to herein as a threshold partially deployed position, at least the distal edge 123-1 of the distal support panel 124 are caused to move away from the distal edge 125-2 of the proximate support panel 122, and thus away from the bottom panel 112, in the first direction D1 at least until, in response to the foldable support platform 120 being in the second partially-deployed position, the horizontal distance between distal edges 123-1 and 125-2 is equal to or greater than a particular distance D at which the weight of the hingeably connected proximate and distal support panels 124 and 122 provides a downward force FG that causes the hingeable connection 126 and the edges 123-2 and 125-1 connected via the hingeable connection 126 to move downwards in a vertical, second direction D2 that is perpendicular to the first direction towards the support surface 1900 under the influence of gravity and with reduced or no further application of force FP by a driver (e.g., human operator). Restated, in response to the foldable support platform 120 being in the second partially-deployed position, the foldable support platform 120 begins to move toward the fully deployed position shown in FIG. 19E with reduced or no further application of driver force FP to the foldable support platform 120 (e.g., without any further application of driver force FP to the foldable support platform 120).

Accordingly, in response to the foldable support platform 120 being in the second partially-deployed position, where the horizontal distance between distal edges 123-1 and 125-2 is equal to or greater than the particular distance D, the downward force FG causes the distal edge 123-1 of the distal support panel 124 to move further outwards in the first direction D1 with reduced or no further application of force FP by a driver (e.g., human operator) (e.g., without any further application of driver force FP to the foldable support platform 120).

As shown in FIG. 19D, where the foldable support platform 120 is at a third partially-deployed position, the horizontal distance between distal edges 123-1 and 125-2 is greater than the particular distance D. As a result, when the foldable support platform 120 is at the third partially-deployed position shown in FIG. 19D, the downward force FG causes the hingeable connection 126 and the edges 123-2 and 125-1 connected via the hingeable connection 126 to move downwards in the second direction D2, and the distal edge 123-1 of the distal support panel 124 to move further outwards in the first direction D1, with reduced or no further application of force FP by a driver (e.g., human operator). Thus, when the foldable support platform 120 is at the third partially-deployed position shown in FIG. 19D, the foldable support platform 120 moves towards the fully deployed position shown in FIG. 19E with reduced or no further application of driver force FP by a driver (e.g., without any further application of driver force FP to the foldable support platform 120).

As a result, the movement of the foldable support platform 120 between the folded position shown in FIG. 19A and the fully deployed position shown in FIG. 19E may be implemented by a driver (e.g., human operator) in a single-step pulling action (e.g., the application of force FP) to cause the foldable support platform 120 to move to a until the horizontal distance between distal edges 123-1 and 125-2 reaches a particular distance D, for example as shown in FIG. 19C) such that the foldable support platform 120 may be unfolded with improved simplicity and ease to the driver. Similarly, the folding of the foldable support platform 120 (e.g., the movement of the foldable support platform 120 from the fully deployed position shown in FIG. 19E to the folded position shown in FIG. 19A) may be implemented via a single-step pushing action (e.g., application of a pushing force that is in the opposite direction of the force FP) by a driver, such that the foldable support platform 120 may be folded with improved simplicity and ease to the driver.

In some example embodiments, including the example embodiments shown in FIGS. 1-7, 14A-21E, and 23A-23C, and as particularly shown in FIGS. 19A-19E, the foldable support platform 120 may be configured to move between the folded and deployed positions via scissors-type motion, such that, as shown in at least FIG. 1, when the foldable support platform 120 is in the folded position, shown for example in FIG. 19A, the foldable support platform 120 may enclose at least a portion of the compartment 180, such that a first surface 122S (e.g., upper surface) of the distal support panel 122 faces outwards from the furniture object 100 and defines an outer surface of the furniture object 100, while a first surface 124S (e.g., upper surface) of the proximate support panel 124 faces inwards into the interior of the furniture object 100 and defines a front inner surface of the compartment 180, thereby at least partially enclosing the front boundary of the compartment 180. As shown, the surface 114S of the rear panel 114 may define a rear inner surface of the compartment 180 that opposes the front inner surface of the compartment 180 that is defined by the first surface 124S of the proximate support panel 124 when the foldable support platform 120 is in the folded position. In some example embodiments, including the example embodiments shown in FIGS. 1-7, the foldable support platform 120 may be configured to complete an enclosure of the compartment 180 when in the folded position, such that the first surface 124S, in combination with the upper surface 112S, the side surfaces 118-1S and 118-2S, the surface 114S, and the bottom surface 116S collectively define compartment 180 as a closed enclosure, within manufacturing tolerances and/or material tolerances, within the interior of the furniture object 100.

As shown in at least FIGS. 5, 22A-22C, and 23A-23C, the furniture object 100 may be configured to hold, or store, a foldable bed 190 in a folded configuration at least partially within the compartment 180. As shown in FIGS. 22A-23C, the foldable bed 190 may include multiple separate, coupled section 190-1, 190-2, and 190-3 which may be folded or unfolded in relation to each other to move the foldable bed 190 between a folded configuration shown in FIG. 22A, where the sections 190-1 to 190-3 are folded to extend in parallel with each other, and a deployed configuration shown in FIG. 22C, where the sections 190-1 to 190-3 are unfolded to extend in series in a same plane. As shown in FIGS. 5 and 23A, the foldable bed 190 may be entirely held within the compartment 180 when in the folded configuration (e.g., as shown in FIG. 22A), but example embodiments are not limited thereto. As shown in at least FIGS. 5 and 23A, the furniture object 100 may be configured to hold the foldable bed 190 in a folded configuration entirely within the compartment 180 when the foldable support platform 120 is in a folded position, such that the foldable bed 190 is isolated from direct contact with the first surface 122S of the distal support panel 122, and the foldable bed 190 is entirely absent from being between the proximate and distal support panels 124 and 122 when the foldable support platform 120 is in a folded position, for example as shown in FIGS. 1 and 14A-14C.

In some example embodiments, including the example embodiments shown in at least FIGS. 4, 6-7, and 23B-23C and particularly FIGS. 19A-19E, the foldable support platform 120 may be configured to move between the folded and deployed positions via scissors-type motion such that, when the foldable support platform 120 is in the deployed position, shown for example in FIG. 19E and FIGS. 17A-17D, the foldable support platform 120, in combination with the bottom panel 112, defines a sleeping platform 140 that extends between the interior and exterior of the furniture object 100 and is configured to structurally support the load, or weight, of the entire bottom surface of the foldable bed 190 in the unfolded configuration and at least a certain structural load, or weight, of one or more loads (e.g., human occupants) resting on the top surface of the foldable bed 190 in the unfolded configuration. As shown in at least FIGS. 4, 6-7, and 23B-23C, the first surfaces 122S and 124S of the distal and proximate support panels 122 and 124 may be coplanar with each other and with the upper surface 112S of the bottom panel 112 (e.g., surfaces 122S, 124S, and 112S all face upwards, away from the support surface 1900) when the foldable support platform 120 is in the deployed position, such that the surfaces 122S, 124S, and 112S collectively define a planar, upwards-facing surface having a surface area sufficient to contact (e.g., directly contact) an entire bottom surface (e.g., underside) of the foldable bed 190 in the unfolded configuration and thus collectively define a planar surface that is configured to directly contact and structurally support at least the outer boundaries of the bottom surface of the foldable bed 190 in the unfolded configuration. As shown, the proximate and distal support panels 124 and 122 may each include one or more structural supports 144 that are configured to contact an underlying support surface 1900 upon which the furniture object 100 is resting when the foldable support platform 120 is in the deployed position, for example as shown in FIG. 19E, such that the one or more structural supports 144 may assist in transferring a structural load of the foldable bed 190 and one or more loads resting thereupon to the underlying support surface 1900, and thus enabling the sleeping platform 140 to support the structural load of the foldable bed 190 and one or more loads resting thereupon.

It will be understood that elements described herein as being "coplanar" with each other encompasses elements that are exactly coplanar with each other and elements that are "substantially" coplanar with each other, where elements that are "substantially" coplanar are coplanar with each other within manufacturing tolerances and/or material tolerances known in the art.

In some example embodiments, at least the first surface 122S of the distal support panel 122 may include ornamentation that is similar to ornamentation on other outer surfaces of the furniture object 100, so that the first surface 122S may at least partially obscure or conceal that compartment 180 is present in the furniture object 100 and/or that a foldable bed 190 is held within an interior of the furniture object 100 and/or that a foldable support platform 120 may be deployed to establish the sleeping platform 140.

In some example embodiments, where the furniture object 100 includes at least a bottom panel 112 such that the sleeping platform 140 may include the bottom panel 112, which is a fixed panel, in addition to the foldable support platform 120, to structurally support the foldable bed 190 in the unfolded configuration, the furniture object 100 may have reduced complexity of the foldable support platform 120. For example, the bottom panel 112 may be structurally reinforced (e.g., with fasteners 134 which may include screws, nails, or the like and which may fix the panel 112 to a separate fixed structure including one or more of the opposing side panels 118-1 or 118-2 and/or the rear panel 114) to be configured to provide at least some of the structural support of the foldable bed 190 without being also configured to move independently of the set of one or more fixed panels 110. Accordingly, the foldable support platform 120 may be configured to support a reduced proportion of the structural load of the foldable bed 190 and one or more loads resting thereupon and thus may be lighter, improving the ease with which the foldable support platform 120 may be moved by a driver between the folded and deployed positions as shown in at least FIGS. 19A-19E and thus improving the practicality of the furniture object 100.

It will be understood that, in some example embodiments, the furniture object 100 may not include any fixed panels 110, and thus may not include a bottom panel 112 that, in addition to the foldable support platform 120, structurally supports the foldable bed 190 in the unfolded configuration when the foldable support platform 120 is in the deployed position. In some example embodiments, the furniture object 100 that does not include any fixed panels 110 may entirely comprise the foldable support platform 120 that is configured to be hingeably connected (e.g., via one or more hingeable connections 128) to one or more fixed structures of a separate object (e.g., a separate article of furniture 200 as described with reference to FIGS. 11-13 and 25A-26B), and one or more of the fixed structures of the separate object may, in combination with the foldable support platform 120, structurally support the foldable bed 190 in the unfolded configuration when the foldable support platform 120 is in the deployed position. Accordingly, it will be understood that the foldable support platform 120 may be configured to support a reduced proportion of the structural load of the foldable bed 190 and one or more loads resting thereupon and thus may be lighter, improving the ease with which the foldable support platform 120 may be moved by a driver between the folded and deployed positions and thus improving the practicality of the furniture object 100, even when the furniture object 100 does not include any fixed panels 110.

In some example embodiments, the furniture object 100 that does not include any fixed panels 110 may entirely comprise the foldable support platform 120 that is configured to be hingeably connected (e.g., via one or more hingeable connections 128) to one or more fixed structures of a separate object (e.g., a separate article of furniture 200 as described with reference to FIGS. 11-13 and 25A-26B), and the foldable support platform 120, may be configured to structurally support the entirety of the foldable bed 190 in the unfolded configuration when the foldable support platform 120 is in the deployed position. Such a furniture object 100 that does not include any fixed panels 110 may thus include a foldable support platform 120 that may be configured to be moved between the folded and deployed positions based on reduced magnitudes of effort by the driver (e.g., human operator and/or mechanical driver) thereby improving the ease of movement and practicality of the foldable support platform 120 and increasing the range of drivers that may be configured to move the foldable support platform 120 completely between the folded and deployed positions, based at least in part upon the opposite, distal edges 123-1 and 125-2 of the foldable support platform 120 being configured to collectively transmit the structural load, or weight, of the foldable support platform 120 to a surface upon which the furniture object 100 is resting, either directly or via transmission through an intervening structure such as the set of one or more fixed panels 110, throughout an entirety of the process of moving the foldable support platform 120 between the folded and deployed positions, even though the furniture object 100 may not include any fixed panels 110.

In some example embodiments, for example as shown in FIGS. 19A-19E and FIGS. 23A-23C, the foldable support platform 120 is configured to move between the folded and deployed positions independently of the foldable bed 190, which may be folded and stored in the compartment 180 independently of the motion of the foldable support platform 120 and which, when held in the compartment 180, may be structurally supported by the bottom panel 112. As a result, in some example embodiments, the foldable support platform 120 may be moved between the folded and deployed positions independently of any manipulation of the foldable bed 190 in combination with the foldable support platform 120. Thus, in some example embodiments, the foldable support platform 120 may have reduced weight and complexity, thereby improving the practicality of the furniture object 100.

In some example embodiments, including the example embodiments shown in FIGS. 1-7, 14A-21E, and 23A-23C, one or more of the set of one or more fixed panels 110, including for example one or more of opposing side panels 118-1 and 118-2, may include one or more stop structures 146 (e.g., stop structures 146-1 and 146-2 on separate opposing side panels 118-1 and 118-2) that extend into the compartment 180, where the stop structure 146 is configured to contact at least a portion of the proximate support panel 124, for example the first surface 124S thereof, when the foldable support platform 120 is in the folded position. As a result, the stop structure 146 may restrict motion of the proximate support panel 124 into the interior of the furniture object 100 when the foldable support platform 120 is in the folded position, thereby reducing or preventing the likelihood of excessive compression of any objects held in the compartment 180.

Referring now to FIG. 3 in particular, in some example embodiments the furniture object 100 may include a lift mechanism 150 that is connected at opposite ends to the set of one or more fixed panels 110 and the foldable support platform 120. The lift mechanism 150 may be configured to control the rate of change of position of one or more parts of the foldable support platform 120, for example the rate at which the foldable support platform 120 moves between the folded position and the deployed position. For example, the lift mechanism 150 may operate as a damper to limit the maximum rate at which the foldable support platform 120 may move between the folded and deployed positions. As a result, the lift mechanism 150 may reduce or prevent rapid, uncontrolled movement of the foldable support platform, thereby improving the ease with which a driver (e.g., a human operator or a mechanical driver) may controllably adjust the position of the foldable support platform 120 between the folded and deployed positions, thereby reducing or preventing abrupt, uncontrollable movement of the foldable support platform 120. Accordingly, safety, ease of use, and practicality of the furniture object 100 may be improved.

As shown in FIG. 3, the lift mechanism 150 may include multiple lift mechanisms 150-1 and 150-2 that are each connected at a first end 152-1 to the set of one or more fixed panels 110, for example separate side panels 118-1 and 118-2 as shown in FIG. 3, and are each further connected at an opposite, second end 152-2 to a separate, opposite edge of the foldable support platform 120, for example opposite edges of the proximate support panel 124 as shown in FIG. 3.

Referring now to FIGS. 15A-18B and 24A-24B, in particular, in some example embodiments, the furniture object 100 may include a single lift mechanism 150 that is connected at opposite ends 152-1 and 152-2 to the to the set of one or more fixed panels 110 and the foldable support platform 120. As shown in at least FIGS. 15A-17D and 24A-24B, a first end 152-1 of the single lift mechanism 150 may be coupled to a first support structure 154 that is connected (e.g., affixed) to an underside of the bottom panel 112, and an opposite, second end 152-2 of the single lift mechanism 150 may be coupled to a second support structure 156 that is connected to an underside of the proximate support panel 124. As further shown, the first end 152-1 may be coupled to a coupling point 154-1 (e.g., a hole) in the first support structure 154 and the second end may be coupled to a coupling point 156-1 (e.g., a hole) in the second support structure 156. As shown in at least FIG. 17B, the first and second support structures 154 and 156 may be connected to the bottom panel 112 and the proximate support panel 124, respectively, in alignment with the longitudinal axis of the sleeping platform 140 that is established when the foldable support platform 120 is in the fully deployed position shown in at least FIGS. 17A-17B.

Referring to FIGS. 15A-17D and FIGS. 19A-19E, the foldable support platform 120 may be configured to move between the folded position shown in FIG. 19A and the deployed position shown in FIG. 19E via a scissors-type motion, and supported and controlled via a lift mechanism 150, such that the opposite, distal edges 123-1 and 125-2 of the foldable support platform 120 move away from each other in the first direction D1 during the movement from the folded position as shown in FIGS. 15A-15B and 19A and the deployed position shown in FIGS. 17A-17D and 19E, while edges 123-2 and 125-1 are hingeably connected to each other via hingeable connection 126 between the proximate and distal support panels 124 and 122. As shown at FIGS. 16A-16C and 19B-19D, when the distance between the distal edges 123-1 and 125-2 reaches a certain, particular distance D, the weight of the hingeably connected proximate and distal support panels 1124 and 122 may naturally (that is, without additional manual application of force FP to the foldable support platform 120 by a driver (e.g., human operator and/or mechanical driver)) and quickly bring the hingeably connected proximate edges 123-2 and 125-1 downwards in the second direction D2 to complete the movement to the fully deployed position as shown in FIGS. 17A-17D. The lift mechanism 150 may enable the rate of lowering of the proximate edges 123-2 and 125-1 (e.g., the magnitude of the downwards-acting force FG caused by the weight of the hingeably connected proximate and distal support panels 124 and 122) to be controlled and/or reduced to be a reduced rate, thereby enabling the distal and proximate support panels 122 and 124 to be moved to the fully deployed position, shown for example in FIG. 19E, gently based on reduced magnitudes of effort (e.g., applied force FP) by the driver (e.g., human operator and/or mechanical driver) thereby improving the ease of movement and practicality of the foldable support platform 120 and increasing the range of drivers that may be configured to move the foldable support platform 120 completely between the folded and deployed positions. For example, the effort (e.g., applied force FP) exerted by the driver to move the foldable support platform 120 between the folded and deployed positions, e.g., to at least the positions shown in FIGS.

16A-16C and 19C to enable the downwards force FG, based on the weight of the hingeably connected proximate and distal support panels 124 and 122, to take over to complete the movement to the fully deployed position shown in FIGS. 17A-17D and 19E, may be limited to effort to induce the initial lateral movement and/or acceleration of the foldable support platform 120 between the folded and partially deployed positions, as shown for example in FIGS. 19A-19B.

It will be understood that a lift mechanism 150 according to any example embodiments may be any lift mechanism known in the art. For example, as shown in at least FIGS. 3, 15A-18B, and 24A-24B, a lift mechanism 150 may include a piston lift mechanism, including one or more devices that are sometimes referred to as a linear dashpot, a gas lift, or the like, which may control the rate at which the foldable support platform 120 moves between the deployed and folded positions based on controlling flow of a fluid in or out of at least one reservoir. However, it will be understood that example embodiments of a lift mechanism 150 are not limited to piston lift mechanisms. For example, in some example embodiments a lift mechanism 150 may include, without limitation, a spring lift mechanism which may control the rate at which the foldable support platform 120 moves between the deployed and folded positions based on operation of a spring.

In some example embodiments, including the example embodiments shown in FIGS. 1-7, 14A-21E, and 23A-23C, the distal support panel 122 may include a set of handles 132-1 and 132-2 at opposite ends of the first surface 122S of the distal support panel 122. As shown in at least FIG. 4, the set of handles 132-1 and 132-2 may have respective longitudinal axes 133-1 and 133-2. The longitudinal axes 133-1 and 133-2 may extend in parallel with each other, for example as shown in FIG. 4. Additionally, the handles 132-1 and 132-2 may be configured such that the longitudinal axes 133-1 and 133-2 extend in parallel with, and are equidistant from, the longitudinal axis 141 of the sleeping platform 140 that is defined when the foldable support platform 120 is in the deployed position. As a result, and as shown in at least FIGS. 6-7 and 23B-23C, the handles 132-1 and 132-2 may be configured to align a longitudinal axis 191 of the foldable bed 190 resting in the unfolded configuration on the sleeping platform 140 with the longitudinal axis 141 of the sleeping platform 140, where the longitudinal axis 141 extends through the bottom panel 112 and the proximate and distal support panels 124 and 122. Accordingly, the handles 132-1 and 132-2, in addition to providing a means for a human operator to manipulate and/or move the foldable support platform 120 between the deployed and folded positions, may further provide alignment and lateral, or horizontal, structural support to the foldable bed 190 resting on the sleeping platform 140 to thus reduce or prevent the possibility of misalignment or undesirable lateral movement of the foldable bed 190 on the sleeping platform 140 when one or more occupants are resting on the foldable bed 190. As a result, the safety, ease of use, and practicality of the furniture object 100 may be improved.

Figure 8:
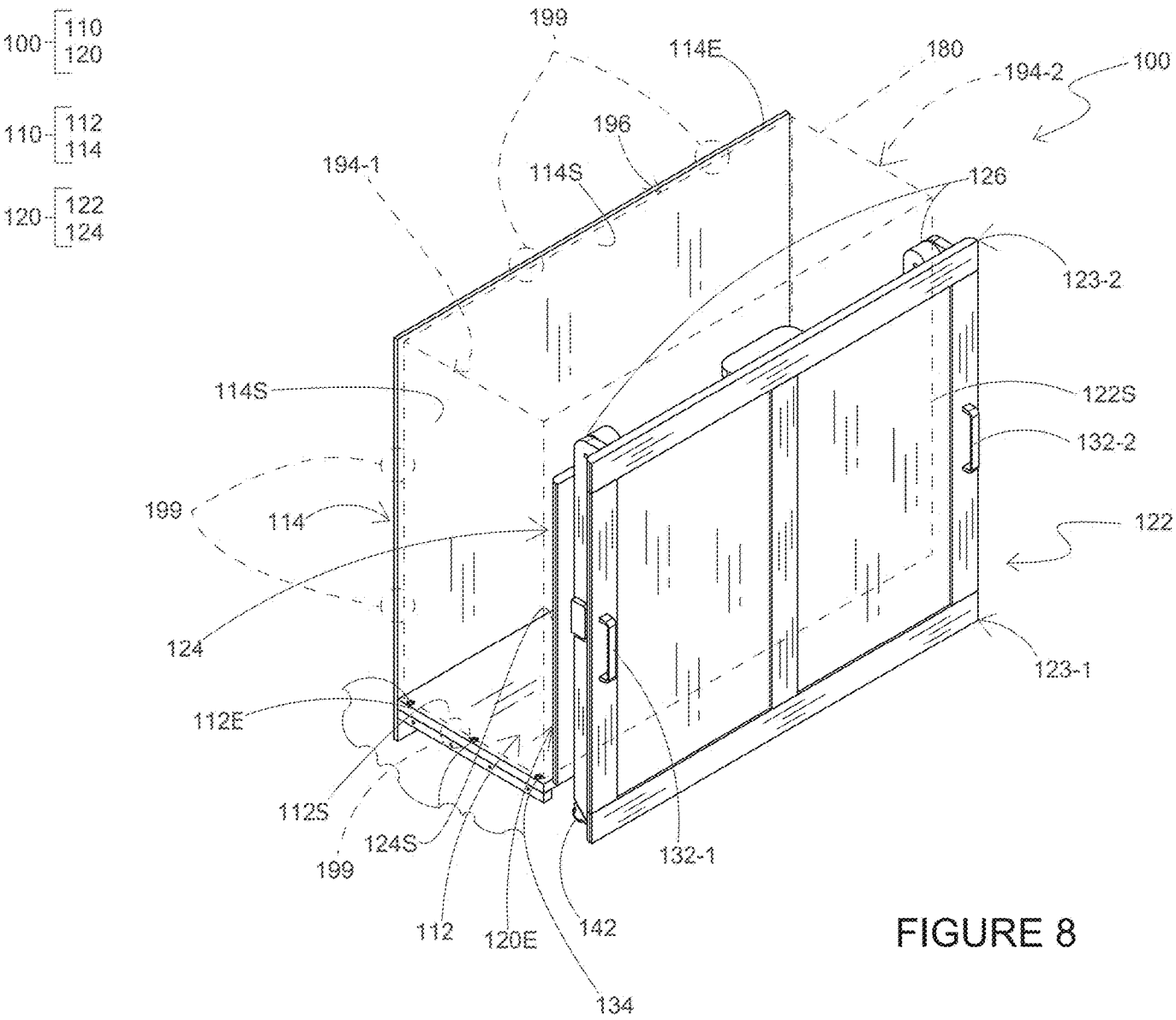
FIG. 8 is an upper front, left perspective view of a furniture object that includes a foldable support platform in a folded position according to some example embodiments.
Figure 9:
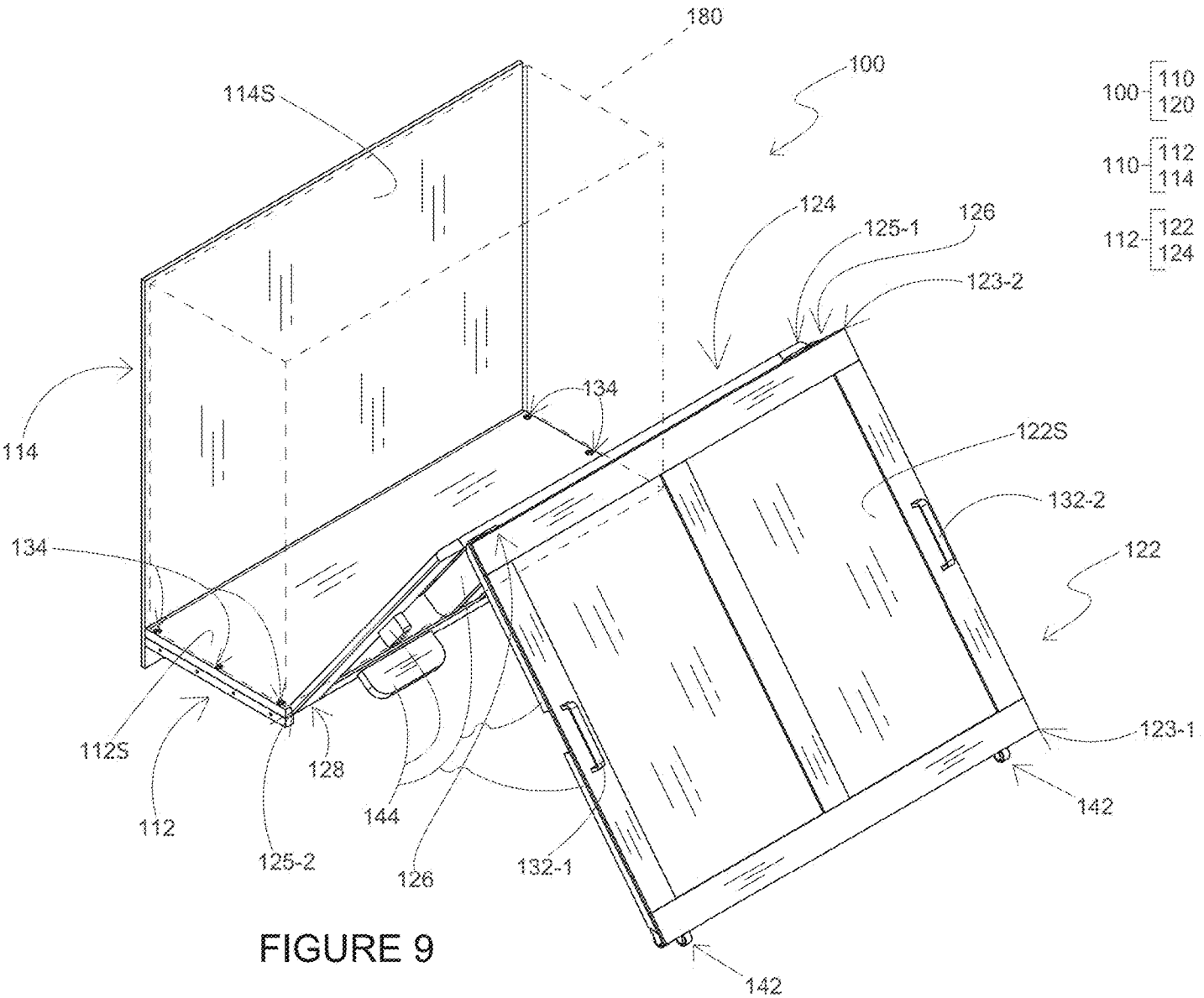
FIG. 9 is an upper front, left perspective view of a furniture object that includes a foldable support platform in a partially deployed position according to some example embodiments.
Figure 10:
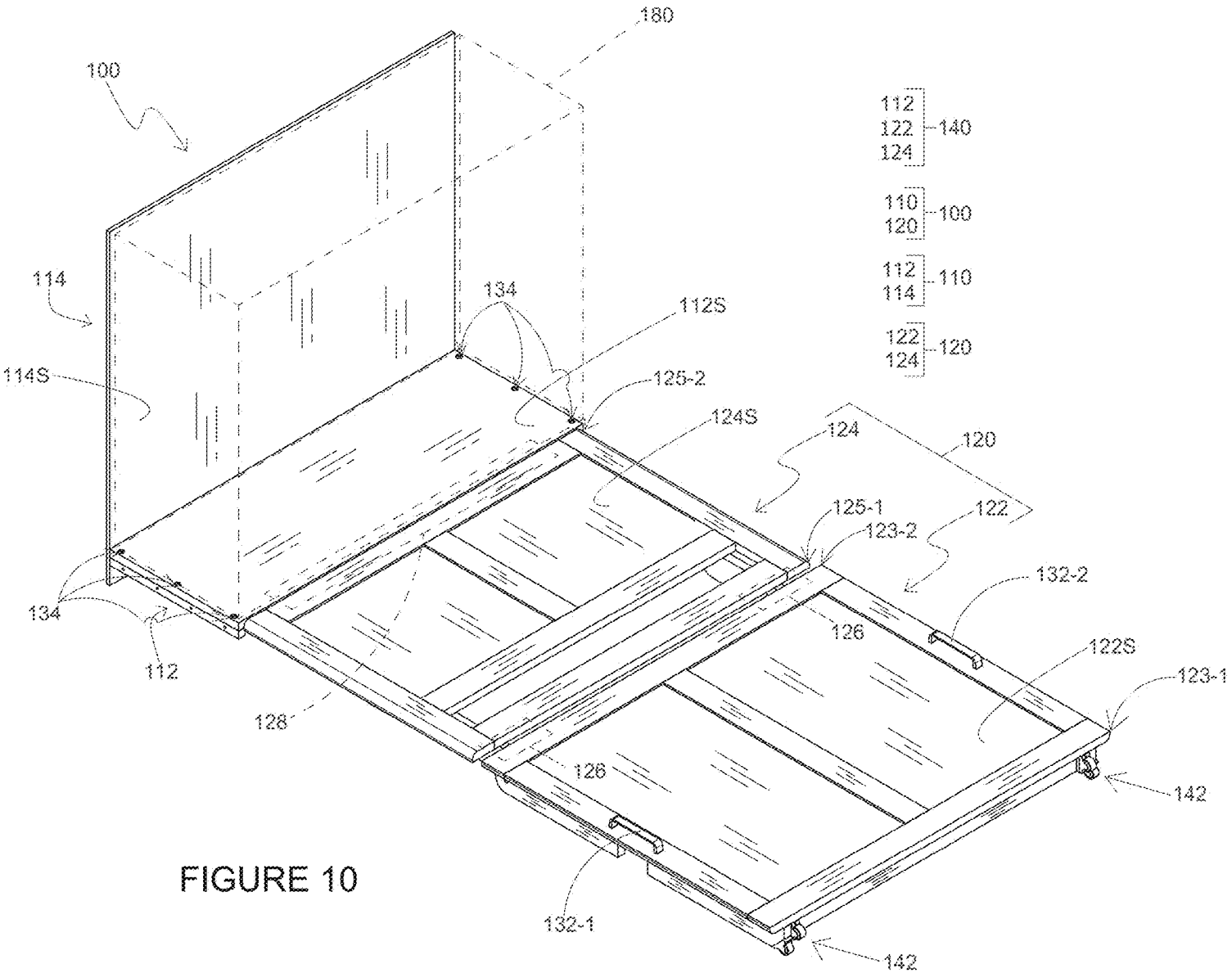
FIG. 10 is an upper front, left perspective view of a furniture object that includes a foldable support platform in a fully deployed position according to some example embodiments.
Figure 24A:
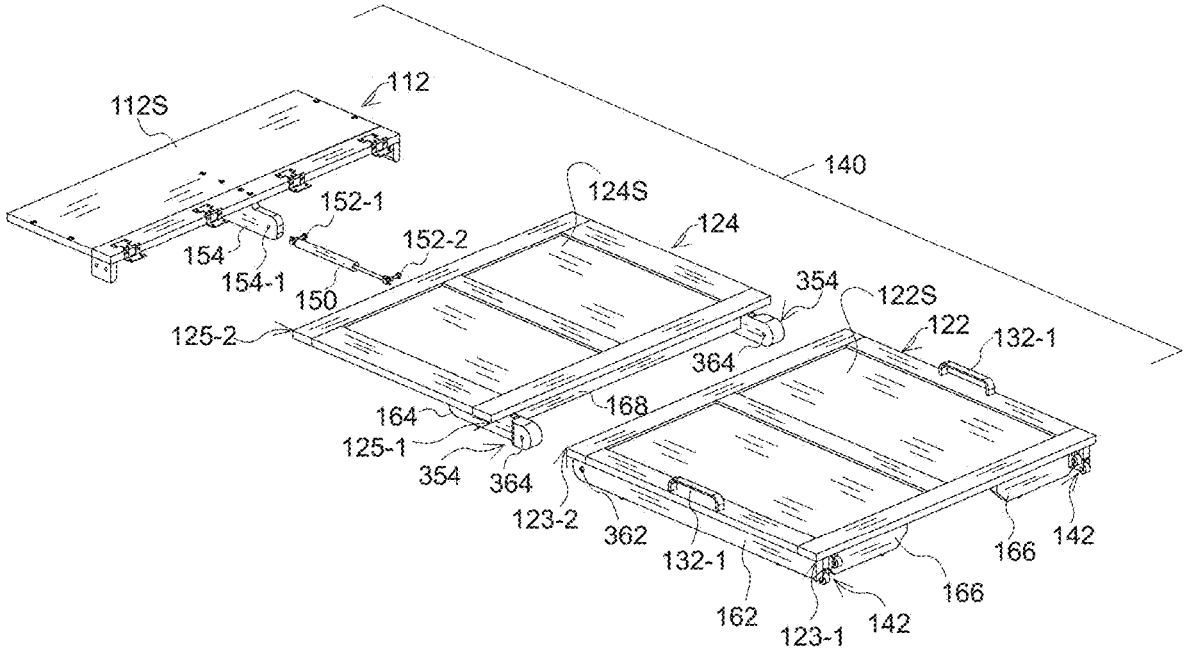
FIG. 24A is an expanded view of a furniture object according to some example embodiments.
Figure 24B:
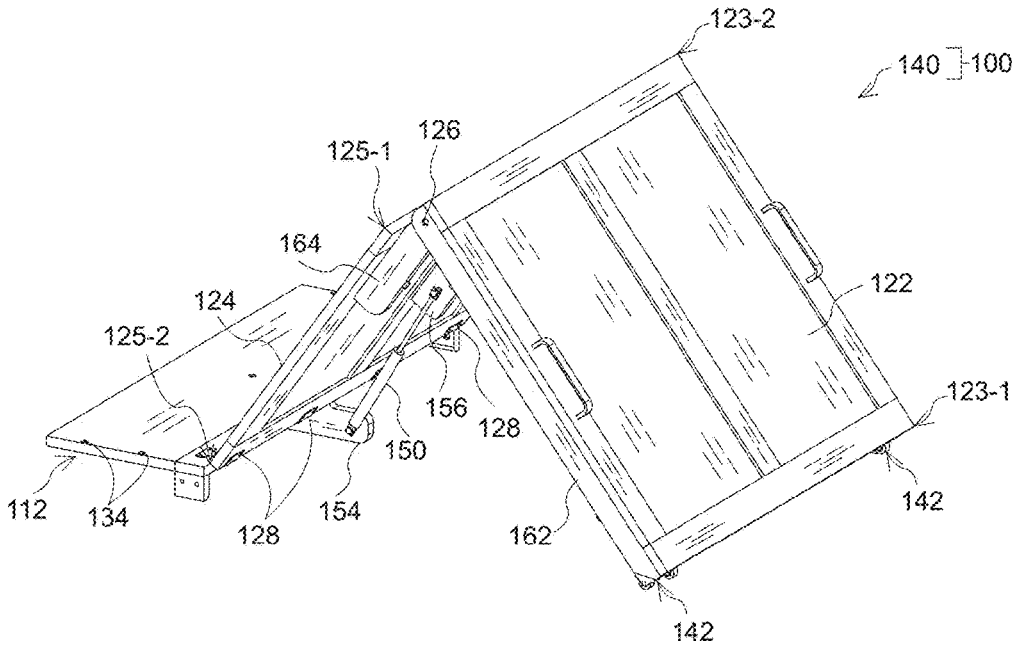
FIG. 24B is a upper front, left perspective view of the furniture object of FIG. 24A according to some example embodiments.

FIG. 8 is an upper front, left perspective view of a furniture object that includes a foldable support platform in a folded position according to some example embodiments. FIG. 9 is an upper front, left perspective view of a furniture object that includes a foldable support platform in a partially deployed position according to some example embodiments. FIG. 10 is an upper front, left perspective view of a furniture object that includes a foldable support platform in a fully deployed position according to some example embodiments. FIG. 24A is an expanded view of a furniture object according to some example embodiments. FIG. 24B is a upper front, left perspective view of the furniture object of FIG. 24A according to some example embodiments;

In some example embodiments, the compartment 180 of the furniture object 100 may not be fully ("completely") enclosed, within manufacturing tolerances and/or material tolerances, even when the foldable support platform 120 is in the folded position, such that the compartment 180 is only partially enclosed by the set of one or more fixed panels 110 and the foldable support platform 120. For example, as shown in FIGS. 8-10, in some example embodiments the set of one or more fixed panels 110 of the furniture object 100 may omit at least side and top panels, such that the set of one or more fixed panels 110 and the foldable support platform 120 only partially enclose the compartment 180, even when the foldable support platform 120 is in the folded position as shown in FIG. 8.

In the example embodiments shown in at least FIGS. 8-10, when the set of one or more fixed panels 110 includes a bottom panel 112 and a rear panel 114, the bottom, rear, and front inner surfaces of the compartment 180 may be defined by surfaces 112S, 114S, and 124S when the foldable support platform 120 is in the folded position, such that the rear panel 114, bottom panel 112, and foldable support platform 120 in the folded position may define and enclose bottom, rear, and front boundaries of the compartment 180. Additionally, the edges 114E, 112E, and 120E of the rear panel 114, bottom panel 112, and foldable support platform 120 shown in FIGS. 8-10 define opposing, unenclosed side boundaries 194-1 and 194-2 of the compartment 180, which may also be opposing, unenclosed side boundaries 194-1 and 194-2 of the furniture object 100, and edges 114E and 123-2 of the rear panel 114 and the foldable support platform 120 in the folded position define an unenclosed top boundary 196 of the compartment 180, which may also be an unenclosed top boundary 196 of the furniture object 100. Accordingly, the interior of the furniture object 100, within which the compartment 180 is defined as an open enclosure, may be understood to be the space within such defined, enclosed and unenclosed boundaries, and the compartment 180 may be understood to be fully defined but only partially enclosed by the set of one or more fixed panels 110 and the foldable support platform 120, and thus is an open enclosure within an interior of the furniture object 100.

In some example embodiments, a furniture object 100, even though not configured to completely enclose compartment 180, and thus define the compartment 180 as a closed enclosure within the interior of the furniture object, may be configured to be coupled to a separate article of furniture, such that the furniture object 100 and the separate article of furniture collectively completely enclose the compartment 180 as a closed enclosure when the foldable support platform 120 is in the folded position. As a result, the furniture object 100 may provide a modular capability to be incorporated into another, separate article of furniture, and may occupy otherwise empty, unused space in the separate article of furniture, thereby improving space utilization efficiency of the separate article of furniture and the furniture object 100 and thus improving the practicality of both the separate article of furniture and the furniture object 100.

In some example embodiments, the furniture object 100 may include one or more connection interfaces 199 configured to connect the one or more fixed panels 110 with a separate article of furniture to incorporate the furniture object 100 into the separate article of furniture. For example, as shown in FIG. 8, one or more edges of the set of one or more fixed panels 110, including one or more edges 114E of the rear panel 114, one or more edges 112E of the bottom panel 112, or the like, may include one or more connection interfaces 199 that may each be any structural connector known in the art, including an adhesive configured to bond the given edge with a structure of the separate article of furniture, a plug or slot structural connector configured to engage with a complementary structural connector of the separate article of furniture, a tongue or groove configured to engage with a complementary groove or tongue of the separate article of furniture to establish a complementary tongue and groove connection, any combination thereof, or the like. In some example embodiments, a furniture object 100 may be configured to be coupled to a separate article of furniture via any known means for structurally connecting two separate furniture objects or for constructing a furniture object.

Figure 11:
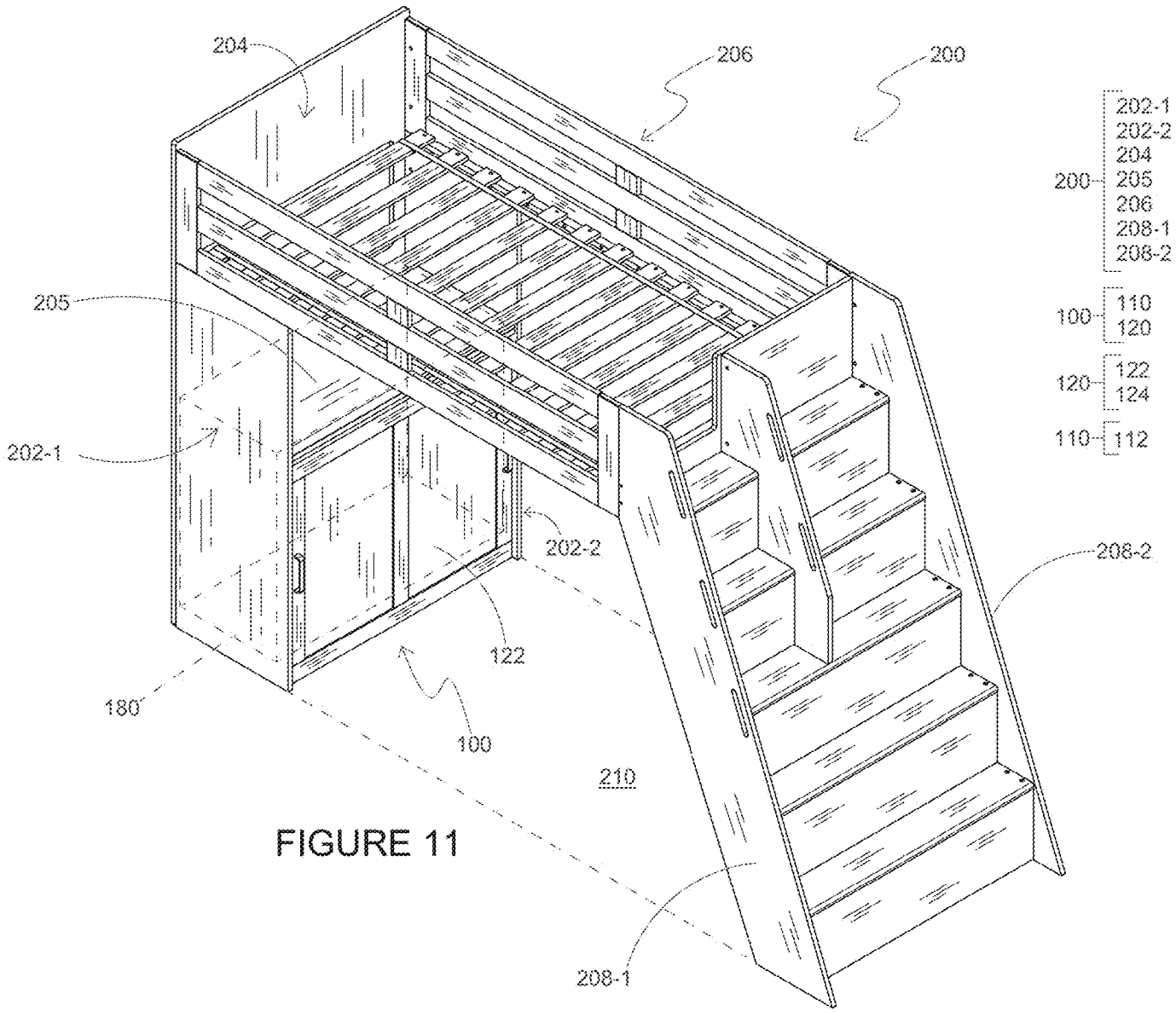
FIG. 11 is an upper front, left perspective view of a loft bed furniture article that is coupled to a furniture object that includes a foldable support platform in a folded position according to some example embodiments.
Figure 12:
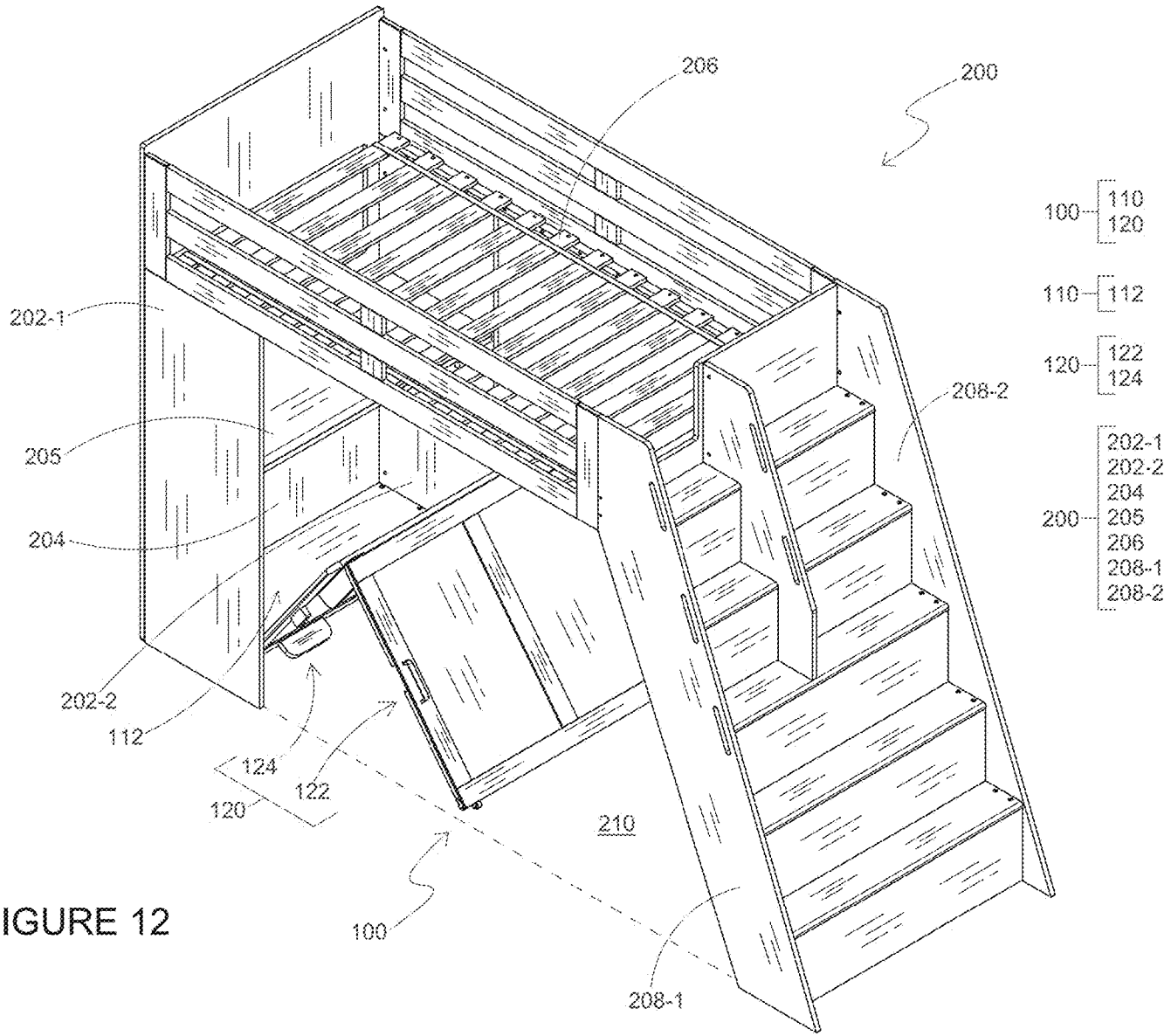
FIG. 12 is an upper front, left perspective view of a loft bed furniture article that is coupled to a furniture object that includes a foldable support platform in a partially deployed position according to some example embodiments.
Figure 13:
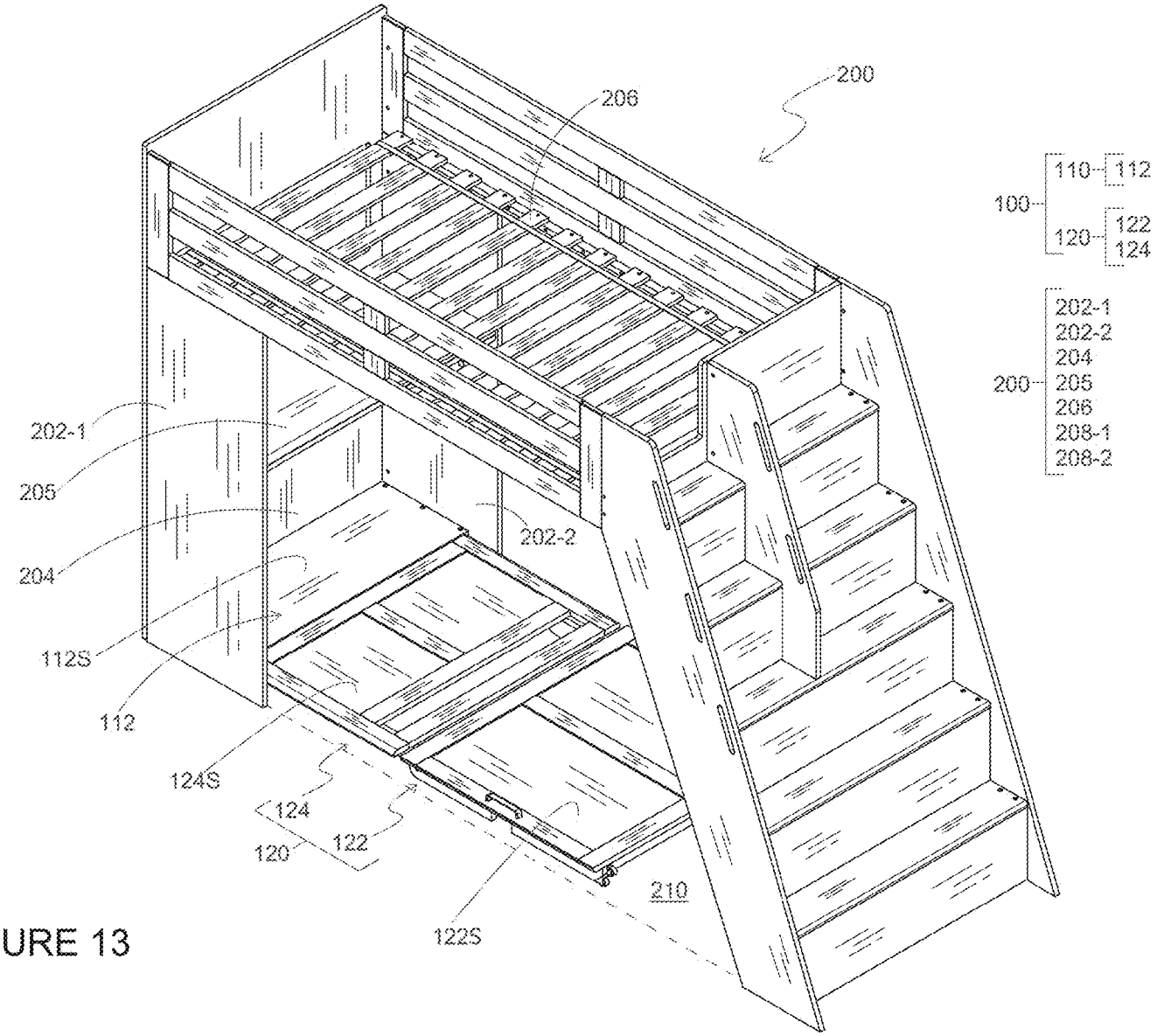
FIG. 13 is an upper front, left perspective view of a loft bed furniture article that is coupled to a furniture object that includes a foldable support platform in a fully deployed position according to some example embodiments.
Figure 25A:
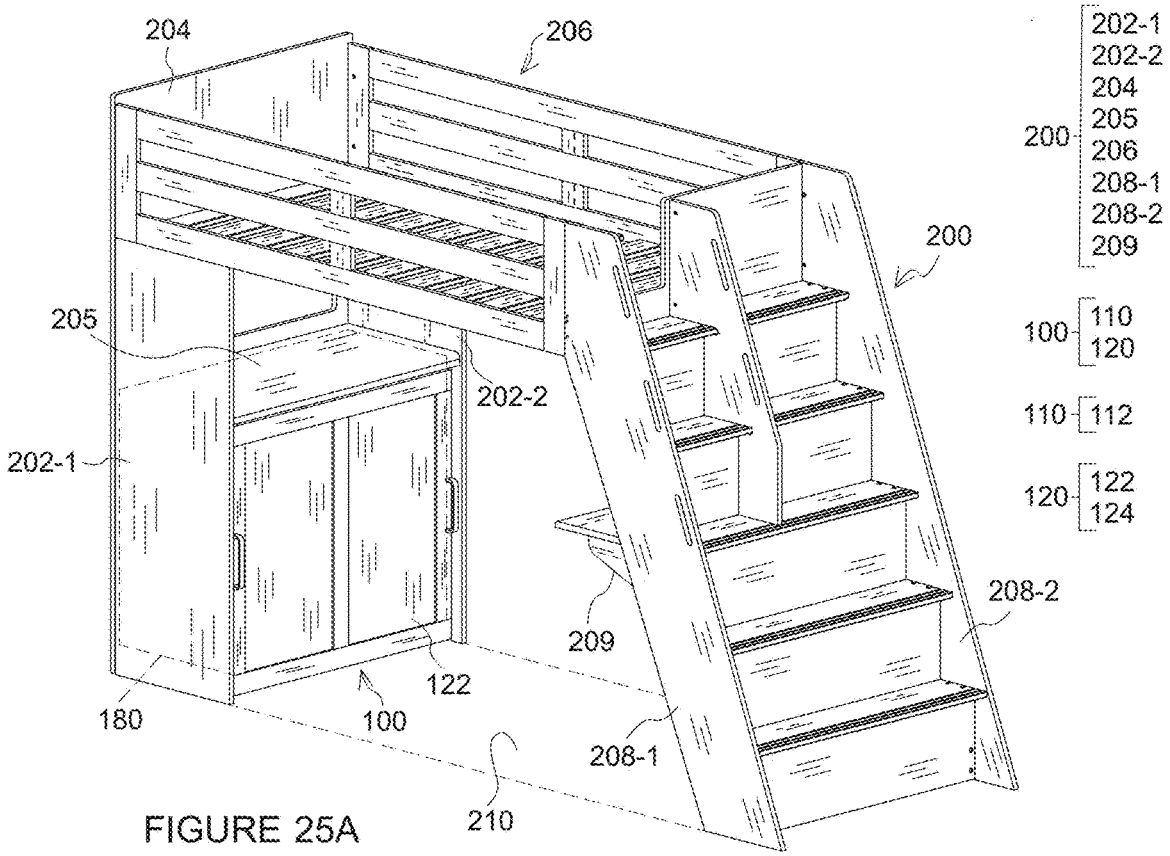
FIGS. 25A, 25B, 25C, and 25D are upper front, left perspective views of a loft bed furniture article that is coupled to a furniture object that includes a foldable support platform in various deployed positions according to some example embodiments.
Figure 25B:
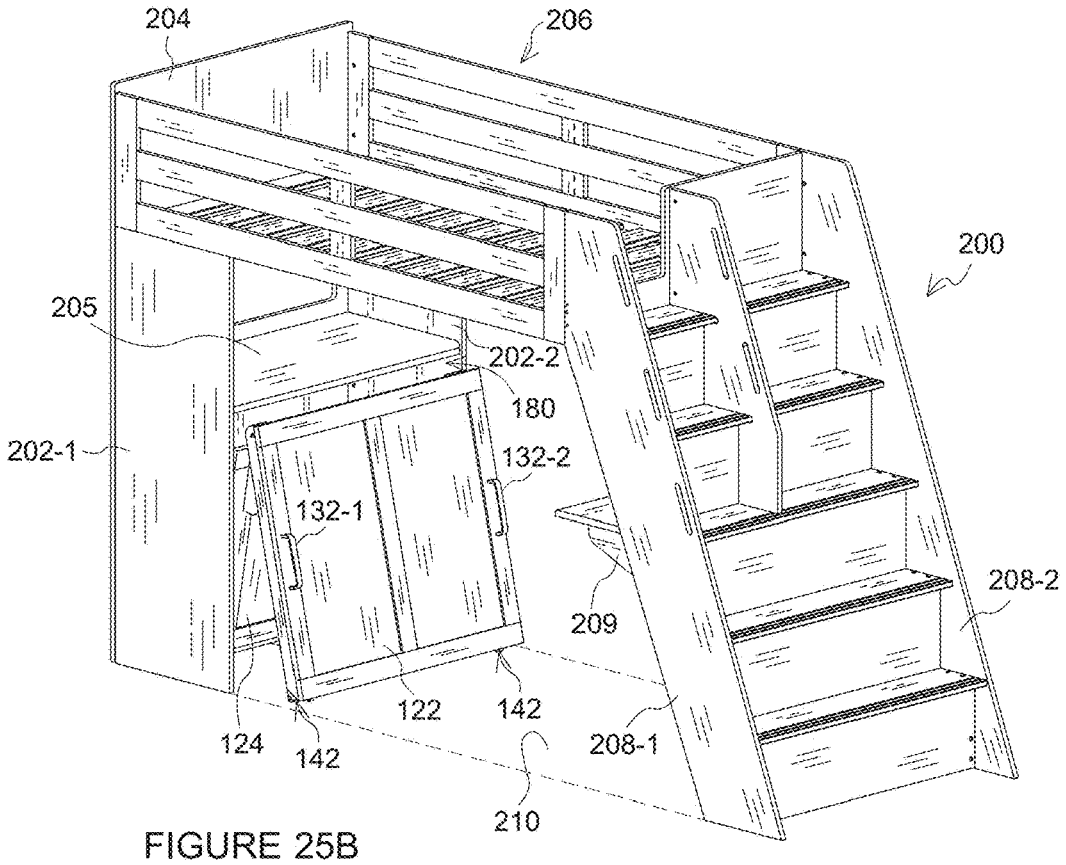
Figure 25C:
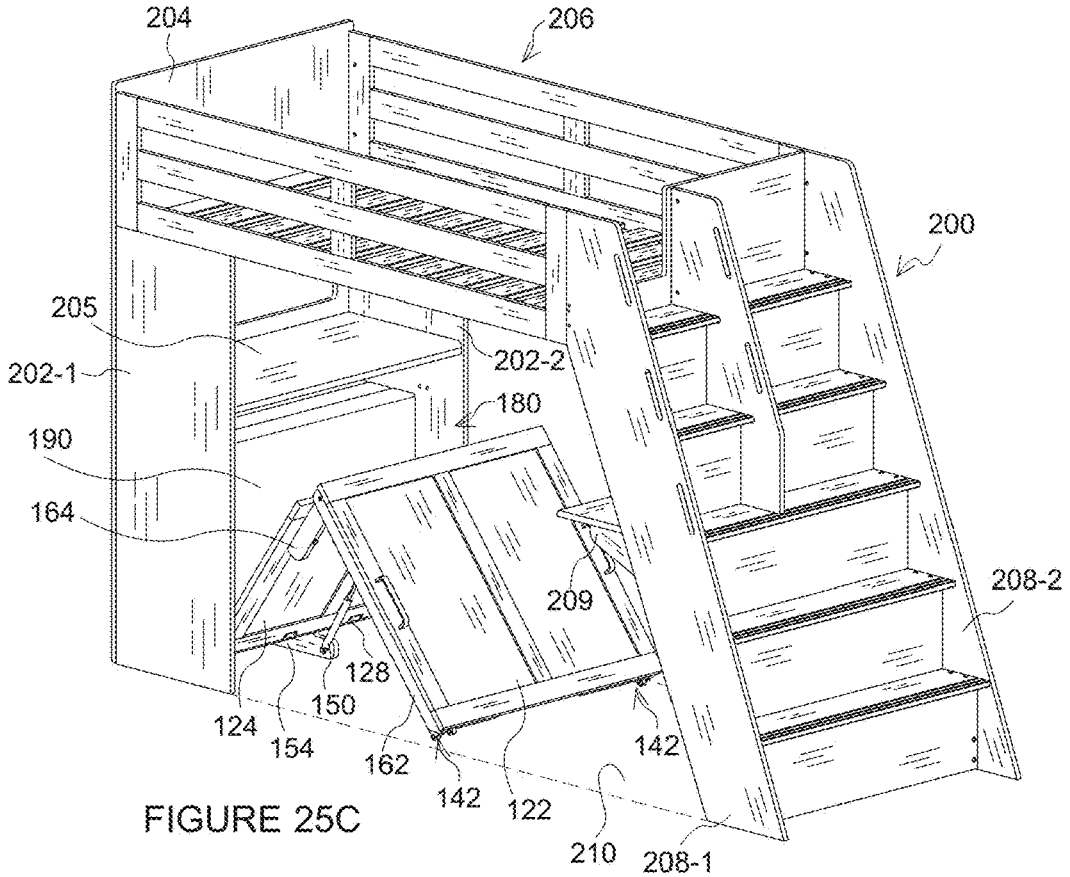
Figure 25D:
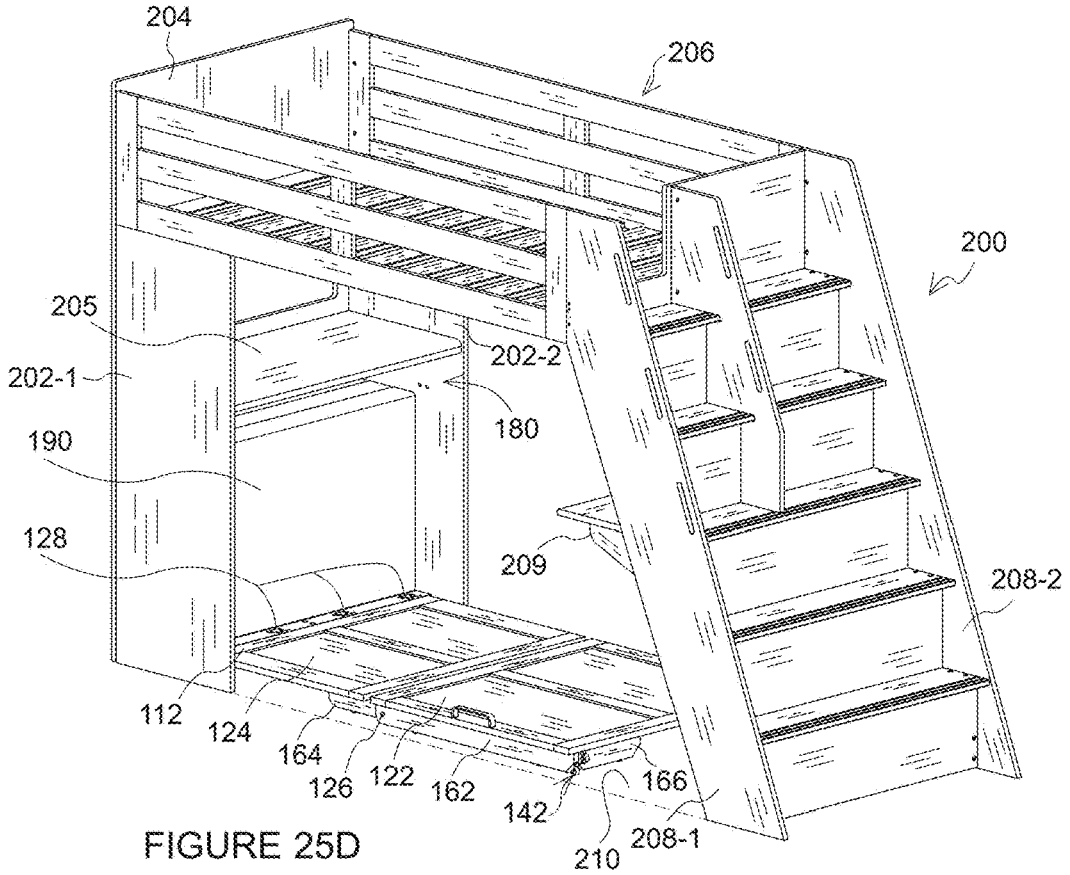
Figure 25E:
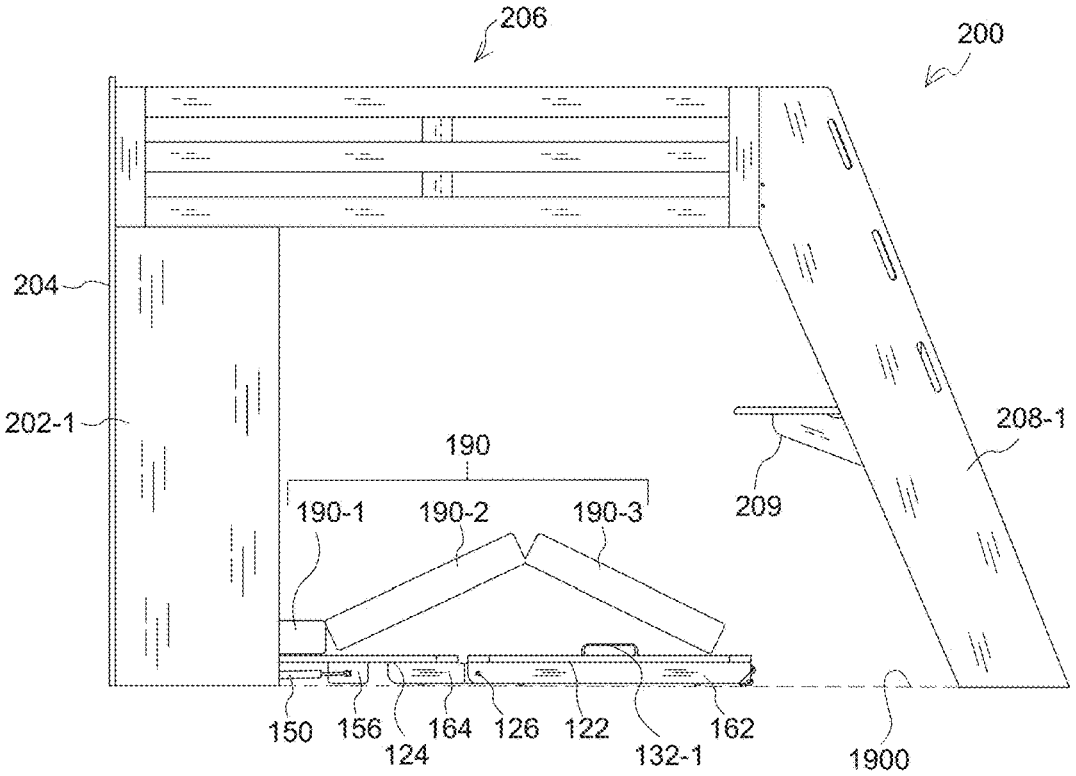
FIG. 25E is a left view of a loft bed furniture article that is coupled to a furniture object that includes a foldable support platform in a fully deployed position and with a foldable bed in a partially deployed position according to some example embodiments.
Figure 25F:
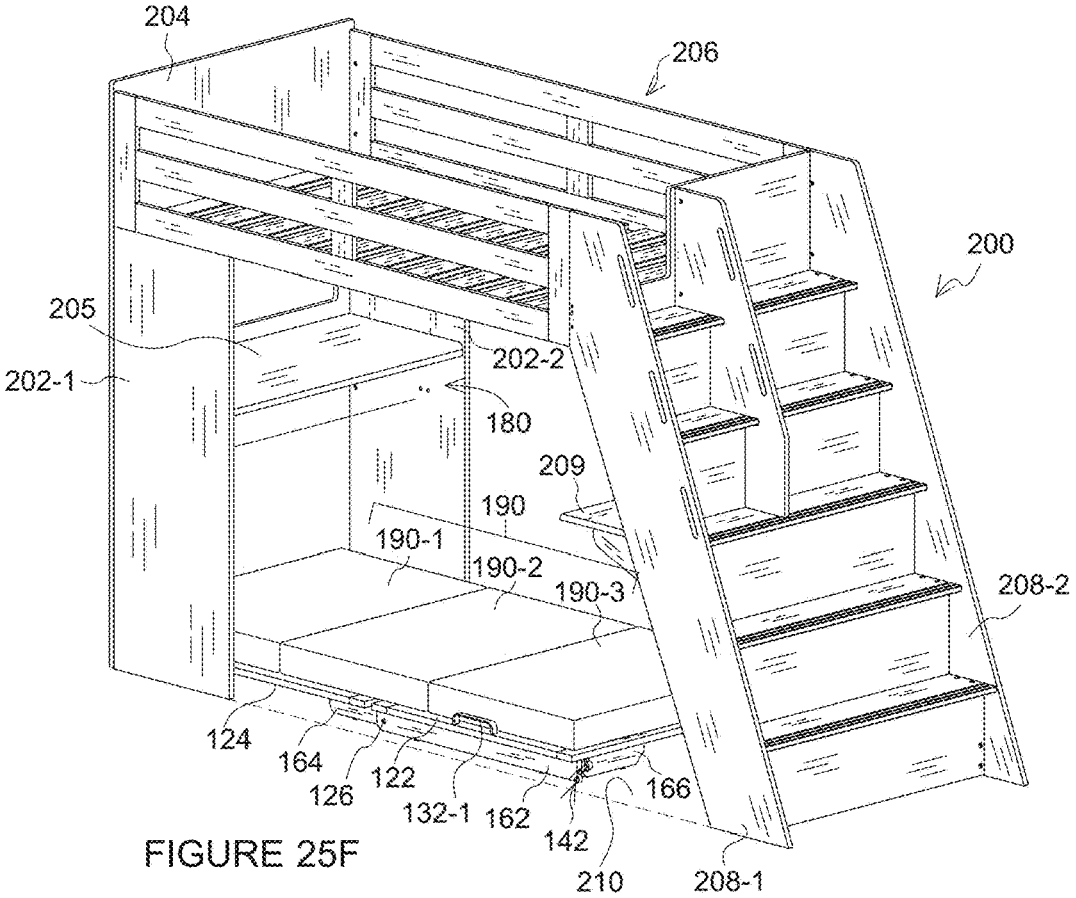
FIG. 25F is an upper front, left perspective view of a loft bed furniture article that is coupled to a furniture object that includes a foldable support platform in a fully deployed position and with a foldable bed in a fully deployed position according to some example embodiments.
Figure 26A:
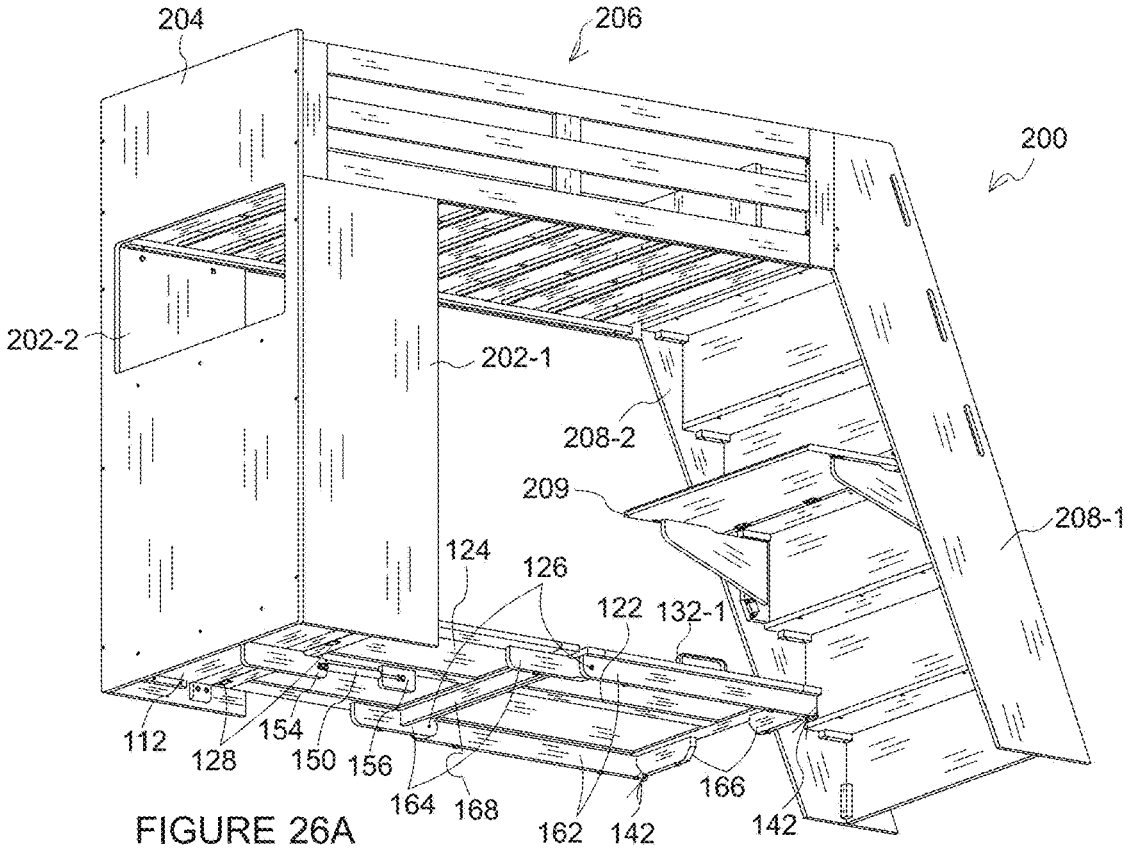
FIGS. 26A and 26B are lower rear, left perspective views of a loft bed furniture article that is coupled to a furniture object that includes a foldable support platform in a fully deployed position and with a foldable shelf in a various deployed positions according to some example embodiments.
Figure 26B:
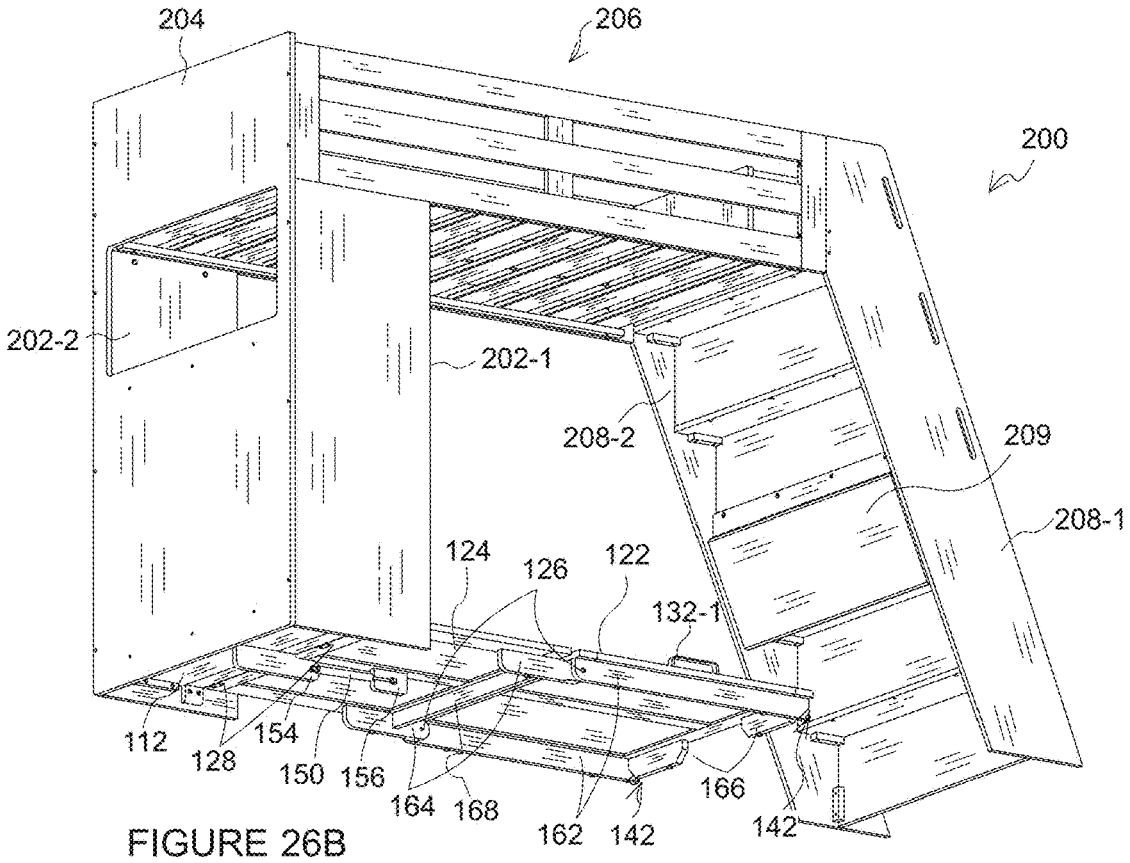

FIG. 11 is an upper front, left perspective view of a loft bed furniture article that is coupled to a furniture object that includes a foldable support platform in a folded position according to some example embodiments. FIG. 12 is an upper front, left perspective view of a loft bed furniture article that is coupled to a furniture object that includes a foldable support platform in a partially deployed position according to some example embodiments. FIG. 13 is an upper front, left perspective view of a loft bed furniture article that is coupled to a furniture object that includes a foldable support platform in a fully deployed position according to some example embodiments. FIGS. 25A, 25B, 25C, and 25D are upper front, left perspective views of a loft bed furniture article that is coupled to a furniture object that includes a foldable support platform in various deployed positions according to some example embodiments. FIG. 25E is a left view of a loft bed furniture article that is coupled to a furniture object that includes a foldable support platform in a fully deployed position and with a foldable bed in a partially deployed position according to some example embodiments. FIG. 25F is an upper front, left perspective view of a loft bed furniture article that is coupled to a furniture object that includes a foldable support platform in a fully deployed position and with a foldable bed in a fully deployed position according to some example embodiments. FIGS. 26A and 26B are lower rear, left perspective views of a loft bed furniture article that is coupled to a furniture object that includes a foldable support platform in a fully deployed position and with a foldable shelf in a various deployed positions according to some example embodiments.

In some example embodiments, including the example embodiments shown in FIGS. 11-13 and 25A-26B, a furniture object 100 may be coupled to a separate article of furniture 200, for example via one or more connection interfaces 199 included in the set of one or more fixed panels 110 as shown in FIG. 8, to incorporate the furniture object 100 into the separate article of furniture 200.

As shown in FIGS. 11-13 and 25A-26B, in some example embodiments, the furniture object 100 is configured to be coupled to the separate article of furniture 200 so that one or more structures of the separate article of furniture 200 at least partially enclose the compartment 180 as a closed enclosure within the separate article of furniture 200, so that the set of one or more fixed panels 110, the foldable support platform 120, and the one or more structures of the separate article of furniture 200 may collectively enclose the compartment 180 as a closed enclosure when the foldable support platform 120 is in the folded position, for example as shown in FIG. 11.

As shown in FIGS. 11-13 and 25A-26B, the set of one or more fixed panels 110 may be limited to a single fixed panel, for example the bottom panel 112, and the furniture object 100 may be coupled to the separate article of furniture 200 via coupling of one or more connection interfaces 199 in the bottom panel 112 to one or more structures 202-1, 202-2, and/or 204, such that one or more structures 202-1, 202-2, 204, and/or 205 complete the definition of all inner surfaces of the compartment 180 that are not defined by the foldable support platform 120 in the folded position and thus complete the enclosure of compartment 180 when the foldable support platform 120 is in the folded position.

In some example embodiments, the separate article of furniture 200 may be configured to structurally support a structural load, or weight, of at least a portion of the separate article of furniture over a first space 210 or "volume", independently of the furniture object 100, and the furniture object 100 may be configured to be coupled to at least one load-bearing structure of the separate article of furniture 200 so that the foldable support platform 120 is configured to move into the deployed position to position the proximate and distal support panels 124 and 122 in the first space 210 to be at least partially vertically overlapped by the portion of the separate article of furniture 200. For example, as shown in FIGS. 11-13 and 25A-26B, the separate article of furniture 200 may include a portion that is a loft bed 206 that is structurally supported over the first space 210 by load-bearing structures 202-1, 202-2, 204, 208-1, and 208-2. As shown, the furniture object 100 may be coupled to one or more of the load-bearing structures 202-1, 202-2, and 204 so that the foldable support platform 120 is configured to move into the deployed position to position the proximate and distal support panels 124 and 122 in the first space 210 to be at least partially vertically overlapped by the loft bed 206. In some example embodiments, the configuration of the foldable support platform 120 to move into the first space 210 as shown in FIGS. 12-13 and 25B-25D may enable improved efficiency of space utilization with regard to the first space 210, and the first space 210 may be utilized for usage of the foldable bed 190 when the foldable support platform 120 is in the deployed position and may additionally or alternatively be used for other uses when the foldable support platform 120 is in the folded position, thereby allowing the separate article of furniture 200 to provide improved versatility and space usage efficiency and therefore to have improved practicality.

While, as shown in FIGS. 1-13, 14A-21E, and 23A-26B, a furniture object 100 may include a foldable support platform 120 and a set of one or more fixed panels 110 (e.g., at least a bottom panel 112), it will be understood that, in some example embodiments, a furniture object 100 may not include any fixed panels 110 and may entirely comprise the foldable support platform 120, where the foldable support platform 120 includes one or more hingeable connections 128, connected to the proximate support panel 124 at edge 125-2, that are configured to hingeably connect the proximate support panel 124, and thus the foldable support platform 120, to a separate, fixed object, where the separate fixed object may include a separate article of furniture 200 as shown in FIGS. 11-13 and 25A-26B. For example, the hingeable connections 128 may be pivot pin connections configured to hingeably connect the proximate support panel 124 to separate, respective load-bearing structures 202-1 and 202-2.

As a result, it will be understood that a furniture object 100 that does not include any fixed panels 110 may be configured to be connected with a separate article of furniture (e.g., the separate article of furniture 200), for example to be incorporated into the separate article of furniture 200, to store a foldable bed 190. Such a furniture object 100 may include a foldable support platform 120 including distal and proximate support panels 122 and 124, the proximate support panel 124 hingeably connected (e.g., via one or more hingeable connections 126) at a first edge 125-1 to the distal support panel 122, the proximate support panel 124 configured to be hingeably connected (e.g., via one or more hingeable connections 128) at an opposite, second edge 125-2 to the separate article of furniture (e.g., to one or more fixed structures (e.g., 202-1, 202-2, 204, and 205 of the separate article of furniture 200) to which the furniture object 100 may be hingeably connected as shown for example in FIGS. 11-13 and 25A-26B). Such a foldable support platform 120 may be configured to move between a folded position and a deployed position via a scissors-type motion, wherein, in the folded position, the foldable support platform 120 at least partially encloses a compartment 180 that is at least partially enclosed by the separate article of furniture (e.g., 200), such that a first surface 122S of the distal support panel defines an outer surface of the separate article of furniture 200 and a first surface 124S of the proximate support panel 124 defines a front inner surface of the compartment 180, and, in the deployed position, the foldable support platform 120 at least partially (e.g., entirely, partially in combination with one or more fixed structures of the separate article of furniture 200, or the like) defines a sleeping platform 140 configured to structurally support the foldable bed 190 resting, in an unfolded configuration, on at least the first surfaces 124S and 122S of the proximate and distal support panels 124 and 122, such that the first surfaces 122S and 124S of the distal and proximate support panels 122 and 124 are coplanar with each other and face upwards, away from the support surface upon which the separate article of furniture 200 is resting (e.g., support surface 1900) such that the upwards-facing, coplanar surfaces 122S, 124S, 112S are configured to directly contact the underside of the foldable bed 190 resting on the sleeping platform 140 in the unfolded configuration and thus structurally support the foldable bed 190 resting on the sleeping platform 140 in the unfolded configuration.

In some example embodiments, the foldable support platform 120 of a furniture object 100 that does not include any fixed panels 110 may not, in combination with separate structures of an article of furniture (e.g., 200) to which the furniture object 100 is hingeably connected, define and/or enclose a compartment 180. Accordingly, the foldable support platform 120 may be configured to move between a folded position and a deployed position via a scissors-type motion wherein, in the folded position, the foldable support platform 120 may at least partially define an outer surface of the separate article of furniture 200 to which the furniture object 100 may be hingeably connected as shown in FIGS. 11-13 and 25A-26B, such that a first surface 122S of the distal support panel 122 defines an outer surface of the furniture object 100 and, in the deployed position, the foldable support platform 120 at least partially or entirely defines a sleeping platform 140 configured to structurally support the foldable bed 190 resting, in an unfolded configuration, on at least or entirely on the first surfaces 124S and 122S of the proximate and distal support panels 124 and 122, such that the first surfaces 122S and 124S of the distal and proximate support panels 122 and 124 are coplanar with each other and face upwards, away from the support surface upon which the separate article of furniture 200 is resting (e.g., support surface 1900) such that the upwards-facing, coplanar surfaces 122S, 124S, 112S are configured to directly contact the underside of the foldable bed 190 resting on the sleeping platform 140 in the unfolded configuration and thus structurally support the foldable bed 190 resting on the sleeping platform 140 in the unfolded configuration. As shown in FIGS. 25A-25D, the foldable bed 190 may be held in the compartment 180 and may remain in a folded configuration while the foldable support platform 120 is moved from a folded position, for example as shown in FIG. 25A, to a fully deployed position, for example as shown in FIG. 25D, to establish the sleeping platform 140. As further shown in FIGS. 25E-25F, the foldable bed 190 may then, subsequently to the sleeping platform being established as shown in FIG. 25D, be unfolded at least partially out of the compartment 180, and similarly to as shown in at least FIGS. 6-7 and 23A-23C, to a fully deployed configuration as shown in FIG. 25F.

In some example embodiments, including the example embodiments shown in FIGS. 25A-26B, the separate article of furniture 200 may include a separate deployable structure, including the deployable structure 209 shown in FIGS. 25A-26, that may be adjustably deployed into the same space 210 into which the foldable support platform 120 may deploy, separately, and independently of the deployment or folding of the foldable support platform 120. As a result, the separate deployable structure 209 may enable the separate article of furniture 200 to provide additional and/or separate utilization of the space 210, thereby improving the utility of the separate article of furniture 200. For example, the separate deployable structure 209 may be configured to be deployed into the space 210 into a deployed configuration, as shown in FIG. 26A, when the foldable support platform 120 is in the folded position as shown in FIG. 25A, to enable manual utilization of the deployable structure 209 as a desk within the space 210, and where the deployable structure 209 may be folded into a folded position, as shown in FIG. 26B, when the foldable support platform 120 is in the deployed position as shown in at least FIGS. 25D-25F, to enable improved utilization of the foldable bed 190 when deployed as shown in FIG. 25F.

While the separate article of furniture 200 is shown in FIGS. 11-13 and 25A-26B to include a loft bed 206, it will be understood that the separate article of furniture 200 may include other additional or alternative articles of furniture, including, without limitation, a dresser, a sofa, a chair, a desk, any combination thereof, or the like.

The description of the disclosure is merely example in nature and, thus, variations that do not depart from the gist of the disclosure are intended to be within the scope of the disclosure. Such variations are not to be regarded as a departure from the spirit and scope of the disclosure.

What is claimed is:

1. A furniture object configured to store a foldable bed, the furniture object comprising:

one or more fixed panels partially enclosing a compartment within an interior of the furniture object, the one or more fixed panels including a bottom panel, an upper surface of the bottom panel at least partially defining a bottom inner surface of the compartment; and a foldable support platform including proximate and distal support panels, the proximate support panel hingeably connected at a first edge of the proximate support panel to the distal support panel, the proximate support panel hingeably connected at a second edge of the proximate support panel to the one or more fixed panels, the first and second edges of the proximate support panel being opposite edges of the proximate support panel, the foldable support platform configured to move between a folded position and a deployed position via a scissors-type motion, wherein in the folded position, the foldable support platform at least partially encloses the compartment, such that a first surface of the distal support panel defines an outer surface of the furniture object and a first surface of the proximate support panel defines a front inner surface of the compartment, and in the deployed position, the foldable support platform at least partially defines a sleeping platform configured to structurally support the foldable bed resting, in an unfolded configuration, on at least the first surfaces of the proximate and distal support panels, such that the first surfaces of the proximate and distal support panels are coplanar with each other and face upwards such that the coplanar first surfaces are collectively configured to directly contact an underside of the foldable bed resting on the sleeping platform in the unfolded configuration, wherein the distal support panel includes a set of rollers connected at a distal end of the distal support panel, wherein the set of rollers are configured to roll on a support surface such that the set of rollers at least partially structurally support the distal end of the distal support panel on the support surface during an entirety of movement of the foldable support platform between the folded position and at least a threshold partially-deployed position, wherein the foldable support platform is configured to, in response to being at the threshold partially-deployed position, move towards the deployed position such that one or more rollers of the set of rollers roll on the support surface while at least partially structurally supporting the distal end of the distal support panel on the support surface during at least a portion of the movement from the threshold partially-deployed position to the deployed position, based on hingeably connected proximate edges of the proximate and distal support panels moving downwards towards the support surface based on a weight of the proximate and distal support panels.

2. The furniture object of claim 1, wherein the one or more fixed panels includes a rear panel, a surface of the rear panel defining a rear inner surface of the compartment, the rear inner surface opposing the front inner surface defined by the first surface of the proximate support panel when the foldable support platform is in the folded position.

3. The furniture object of claim 2, wherein the one or more fixed panels includes a top panel, a bottom surface of the top panel defining a top inner surface of the compartment, and opposing side panels extending at least between opposite edges of the top panel and opposite edges of the bottom panel and further extending orthogonally from opposite edges of the rear panel, wherein opposing side surfaces of the opposing side panels define opposing side inner surfaces of the compartment.

4. The furniture object of claim 3, wherein each side panel of the opposing side panels includes a stop structure configured to restrict motion of the proximate support panel into the interior of the furniture object when the foldable support platform is in the folded position.

5. The furniture object of claim 1, wherein the one or more fixed panels includes one or more connection interfaces configured to connect the one or more fixed panels with a separate article of furniture to incorporate the furniture object into the separate article of furniture.

6. The furniture object of claim 5, wherein the separate article of furniture is configured to structurally support at least a portion of the separate article of furniture over a first space, independently of the furniture object, and the furniture object is configured to be coupled to at least one load-bearing structure of the separate article of furniture so that the foldable support platform is configured to move into the deployed position to position the proximate and distal support panels in the first space to be at least partially vertically overlapped by the portion of the separate article of furniture.

7. The furniture object of claim 6, wherein the portion of the separate article of furniture is a loft bed structurally supported by one or more load-bearing structures over the first space.

8. The furniture object of claim 6, wherein the at least one load-bearing structure at least partially encloses the compartment.

9. The furniture object of claim 1, further comprising:

a lift mechanism, connected at opposite ends to the one or more fixed panels and the foldable support platform, respectively, the lift mechanism configured to control a rate at which the foldable support platform moves between the folded position and the deployed position.

10. The furniture object of claim 9, further comprising:

a plurality of lift mechanisms, the plurality of lift mechanisms including the lift mechanism, the plurality of lift mechanisms each connected between a separate fixed panel of the one or more fixed panels and a separate, opposite edge of the foldable support platform.

11. The furniture object of claim 9, wherein the lift mechanism includes a piston lift mechanism.

12. The furniture object of claim 9, wherein the lift mechanism is connected, at one end, to the proximate support panel at a location on the proximate support panel that is between the first edge of the proximate support panel that is hingeably connected to the distal support panel, and the second edge of the proximate support panel that is hingeably connected to the one or more fixed panels.

13. The furniture object of claim 1, wherein the distal support panel includes a set of handles including at least two handles at opposite ends of the first surface of the distal support panel, the at least two handles having respective longitudinal axes that extend in parallel with each other, and the at least two handles are configured to align a longitudinal axis of the foldable bed resting on the foldable support platform between the at least two handles with a separate longitudinal axis extending through the bottom panel and the proximate and distal support panels, based on the foldable support platform being in the deployed position.

14. The furniture object of claim 1, wherein the furniture object is configured to hold the foldable bed in a folded configuration entirely within the compartment when the foldable support platform is in the folded position, such that the foldable bed is isolated from direct contact with the first surface of the distal support panel, and the foldable bed is entirely absent from being between the proximate and distal support panels.

15. The furniture object of claim 1, wherein in the deployed position, the foldable support platform, in combination with the bottom panel, define the sleeping platform such that the sleeping platform is configured to structurally support the foldable bed resting, in the unfolded configuration, on the first surfaces of the proximate and distal support panels and the upper surface of the bottom panel, such that the first surfaces of the proximate and distal support panels are coplanar with each other and with the upper surface of the bottom panel.

16. The furniture object of claim 1, wherein the proximate and distal support panels are hingeably connected together via at least one pivot pin connection, the at least one pivot pin connection connects the proximate and distal support panels based on connecting respective support structures that have one or more protruding structures that cause the at least one pivot pin connection to be spaced apart from one or both of the hingeably connected proximate edges of the proximate and distal support panels, such that the foldable support platform is configured to cause the hingeably connected proximate edges of the proximate and distal support panels to not contact each other when the first surfaces of the proximate and distal support panels are coplanar with each other and face upwards.

17. A furniture object configured to be coupled with a separate article of furniture to store a foldable bed, the furniture object comprising:

a foldable support platform including proximate and distal support panels, the proximate support panel hingeably connected at a first edge of the proximate support panel to the distal support panel, the proximate support panel hingeably connected at a second edge of the proximate support panel to the separate article of furniture, the first and second edges of the proximate support panel being opposite edges of the proximate support panel, the foldable support platform configured to move between a folded position and a deployed position via a scissors-type motion, wherein in the folded position, the foldable support platform at least partially encloses a compartment that is at least partially enclosed by the separate article of furniture, such that a first surface of the distal support panel defines an outer surface of the separate article of furniture and a first surface of the proximate support panel defines a front inner surface of the compartment, and in the deployed position, the foldable support platform at least partially defines a sleeping platform configured to structurally support the foldable bed resting, in an unfolded configuration, on at least the first surfaces of the proximate and distal support panels, such that the first surfaces of the proximate and distal support panels are coplanar with each other and face upwards such that the coplanar first surfaces are collectively configured to directly contact an underside of the foldable bed resting on the sleeping platform in the unfolded configuration, wherein the distal support panel includes a set of rollers connected at a distal end of the distal support panel, wherein the set of rollers are configured to roll on a support surface such that the set of rollers at least partially structurally support the distal end of the distal support panel on the support surface during an entirety of movement of the foldable support platform between the folded position and at least a threshold partially-deployed position, wherein the foldable support platform is configured to, in response to being at the threshold partially-deployed position, move towards the deployed position such that one or more rollers of the set of rollers roll on the support surface while at least partially structurally supporting the distal end of the distal support panel on the support surface during at least a portion of the movement from the threshold partially-deployed position to the deployed position, based on hingeably connected proximate edges of the proximate and distal support panels moving downwards towards the support surface based on a weight of the proximate and distal support panels.

18. A method of operating a furniture object to deploy foldable support platform, the furniture object resting on a support surface, the furniture object including one or more fixed panels partially enclosing a compartment within an interior of the furniture object, the one or more fixed panels including a bottom panel, an upper surface of the bottom panel at least partially defining a bottom inner surface of the compartment, the furniture object further including the foldable support platform including proximate and distal support panels, the proximate support panel hingeably connected at a first edge of the proximate support panel to the distal support panel, the proximate support panel hingeably connected at a second edge of the proximate support panel to the one or more fixed panels, the first and second edges of the proximate support panel being opposite edges of the proximate support panel, the method comprising:

applying a driver force on the distal support panel to cause a distal end of the distal support panel to move, in a first direction parallel to the support surface, away from a distal edge of the proximate support panel that is the second edge of the proximate support panel that is hingeably connected to the one or more fixed panels, to cause the foldable support platform to move from a folded position to a threshold partially-deployed position via a scissors-type motion, wherein the distal support panel includes a set of rollers connected at the distal end of the distal support panel, wherein the set of rollers are configured to roll on the support surface such that the set of rollers at least partially structurally support the distal end of the distal support panel on the support surface during an entirety of movement of the foldable support platform between the folded position and at least the threshold partially-deployed position, wherein, in response to the foldable support platform moving to the threshold partially-deployed position, hingeably connected proximate edges of the proximate and distal support panels are caused to move downwards towards the support surface based on a weight of the proximate and distal support panels, such that the foldable support platform moves from the threshold partially-deployed position to a fully deployed position via the scissors-type motion such that one or more rollers of the set of rollers roll on the support surface while at least partially structurally supporting the distal end of the distal support panel on the support surface during at least a portion of the movement from the threshold partially-deployed position to the fully deployed position to cause first surfaces of the proximate and distal support panels to be coplanar with each other and face upwards to at least partially define a sleeping platform configured to directly contact and structurally support a foldable bed resting, in an unfolded configuration, on at least the first surfaces of the proximate and distal support panels.

19. The method of claim 18, wherein, in response to the foldable support platform moving to the threshold partially-deployed position, the foldable support platform moves from the threshold partially-deployed position to the fully deployed position without any further application of driver force to the foldable support platform.

* * * * *